US006953000B2

(12) United States Patent
Fink

(10) Patent No.: US 6,953,000 B2
(45) Date of Patent: Oct. 11, 2005

(54) UNIVERSALLY COMPATIBLE, SEMI-ELLIPTICAL, VERTICALLY DEPLOYED SAIL SYSTEM FOR WIND—PROPELLED VEHICLES

(76) Inventor: Lowell S. Fink, 87 Av. du Mt. Alban-Villa Margaux-Nice, Nice 06300 (FR)

( * ) Notice: Subject to any disclaimer, the term of this patent is extended or adjusted under 35 U.S.C. 154(b) by 126 days.

(21) Appl. No.: 10/841,535

(22) Filed: May 10, 2004

(65) Prior Publication Data

US 2004/0244665 A1 Dec. 9, 2004

Related U.S. Application Data

(63) Continuation-in-part of application No. 09/781,167, filed on Feb. 13, 2001, now abandoned.
(60) Provisional application No. 60/182,207, filed on Feb. 14, 2000.

(51) Int. Cl.[7] ..... B63H 9/04
(52) U.S. Cl. ..... 114/102.1
(58) Field of Search ..... 114/102.1, 104, 114/105, 106, 107, 102.12, 102.14, 102.15

(56) References Cited

U.S. PATENT DOCUMENTS 4,688,506 A * 8/1987 van Breems ..... 114/104
5,445,098 A * 8/1995 Marechal ..... 114/102.16
5,632,215 A * 5/1997 Moessnang et al. ..... 114/104

* cited by examiner

*Primary Examiner*—Ed Swinehart

(57) ABSTRACT

A comprehensive System of hoisted, universally compatible, semi-elliptical mainsails and self-tacking headsails. Reducing weight on deck and aloft and fully cockpit-controlled, self-boomed System sails replace cumbersome conventional genoas and rigid booms with self-boomed, overlapping, self-tacking, semi-elliptical headsails and mainsails. Each sail assures optimum sail interface. Synergism between aerodynamic headboard-end plate combinations, integrated alternate energy, and maximum sailing efficiency optimizes convenience, safety and performance. Overlapping Maxjib (26), Non-overlapping Maxjib (28) and self-boomed Maxmain (30) are self-boomed, self-tacking hoisted sails. External-spar Maxmain (32) provides unique new System benefits for boomed mainsail configurations. Usable in various combinations, entirely new sail types assure cost savings for boat builders and users alike: Cost-effective sail power for both recreational and commercial users of wind-powered vehicles as well as new markets for boat builders and sail makers.

20 Claims, 11 Drawing Sheets

UNIVERSALLY COMPATIBLE, SEMI-ELLIPTICAL, VERTICALLY DEPLOYED SAIL SYSTEM FOR WIND— PROPELLED VEHICLES

CROSS REFERENCE TO RELATED APPLICATIONS

The present application is a Continuation-in-part of U.S. patent application Ser. No. 09/781,167 Priority Filing date Feb. 13, 2001, now abandoned which claims the benefit of provisional application No. 60/182,207 filed Feb. 14, 2000.

BACKGROUND

1. Field of Invention
2. Overview of the Prior Art

Performance Versus Convenience and Safety Priorities: 1925 to Date

Until 1975, sailmakers primarily marketed sail performance or sail durability. Technology for convenient sail handling was still in the future, and easy-to-use high performance sails were unimaginable. In 1975, truly functional convenience and safety-oriented sail handling technology began to appear, promising to make sailing easier and safer but imposing significant performance compromises.

Notwithstanding inevitable performance compromises, boat owners and new boat buyers increasingly opted for easily controlled, or "convenient" sails. Sail design dictum inescapably cast optimum sail performance and optimum sail handling convenience as irreconcilable adversaries.

An Ongoing Geometric Prohibition of Efficient Sail Design

A 1925 discovery revealed that triangular sail form was the least efficient form possible, and that elliptical sail form was the most efficient form possible. Unfortunately, conventional sailboat rig geometry would impede application of that discovery to the sails of conventionally rigged sailboats, underscoring a basic and apparently irreducible gap between sail design theory and sail design feasibility.

A side view of any conventionally rigged sailboat shows a mast supported by forward and aft rigging wires, forming fore and aft rig triangles. Sail designers quite naturally, and invariably have respected those rig triangles as absolute limitations on the perimeter of a mainsail or a self-tacking headsail, each of which attaches to a single control line, or sheet, and each of which connects to a sailboat inside its corresponding rig triangle.

Terminology: Functionally, mainsails are self-tacking sails but are referred to simply as "mainsails", whereas headsails that are self-tacking are referred to interchangeably as "self-tacking headsails "or self-tacking jibs". Use of the terms "mainsail", "self-tacking headsail", "self-tacking jib" in this Application uniformly denotes a sail controlled by a single sheet that tacks and jibes without resort to alternating port and starboard sheets for each tack or jibe. A detailed disclosure of the descriptive terms used in this Application appears in a subsequent section.

Designers thus drew mainsails and self-tacking headsails as smaller, or "inner" triangles limited by companion rig elements. Historically, a boat's mast has always limited the profile of its self-tacking jib, and a boat's permanent backstay limited the profile of its mainsail.

Designers accepted uniformly that:

1. optimum sail handling convenience and optimum sail performance were irreconcilable; and also that
2. sails controlled by a single-sheet, or self-tacking sails, could not tack and jibe safely and reliably if the trailing edge of any such a sail overlapped any companion rig element.

Sail designers never even speculated on whether an overlapping, self-tacking mainsail or headsail was theoretically feasible, or whether such sails could reconcile optimum performance and convenience. To the contrary, designers simply assumed that optimum sailboat performance and optimum convenience were irreconcilable, and that as a matter of absolute design dictum, a safe, functional self-tacking sail must not overlap companion rig elements.

No designer imagined that a sail controlled by a single sheet could tack and jibe safely and reliably, notwithstanding that its trailing edge had to cross an intervening mast or permanent backstay as the sail tacked or jibed. Designers assumed that the sail would "hang up" and eventually self-destroy. That assumption profoundly obstructed advances in the art of sail design and fabrication, as will be seen in a subsequent review of prior art.

Ideally, any boat's helmsman, unassisted by crew, would be able to maintain optimum boat speed in all conditions and, without assistance, turning through the wind as easily as one drives a car. That ideal has remained unattainable. To meet changing conditions, boat owners must still buy diverse inventories of headsails, each controlled by separate port and starboard sheets; each yielding a level of performance proportional to sail cost and the crew effort and risk required to use then. Turning through the wind with sails that are not self-tacking requires a high effort, potentially dangerous alternate tensioning and releasing of port and starboard headsail sheets. No available sail system has ever minimized cost, effort, and risk while providing optimum sailboat performance.

Rigging and Sail-making Terminology

The text of the present cause, "the text" describes Applicant's sail system, the "System" with terminology known to one skilled in the art. In that context, a "conventionally rigged" sailboat is one having conventional "rig elements" comprising one or more masts, each supported by "standing rigging" consisting of forward, lateral and aft rigging wires. Conventional standing rigging consists of:

a "permanent forestay"; port and starboard "shrouds"; and a "permanent backstay".

Terminology used by those skilled in the art to describe a boat's sails and sail control systems follow:

1. The upper, forward and aft corners of a sail are its "head", "tack", and "clew", respectively. The leading, trailing, and bottom edges of a sail are its "luff", "leech", and "foot", respectively. A semi-elliptical sail's "roach" area is that area extending aft of the linear head-to-clew line of a sail.
2. In contrast to the linear leech of a triangular sail, the leech of a "semi-elliptical" sail is a convex curve.
3. Forward sails, or "headsails" may be controlled either by a single "self-tacking" sheet that requires no crew intervention, or by separate port and starboard sheets that crew must alternately tension and release.
4. A Mainsail systematically connects to a mast along its luff. A mainsail's foot typically connects to a rigid external boom controlled by a single self-tacking sheet.
5. A headsail systematically connects along its luff to a forestay. Single self-tacking sheet have been used for headsail control only if the headsail's leech did not overlap its companion mast. Mast overlap in a headsail has invariably imposed separate, alternately tensioned port and starboard sheets.

6. Typically, sail construction involved woven or laminated sailcloth cut into panels and assembled by sewing or gluing. Recently, sailmakers introduced sails that employing proprietary fiber-oriented laminating technology, whereby individual fibers are laminated in specific orientation and density between layers of synthetic film, often with abrasion resistant outer layers. North 3-D™, UK Tape Drive™, and Sobstad Genesis™ exemplify the latter type of sail construction.
7. Battens have long been used to stabilize a sail's leech. By 1980, easily broken, heavy wooden battens had been replaced by durable, semi-rigid fiberglass battens.
8. A diagonal "vang" tackle or solid strut connects a rigid boom to a boat's deck. Such vangs have been required to resist the tendency of a sail's clew to rise as a boat turns away from the axis of the wind, or "reaches" off.
9. "Standing sails" connect along their luff edge to a boat's forestay in the case of a headsail, and to its mast in the case of a mainsail.
10. The "working sails" of a conventionally rigged sailboat consist of a conventional, non-overlapping headsail, or "working jib" and a conventional mainsail.
11. A "free-flying headsail" can use elliptical form because it sets outside a boat's rigging, usually ahead of its forestay, as in the case of a spinnaker. Connected to the boat only at three corners, a free-flying headsail must either be jibed, or hoisted and lowered entirely, as conditions change or each time a boat turns through the wind. Such sails typically require crew to set and strike a lateral supporting pole as conditions and boat course change. Free flying headsails are crew intensive, and even with skilled crew, such sails are frequently dangerous to use.
12. The foot length of headsails is generally expressed as a percentage of "j", which is forestay-to-mast distance at deck level. Thus, a 100% jib, or conventional "working jib" is "non-overlapping." A headsail whose foot length exceeds "j" is generally referred to as an "overlapping headsail", or "genoa" because its clew overlaps a boat's mast.
13. A mainsail whose aft end does not contact a boat's "permanent backstay" is a "non-overlapping mainsail".

Most Existing Sailboats Use Only Two Sails: 1925 to Date

At least ninety-percent of contemporary sailboats are "conventionally rigged", having a mast supported by forward, lateral, and aft rigging wires: a forestay, lateral shrouds, and a backstay, respectively. For cost and convenience reasons, most conventionally rigged sailboats use only two sails, known as "working sails", which, in the case of vertically deployed, or "hoisted sails" consist of:

1. A forward, or headsail hoisted by a halyard; attached along its leading edge to a forestay; and attached at its aft corner, or "clew" either to alternately tensioned port and starboard sheets, or to a single self-tacking sheet. In the latter case, the headsail is self-tacking. Heretofore, it has been considered impossible for a headsail to overlap its companion mast or any other rig element while tacking and jibing.
2. Headsails may connect to a rigid external jib spar, or "external jib boom", which like a mainsail boom, is controlled by a single sheet and serves to hold a companion sail in extension. A halyard line hoists a Mainsail. It connects along its leading edge to a companion mast connects along its foot to a rigid external spar or "boom" controlled by a single self-tacking sheet.

Sails controlled by a single self-tacking sheet eliminate the need for crew to alternately release and tension port and starboard sheets, as is the case with overlapping headsails and free-flying headsails. A boat with self-tacking mainsail and headsail enables its helmsman to turn the boat as easily as a driver turns an automobile.

Despite their convenience, hoisted, triangular self-tacking jibs lost popularity as post-1980 sailors regularly chose larger, overlapping triangular hoisted roller-furling headsails that could be deployed and recovered from the safety of the cockpit. The difficult, often dangerous on-deck sail handling imposed by hoisted sails quickly became unacceptable to a majority of sailors. However, the effort required to tack and jibe such overlapping headsails would quickly underscore their deficiencies in terms of safety and convenience.

Thus did the hoisted self-tacking sail lose market share to heavier, more costly roller furling headsail and mainsail configurations, which also compromised performance. After an early rush to roller furling configurations, sailors would reevaluate the convenience-oriented-trend to long-footed overlapping furling genoas and roller-furling mainsails. The real versatility and convenience of such sails eventually belied sailmakers' promotional sales rhetoric, and a strong but unrealizable market demand for a more powerful self-tacking headsail continued to grow.

Triangular Working Sails

In theory, the worst possible two-dimensional sail profile is triangular, and the best is elliptical. Notwithstanding, designers still condemn theoretically superior elliptical working sails as unfeasible. This anomaly is explained below.

1. Since a boat's non-overlapping working sails, its mainsail and non-overlapping headsail, invariably set inside the confines of a boat's rigging wires, or "rig triangles", designers uniformly assumed that the profile of working sails could not overlap companion rig triangles.
2. On the other hand, supplementary free flying sails set outside a boat's rigging, thus avoiding contact with rig elements. Consequently, designers could draw such sails with semi-elliptical profiles. However, free flying sails required costly supplemental equipment and a complement of skilled athletic crewmembers. Useful only in limited downwind situations, free flying sails addressed performance priorities while ignoring convenience and safety entirely.
3. Optimum performance still requires a costly, cumbersome variety of inconvenient hoisted triangular headsails and free flying headsails controlled by alternately tensioned port and starboard sheets.
4. Optimum convenience favors roller-furling sails, but potential mechanical problems plus the limited versatility of such sails in varying conditions qualifies this apparent convenience.
5. Designers succeeded in making hoisted mainsails easier to use, but their surface area remains limited by conventional rig geometry, and they still require a boom to hold the sail in extension for downwind sailing.
6. As for hoisted, self-tacking headsails, Designers did not succeed, either in making such sails easier to use, or in extending their sail area beyond triangular form. As a result, hoisted self-tacking headsails all but disappeared from the market as roller-furling headsail configurations replaced them.

7. Optimum convenience would favor hoisted self-tacking headsails if:
   A. an external spar was not required for effective downwind deployment;
   B. deployment, reefing, and recovery could be performed from the safety of the cockpit.
   C. surface area and form were not limited to a triangle that must fit into the triangle formed by a boat's mast and forestay, variously referred to as a 100% headsail; a 100% jib; or a working jib. Such sails can have a single self-tacking sheet or port and starboard sheets. Few boats use self-tacking configurations because their overlapping genoa headsails require two sheets. In this overwhelming majority of cases, as hoisted sails are changed, crewmembers must change the sheets from one sail to another, an often dangerous maneuver.
   D. a 100% headsail were not underpowered wind speeds of less than 20 knots. Undoubtedly, over 90% of sailing takes place in less than 20 knots of wind.
8. For precisely that reason, hoisted sails have given way to easily deployed overlapping furling genoa sail configurations, but not without imposing important compromises: While a fully deployed overlapping furling headsail has more sail area than a hoisted non-overlapping working jib, the furling configuration costs more than a hoisted one, adds weight aloft, is less efficient for heavier conditions when partially furled, is skill and effort intensive, and can be dangerous to use.
9. In summary, contemporary designers have never been able to reconcile optimum performance with convenience and safety for conventionally rigged boats.

What has Changed: 1925 to Date

Sail deployment, reefing and recovery as well as sailcloth and sail construction methods have advanced markedly along with the three-dimensional aspect of sails.

What has not Changed: 1925 to Date

Theoretically, "Semi-elliptical" working sails having an elliptical, or nearly elliptical trailing edge, or "leech" could produce optimum sail area and optimum efficiency. Such working sails have never been reduced to practice due to the persistence of prevailing design assumptions and the absence of feasible, universal design Parameters for feasible working sail overlap. The persistent and seemingly inevitable triangular profile of today's working sails imposes three major design barriers:

A. The sail area of a mainsail is still limited by its companion permanent backstay;
B. The sail area of a working jib is still limited by its companion mast and lateral rigging; and
C. A rigid external spar is still indispensable for maintaining tension along the foot of a headsail or mainsail in all wind and sea conditions. Such spars pose a danger to crewmembers and, in the case of a jib, obstruct access to a boat's foredeck anchor stowage locker.

Conflicting Priorities: 1980 to Date

By 1980 sailmakers were celebrating the introduction of furling sails and promoting that as the answer to both performance and convenience issues. As seen below, sailmakers' claims differed materially from the demands imposed by actual sailing conditions.

1. Maximum boat speed across a wide range of conditions had always required a maximum number of sails and a maximum number of skilled, athletic crewmembers willing to perform dangerous on-deck sail maneuvers regardless of wind and sea conditions. Such is still the case.
2. At the opposite extreme, "multi-purpose" furling sails delivered maximum convenience but compromised windward ability and maximum boat speed by ten to twenty percent. In addition, if a furling headsail or mainsail jammed, the only way to reduce sail area in heavy conditions would be to cut the sail away: an expensive and dangerous exercise, even when possible.

The Present State of the Art: Boat Owner Priorities in Detail

At one extreme, convenience and safety-oriented boat owners accepted only easy to use cockpit-controlled roller-furling sails. For them, boat speed was secondary. At the other extreme, boat speed priorities required large, skilled crews to perform dangerous on-deck sail handling maneuvers, thus compromising convenience and often safety.

On balance, boat owners today increasingly seek convenience in preference to boat speed. This is in part explained by the fact most boats are sailed "shorthanded" by average sailors. Few boats have a full crew with the skill and physical capacity to derive maximum speed from even the best of available sails and sail deployment devices. Historically, maximum boat speed has been irreconcilable with sail handling convenience and safety. Reconciliation of those priorities has evaded designers to the present date.

Present State of the Art: A Critical and Ongoing Sail Design Assumption

Three-dimensional sail form has evolved consistently yet the two-dimensional triangular sail profile still dominates. That disparity is due primarily to a single, ongoing design assumption: The back end of a boat's working sails cannot overlap any companion rig element.

In 1925, it was unthinkable that the back end of a mainsail fitted with heavy horizontal wooden battens could pass across a boat's backstay as the boat turned through the wind. The battens would break. Even less conceivable was a headsail that overlapped its companion mast. Designers eventually resorted to supplementing the sail power of underpowered triangular working sails with free flying sails set outside the rigging for light air and downwind sailing.

Supplemental, or "free flying sails", are set and maneuvered forward of a boat's forestay, thus eliminating rig compatibility issues. Free flying sails attach to a boat only at their three corners and can employ an elliptical or semi-elliptical two-dimensional profile.

Such sails were suitable when the wind came from aft of a boat's beam, but they imposed a mast-mounted lateral support pole and frequent and dangerous on-deck sail and pole handling. Free flying sails would remain an application of elliptical sail form, but one for use in limited situations; one that addressed neither optimum convenience, optimum economy nor optimum safety.

Full-batten Non-overlapping Mainsails and Furling Mainsails: 1980 to Date

By 1980, designs for fully battened mainsails with a small positive roach area had gained popularity for racing boats having alternating or "running" backstays and for multihulls that had no backstays. Multihulls and America's Cup boats exemplify such boats. For such boats, rig overlap was not an issue since backstays either did not exist, or they could be moved out of the way as a mainsail tacked or jibed.

However, failure to move such running backstays out of the way in time could lead to serious damage including dismasting. Such sails were not readily accepted by the mainstream market, which opted for the convenience of furling mainsail configurations rather than optimum performance.

Most sailors considered the performance benefits of hoisted, full batten mainsails disproportional to their incremental cost and inconvenience. It remained unthinkable that a mainsail could overlap a companion permanent backstay, and even more remote that a self-tacking headsail could have genoa-equivalent sail area by overlapping a companion mast.

Today's convenience-oriented sailors either accept important safety and performance compromises or they supplement the undersized triangular profile of their standing headsail and mainsail with inconvenient, often dangerous free-flying sails. In most cases, owners opt for long-footed genoas that impose alternately tensioned port and starboard sheets. As seen below, small-roach or no-roach mainsails and triangular headsails are still the only available sails for contemporary, conventionally rigged sailboats. Even the largest available full batten mainsail combined with a 100% working cannot power any but the very lightest of sailboats in light wind conditions.

The Present State of the Art—Reality and Rhetoric

The present state of the art reveals that:

1. Currently available working sails mirror underpowered 1980's counterparts, thus lacking versatility for a wide range of wind conditions;
2. As in 1980, most boat owners forego convenient but underpowered self-tacking jibs, opting for long-footed roller furling genoas with separate port and starboard sheets; and
3. As in 1980, maximum boat speed in all conditions still requires dangerous on-deck sail handling, large costly sail inventories and a full complement of skilled crewmembers.

Currently Available Working Sails have not Changed Since 1980

Three highly knowledgeable boat owners recently built state-of-the art sailboats. Despite extensive experience and budgets, none of them escaped the convenience and performance compromises that prevailed in 1980. The mandatory triangular two-dimensional sail profile still imposed sails that failed to satisfy either optimum performance priorities or optimum convenience and safety priorities.

Currently Available Sails: Performance-oriented Choices Multiple Hoisted Headsails for Best Performance but Least Convenience

*Cruising World* magazine's December 2002 cover stories revealed that boat builder Peter Johnstone's "state-of-the-art" sails for his new 62-foot catamaran were reruns of 1980 counterparts. For its 7,000-mile initial cruise, the boat's shorthanded crew of four was made up of a veteran of four round-the-world races; a long-time charter boat captain; an experienced inshore racing sailor; and Peter Johnstone, builder of the highly regarded "J Boat" line of cruiser/racer sailboats.

To meet changing conditions, Mr. Johnstone chose a variety of task-specific hoisted headsails with companion deck stowage bags. To change a headsail crew went forward, just as performance-oriented sailors had always done, accepting the accompanying effort and danger:

Mr. Johnstone sums up his sail changing Procedure as follows:

"Each jib has an [on-deck stowage bag or] turtle. We simply
[1] drop the jib in the turtle,
[2] zip it, then
[3] unhank the sail,
[4] detach its port and starboard sheets]
[5] the next jib gets hanked on,
[6] port and starboard sheets are attached to it,
[7] we unzip the turtle, and
[8] hoist A change takes ten minutes." (Peter Johnstone, *Cruising World*, pp. 40–45, December 2002).

Changing Multiple Hoisted Headsails is More Difficult on a Heeling Monohull

A ten-minute sail change for a highly skilled crew on a catamaran can easily become an endless story with a bad ending for average sailors on a monohull, which heels more than a catamaran. The above eight-step maneuver is identical to sail change maneuvers sailors have always performed and is as dangerous and fatiguing as ever.

Why Peformance-oriented Sailors Choose Hoisted Sails

Mr. Johnstone gave his reasons for choosing multiple hoisted sails as follows:

"Roller furling . . . limits your sail selection and places too much weight up high . . . . Roller furling makes more sense on a heeling [monohull], where it's not safe to go forward of the mast."

Thus, Mr. Johnstone identifies four unsolved problems:

1. Furling headsails do not have the versatility to meet a wide range of conditions;
2. Furling configurations impose detrimental weight aloft;
3. No satisfactory alternative to multiple hoisted headsails is currently available; and
4. Going forward for on-deck sail handling is not safe, particularly on monohull sailboats, which make up the overwhelming majority of existing sailboats.

If Mr. Johnstone could have conceived of a truly versatile hoisted headsail configuration that eliminated on-deck sail handling, he would have installed it on his own boat. The present state of the art offers not even a suggestion for truly versatile hoisted headsails that are safe and easy to use.

Currently Available Working Sails: Convenience-oriented Choices Roller Furling Genoas for Optimum Convenience, not Performance Peter Johnstone wrote that going forward of the mast to change hoisted headsails is dangerous. Not surprisingly, most contemporary sailors agree. As a result, they simply get by with a single cockpit-controlled general purpose furling genoa.

In difficult situations, where "getting by" may not be sufficient, a general purpose furling genoa poses safety issues. If a long-footed furling genoa jams, a dangerous situation is in place. Furthermore, long-footed genoas cannot furl effectively to working jib size or smaller for heavy air use. Thus, a sail with compromised windward ability makes clearing dangerous windward obstacles even more hazardous. Walt Schultz, naval architect and owner of Shannon Yachts summed it up in saying, " . . . it is still impossible to roller furl a large overlapping genoa into a useable and safe working jib." (Ocean Navigator no. 100, 1999)"

As a genoa furls, its clew rises, causing it to lose effective sheeting angle in precisely the conditions that most demand an effective headsail. Thus, boats with a single furling genoa are underpowered for light air conditions and are unable to meet heavy air conditions effectively. Designers have not discovered that single headsail, whether hoisted or roller furling, that could satisfy both performance and convenience priorities.

Currently Available Sails: Performance-oriented Choices for Light Air and Downwind Sailing Free Flying Sails: a Performance Choice that Ignores Convenience and Safety For light air and offwind sailing versatility, Peter Johnstone's "screecher" free-flying headsail and single-line furler proved uncontrollable. After the voyage, he replaced them with a supplementary hoisted sail. Sailmaker claims for today's offwind sails and related "convenient" deployment gear repeat the unrealistic claims of 1980. Reality belies these claims for safe, convenient light-air and downwind sailing:

"If you believe your sailmaker, screechers are user-friendly . . . a well-orchestrated plan helps us tame the beast somewhat, but typically we all end up on our backs [exhausted]. Every time the [screecher] spanks us we take it down."

"The continuous-line furler is "the latest development from the Volvo Race", according to its manufacturer. With a crew of 10, I'm sure the unit will suffice, but for short-handed sailing, the furler unit has multiple flaws . . . . Typically the furler jams, and a partially furled screecher flogs until the whole mess is wrested into submission." (*Cruising World*, Peter Johnstone, pp. 40–45, December 2002).

Free-flying sails and single-line furling gear were introduced in the 1970's, when they exhibited the same shortcomings Mr. Johnstone suffered. Many sailors, including Applicant, tried and abandoned these products just as Mr. Johnstone would do twenty years later.

Currently Available Sails: An Alternate Performance-weighted Approach

U.K. *Yachting World* editor, Andrew Bray supplemented his new boat's underpowered, boomed, roller-furling self-tacking jib with a free-flying light air sail, thus accepting dangerous on-deck sail handling in exchange for improved light air and downwind potential. He found no working sail combination that would have allowed him to dispense with supplementary free-flying sails.

Currently Available Sails: A Convenience and Safety-weighted Approach

*Sail* magazine editor, Patricia Wales chose twin headsails, which required dual forestays: a small, boomed triangular jib set on an inner forestay for heavier conditions plus a general purpose roller furling genoa set on an outer forestay. The inner sail was convenient, but underpowered except in high winds, and the heavy furling genoa was underpowered for light air conditions. Ms. Wales simply found no available working sails that would have provided self-tacking convenience and safety combined with optimum performance across a wide range of wind and sea conditions.

Neither Furling Genoas nor Free Flying Sails Reduce Light Air Motoring

Ms. Wales and Mr. Bray will no doubt have equal resort to motoring or motor sailing in light air conditions. Sailing shorthanded, Mr. Bray will use his hard-to-handle free flying sail infrequently, preferring to start his engine as wind speeds drop.

At an approximately equivalent wind speed Ms. Wales will give up on her underpowered furling genoa and start her engine. Ms. Wales speaks for most boat owner in saying, "[We] are willing to give up a bit of performance in the interest of easy sail handling . . . . This is a tradeoff." (Wales, *Sail*, February 1998).

Bill Schanen, editor of *Sailing* magazine, reiterated the majority view on existing conventional hoisted headsails, writing, "To set a headsail, someone has to go to the bow . . . as in the old days. Only for the truly pure at heart, I'm afraid" (Schanen, *Sailing*, January 2000).

No available headsail, whether hoisted or roller furling, satisfies both performance and convenience priorities across a range of wind speeds from five to thirty-five knots. Economical, efficient hoisted sail configurations will never rival furling configurations for market share unless hoisted sail configurations can first, be deployed, reefed, and recovered from the safety of a boat's cockpit and second, provide performance superior to triangular counterparts.

Overview of the Prior Art 1925–1980

In 1925, Manfred Curry discovered that triangular wings and sails had the least efficient profiles. Contrarily, he discovered that elliptical wings and sails were most efficient because they induced less aerodynamic drag and allowed a boat to sail more upright than triangular counterparts. A boat that leans less is able to go forward more easily with less lateral slippage.

By World War II, aircraft designers had reduced elliptical wings to practice. Contrarily, sail designers assumed that the aft end or "roach" of a sail could not tack or jibe across any part of a boat's rig, thus prohibiting application of Mr. Curry's theory to working sails.

Eventually, unconventional rig designs would enable semi-elliptical mainsails for a small minority of sailboats. One such design approach, exemplified by diverse racing monohulls, specifies alternately tensioned port and starboard backstays. Other unconventional rig designs eliminate backstays, and a few "free-standing" rigs eliminate rigging wires altogether, thereby enabling large-roach mainsails but not overlapping, self-tacking headsails.

Overlapping semi-elliptical, self-tacking headsails have been ignored entirely by contemporary designers, even for such unconventionally rigged boats. Consequently, a self-tacking headsail with sufficient power for light air use remains inconceivable.

Overview of the Prior Art: 1980 to Date: Light Air Compromises for Performance-oriented Sailors In 1980, enthusiastic boat owners bought costly second-generation free-flying headsails to supplement the inadequate performance of triangular working sails. Second-generation free flying sails pretended to dispense with lateral support Doles and offer improved convenience and safety. The sails proved unstable downwind and as hard to recover as earlier free flying sails. True downwind sailing still required a lateral support pole.

Even with the most recent spinnaker recovery sleeves or furlers and retractable bowsprits, free flying sails remain altogether inappropriate for shorthanded sailing. Stated otherwise, free flying sails just aren't a workable light air sailing solution for the mainstream market composed of average boats sailed by shorthanded crews of average sailors.

Overview of the Prior Art: 1980 to Date: Light-air Compromises for Convenience-oriented Sailors Convenience-oriented sailors of the 1970's quickly accepted marketing claims that roller furling sails worked well in all conditions and satisfied convenience and safety priorities. These claims quickly proved unfounded. As concerned mainsails, triangular furling mainsails were underpowered and could jam in their mast slot, presenting a dangerous situation. Similar problems could occur with headsail furlers, presenting similarly dangerous situations. Furling a large headsail in high wind conditions is at best a labor-intensive, anguishing experience best handled by two skilled crewmembers.

Long-footed furling genoas did eliminate on-deck sail changes, but they could not meet a wide range of conditions. The promised versatility was illusory, as was the ease of use on all but the smallest boats. Certainly, deployment was more convenient than deployment of hoisted headsails. However, the high levels of physical effort and crew coordination required to tack and jibe long-footed "general purpose" furling genoas offset much of their deployment convenience. As for safety, if a furling genoa jammed, it could not be lowered, giving rise to a dangerous situation.

The force of gravity facilitates lowering a hoisted sail, whereas natural forces work against furling sail recovery, imposing levels of physical force that can overwhelm crew and gear. Finally, triangular furling genoas cause excessive heel and provide poor mainsail interface.

Overview of the Prior Art: 1980 to Date: The Present State of the Art: Mainsail Roach and Permanent Backstays Steve Dashew, American boat builder reiterated an ongoing design assumption in 1992, writing, > "The problem with most cruising rigs . . . is that the permanent backstay . . . gets in the way of an optimum sail shape. (Dashew, *Sail,* 1992).

A sailmaker's error resulted in a mainsail that overlapped the permanent backstay of a Dashew-designed boat. The accident led Mr. Dashew to recognize that a mainsail could overlap a backstay "to some extent", but he was unable to identify a reliable overlap limit. Mr. Dashew concluded that it would be impossible to develop universally applicable predetermined maximum roach overlap parameters. Once he had reached that conclusion, Mr. Dashew resolved his own rig overlap issues by eliminating backstays altogether for his future designs.

In 2001, Mr. Dashew confirmed that predetermined maximum roach parameters were unfeasible saying, > "I don't think you can make a blanket statement about the maximum roach overlap that will work." (Steve Dashew, email communication with Applicant, Oct. 17, 2001).

Mr. Dashew's restatement of the insolvable nature of the problem and its complexity establishes first, that predetermined maximum roach parameters were not obvious and secondly, that if such parameters could be reduced to practice, they would constitute a major advance in the art of sail power.

Owners of existing boats or designers for the mainstream sailboat market cannot resort to eliminating backstays or other radical design changes to render overlapping self-tacking mainsails compatible with particular rig geometry. Even if they could, such rigs do not resolve the inadequacy of existing headsails in the face of either convenience or performance priorities.

For cost, marketing and security reasons, few boat owners or boat buyers will accept the idea that a monohull sailboat does not lose a critical margin of safety if its design does not include a backstay. Consequently, unconventional rigs, those having no rigging wires whatever, or having forward and lateral rigging wire but no backstay, are not a viable option for designers and builders of sailboats for the mainstream market.

The Present State of the Art: The Mainsails of Most Boat are too Small

Larger mainsails could make possible smaller, more easily handled, task-specific headsails only, but the permanent backstay found on nearly all existing sailboats precludes larger mainsails. This is unfortunate, particularly in view of the following:

"Many sailors don't want to exert themselves sheeting in large headsails. During last fall's boat shows we couldn't help but notice the number of boats [that] offered standard with self-tacking jibs . . . . A modern [light or medium displacement] boat can sail quite nicely with a large mainsail and [100%] working jib" (Practical Sailor, May 15, 2000).

The above statement confirms a renewal of interest in self-tacking convenience and also sailors' ongoing dissatisfaction with undersized mainsails and cumbersome long-footed furling genoas.

The Present State of the Art: Most Boat Owners Favor Convenience and Safety Priorities A majority of today's boat owners would choose the convenience of self-tacking headsails if such sails could adequately meet a wide range of conditions, and if the convenience and safety of deploying, reefing, and recovering such sails rivaled that of furling sails. Ideally, shorthanded sailors want only two easily-used sails that enable high average boat speed and low crew effort and risk regardless of conditions. In that context, hoisted self-tacking sails could regain market share from costly furling configurations if only the hoisted configurations could be easily deployed, reefed, and recovered from a boat's cockpit.

The Present State of the Art: Design Assumptions

Contemporary sail designers still assume that:

1. Predetermined, universal maximum roach parameters for working sails of conventionally rigged sailboats are unfeasible;
2. Boats with small working jibs require supplementary furling headsails or free flying sails to meet light air and offwind sailing requirements;
3. Hoisted self-tacking headsails have no potential for regaining market share lost to furling headsail configurations;
4. Hoisted headsails can never be truly versatile or convenient; and
5. "Overlapping sail" and "self-tacking sail" are mutually exclusive sail properties.

The above assumptions have perpetuated triangular working sails, requiring boat owners to buy multiple headsails to meet changing conditions, or to "get by" with a single long-footed genoa with port and starboard sheets. In no way have boat owners been liberated from the inefficiency and handling difficulties of long-footed genoas, underpowered mainsails, or free flying headsails.

Prior Art: Detailed Analysis 1980 to Date

In summary, furling gear appears on most contemporary sailboats while free flying sails are found on few short-handed sailboats as owners realize that they cannot use such sails frequently. The unrelenting triangular two-dimensional profile of working sails still makes them unsuitable for a wide range of conditions. Detailed examination of prior art follows with a view to identifying the reasons for the unavailability of versatile working sails and to identifying:

1. what prior art has taught, explicitly or implicitly, about two-dimensional profiles for working sails;
2. what prior art has not taught or even implied about two-dimensional profiles for working sails.

The following detailed analysis of sail design history addresses "conventionally rigged sailboats". That term as well as others is explained below for reasons of precision and reader convenience. Notwithstanding, a person skilled in the subject matter of the present cause, or a "skilled sailmaker", would be familiar with each of those terms.

The Prior Art: Detailed Analysis The Shortcomings of Triangular Sails: 1925 to Date Triangular sails produce a maximum of aerodynamic drag and heel. Although they are typically thirty-percent smaller than counterpart semi-elliptical sails, triangular sails induce more heel, thus making a boat harder to control, uncomfortable, and eventually unsafe. Also, triangular sails twist easily, compromising efficiency.

"A long, slender elliptical airplane wing has . . . little or no twist. A triangular sail is opposite in all respects. It is relatively short, and it twists, . . . lowering its effective height . . . . Twist makes stubby rigs out of tall rigs."

"The wings [of] any aeroplane or great sea bird in flight are beautifully designed, with no twist at all, or very little. Birds and airplanes have wings that respond dynamically to changing conditions, wings that can flex and that are ideally shaped. (Bethwaite, *Performance Sailing*, Performance Marine, p. 199 (1993).

Designers Considered Semi-elliptical Working Sails Unfeasible: 1925 to Date

Since 1925 designers have ignored semi-elliptical working sails, dismissing them as unfeasible on both theoretical and practical levels. A leading sail designer expressed this position in a widely read book on sail design:

"[Headsail battens] are unseamanlike appendages if they have to come into contact with the mast or shrouds when tacking . . . . There is no point in trying to build up a roach on the leech of . . . a [head]sail, because this would defeat its own object. The extra cloth would probably cause the leech to foul the mast, which in turn would break the battens. If a greater area is desired in a headsail which is tall and narrow, it is better to draw the clew further aft, so that it overlaps the mast and the sail achieves a lower aspect ratio." (*Sails*, pp. 87–88, Jeremy Howard-Williams, Adlard Coles Limited, (1974)).

Mr. Howard-Williams also wrote that battens couldn't support a large mainsail roach in upwind conditions. He reasoned that it was better to use a smaller mainsail and regain needed sail area by resort to long-footed genoas and free flying downwind sails. His performance-oriented assumptions would continue to encumber headsail and mainsail design for the foreseeable future.

Thus did a leading 1970's sail designer further entrench three sail design assumptions:

1. Standing headsails should not have a roach;
2. The best way to increase the power of a standing headsail was to lengthen its foot, and
3. Large mainsail roach was a poor way to gain sail area.

Rig Overlap and Sailboat Geometry: 1980 to Date

In an era of easily broken wooden battens, increased sail area was achievable only by resort to long-footed triangular genoas, taller masts, and free flying sails. Unfortunately, lengthening a headsail's foot made it harder to handle and materially deteriorated its interface with a companion mainsail. In addition, with each tack or jibe, however skillfully performed, a long-footed overlapping genoa and its sheets violently chafe across a boat's mast and rigging.

Tall masts were not cost-effective, and costly free-flying sails were unsuitable for boats sailed shorthanded by average sailors. Nonetheless, designers clung to old assumptions about roach size, rig overlap, and the feasibility of cockpit control for hoisted sails.

Predetermined Maximum Roach Overlap Parameters: 1980 to Date

For sail designers, a conventionally rigged sailboat was a hull encumbered by a cage of spars and wires that absolutely precluded overlapping mainsails and overlapping self-tacking headsails. Thus, the mainsails and self-tacking headsails of conventionally rigged sailboats uniformly passed clear of companion permanent backstays and masts, respectively.

Boat builder Steve Dashew's accidental experiment with overlapping mainsail roach only served to convince him that predetermined roach overlap parameters were unfeasible. Mr. Dashew's conclusion reflected design assumptions that unrelentingly condemned a majority of existing sailboats to underpowered mainsails and long-footed triangular genoas. Those assumptions similarly precluded the discovery of hoisted, self-tacking sails that could reconcile optimum performance with optimum safety and performance.

Detailed Analysis: Hoisted Working Jibs and Rigid External Spars: 1980 to Date In 1980, alternately tensioned port and starboard sheets were the dominant headsail control configuration. Most boat owners had replaced convenient self-tacking configurations with overlapping furling genoas that imposed alternately tensioning and releasing port and starboard sheets. Self-tacking headsails, particularly those set from rigid jib spars, had also fallen into disuse, such configurations being useful only in wind speeds above fifteen knots. Subsequent efforts to revive interest in self-tacking jibs would have little success due to the performance limitations of available, triangular sails; their inconvenience, and the cost, complexity and danger of companion rigid jib booms.

The Bierig Rigid External Spar 1985

One attempt to revive interest in external jib spars is seen in U.S. Pat. No. 4,503,796 to Bierig (1985): The Bierig patent covers a curved, rigid half-wishbone that rotates inside a large sleeve sewn to a sail. The patent argues that flexible battens break easily whereas a rigid spar will not. Experience proved the contrary. After an initial breakage, the owner of Freedom Boats in the United Kingdom was obliged to replace the cumbersome curved Bierig spar on his own boat and carry a second one on deck as a precaution against recurrent breakage. Thus did a wishbone far more substantial than a Bierig spar break in use, belying the idea that a rigid spar was, a priori, more reliable than semi-rigid battens. Semi-rigid battens such as those ultimately used on the present invention existed and were well-known at the time the Bierig patent issued.

Interestingly, the freestanding masts of Freedom boats had no rigging wires whatever, thus presenting an ideal configuration for an overlapping mainsail or headsail. Even though a positive-roach headsail would have had only the Freedom boat's mast to cross when tacking and jibing, jibs on single-mast Freedoms were tiny, underpowered triangular ones that cleared companion masts comfortably. Thus, even in the case of a boat with no rigging wires, a positive-roach jib was never considered.

The Freedom rig, which would have presented minimum obstruction to tacking and jibing an overlapping headsail, never suggested to designers that an overlapping headsail might be possible. Old assumptions still controlled sailboat design, and any departure from those assumptions was anything but obvious.

Nowhere did Bierig suggest that the aft end of a sail could overlap a boat's rig. In fact, Bierig neither depicted nor described rigging wires at all in its text or drawings. In Bierig's FIG. 8, the rigid Bierig spar leading diagonally upwards from the clew of the mainsail is longer than the sail's foot. The patent promised that the mainsail could be lowered with the aid of jackline 51. This is unlikely in theory and unfeasible in real sailing conditions.

At best the sail could have been lowered on a model boat. On a real boat in real sailing conditions a mainsail must quickly and easily assume a reefed or lowered configuration that threatens neither crew nor gear. Once lowered partially or entirely, the mainsail configuration seen in Bierig's FIG. 8 would not be firmly attached to the mast. Consequently, the sail would flail dangerously, threatening crewmembers, quickly destroying the mainsail and its spar. In no way could the depicted sail be reefed or lowered safely. The sail would be safe only in a lowered configuration, and even then, only after crew had gone forward to secure the sail and spar: a dangerous and inconvenient prospect at best.

Nowhere did Bierig suggest that its rigid spar might lead downwards from it clew to the boat's mast. Revealing the impracticality of his claims, in FIG. 13, Bierig resorted to a conventional horizontal boom, thus dropping the pretense that a diagonal Bierig spar could control a mainsail's foot in real sailing conditions. In fact, the Bierig spar was never intended to be functional with mainsails. Mainsail claims included in Bierig would not have worked in real sailing conditions, and they have not been reduced to practice. Accordingly, Bierig taught nothing about mainsails other than the fact that the Bierig invention was limited to headsails.

The series of heavy, cumbersome Bierig spars shown in the upper part of the sail of FIG. 13 would prevent safely and easily raising, reefing, or lowering the sail and would be dangerous to crewmembers during any such maneuver. Simply stated, the Bierig spar, as shown in the patent would not work for controlling a mainsail even in the best of conditions.

While Bierig addressed the convenience of self-tacking, non-overlapping jibs, the patent disclosed nothing relevant to overlapping ones. In the final analysis, the subject matter of Bierig was a rigid spar. Bierig replaced supposedly unusable semi-rigid battens with a rigid spar, reasoning that battens were nonfunctional for booming a sail whereas the Bierig rigid spar was.

Contrarily, Applicant's unique semi-rigid batten configurations eliminate rigid external spars including the Bierig spar for specific reasons discussed below, thus presenting a first reason why the prior art pertinent to rigid spars in no way affects patentability of Applicant's system.

Bierig specifically stated that full-length battens could not control a sail in either heavy or light air. conditions (see Bierig, p. 1, lines 26–44; p. 2, lines 14–26). As seen below, Applicant's thousands of test miles in widely varying conditions have proven the contrary.

Bierig substituted rigid spars for battens, stating,

"For full length battens, we can now use pre-curved rigid spars instead of battens" (p. 3 lines 17–18.

In part, the new and unexpected results produced by Applicant's System are generated by Applicant's unexpected use of new semi-rigid batten configurations, and in part by universally compatible predetermined maximum roach parameters. Each System sail embodiment employs and embodiment of such batten configurations and complies with those predetermined parameters. Those parameters have heretofore been considered unfeasible. Bierig neither teaches nor infers anything concerning predetermined roach overlap parameters or rig overlap for working sails:

"A further advantage [of the rigid Bierig spar] is that sails with large roach (convex curvature of the after edge) can be more easily controlled and put less demanding loads on the sailcloth."

The use of the term "large roach" in Bierig taught nothing about predetermined maximum roach parameters. Nor did Bierig disclose or imply anything whatever about rig overlap. A concerns leech control and sailcloth loads, Bierig taught nothing beyond the well-known art pertinent to conventional wishbone spars. The subject matter of Bierig pertained to a pivoting half-wishbone without the slightest pertinence to rig overlap at the back end of a sail or predetermined maximum roach parameters. Moreover, much of what Bierig claimed would not be possible in real sailing conditions, particularly as concerns mainsails.

Bierig presented small variations on well-known external wishbone devices; it promised to revive commercial interest in a rarely used device; and it occupied a crowded classification. Bierig spars still appear on a few boats to control underpowered triangular jibs. The complexity, fragility and cost of the spars have limited their commercial success.

The Hoyt Rigid External Spar 1995

A second effort to revive interest in rigid external jib spars appeared in U.S. Pat. No. 5,463,969 to Hoyt (1995). A rigid Hoyt boom costs more than a Bierig spar, provides fewer control functions, and imposes major structural changes to a boat's deck and invasion of its below-deck space.

Purchase and installation costs and the inefficiency of companion triangular jibs limited the commercial potential of both the Bierig and Hoyt spars. Despite self-tacking convenience, the Hoyt boom failed to resolve the following shortcomings in conjunction with hoisted sails:

1. High cost and encumbrance of heavy external jib spars;
2. Inadequate sail area in wind speeds of less than fifteen knots;
3. Difficult, risky on-deck deployment, reefing and recovery maneuvers.

Detailed Analysis: Hoisted Mainsails and Rigid External Spars 1980 to Date

The Two Most Recent Developments in Sailboat-related Prior Art Both Reemphasized that Overlapping, Semi-elliptical Sails for Conventionally Rigged Sailboats were Unimaginable As seen below, Applicant reviewed a diversity of patents, all of which confirmed that his invention is unobvious. Some of those patents have "reverse relevance". That is, they recite that the subject matter of Applicant's invention is either unobvious, or they ignore that subject matter altogether, or the explicitly deem that subject matter as unfeasible and inconceivable. A review of such patents is justifiable in order to describe a historical context of prior art that precluded the feasibility of Applicant's invention.

Two innovative designers created the Bierig Spar, the Freedom boat series, and the Hoyt boom, yet neither of those designers ever even inferred that hoisted, self-tacking overlapping headsails or mainsails were feasible. Indeed, the Freedom boats, having no rigging wires whatever, might have provided a forum for overlapping headsails. No such sails have ever appeared. The Bierig spar explicitly denied the feasibility of booming a sail with battens, thus reiterating the above-mentioned design assumptions, which continue to preclude such sails. Examination of the Hoyt patent reveals Mr. Hoyt's acceptance of prevailing design assumptions precluding hoisted, self-tacking overlapping headsails or mainsails.

A detailed review of these areas of prior art is justifiable in that it reveals that patents issued in arguably related classifications are silent on the subject of hoisted, self-tacking overlapping headsails or mainsails. Beyond silence, those patents actually preclude such sails, once again reinforcing long-standing design assumptions.

1. FREE STANDING MASTS HAVING NO RIGGING WIRES: By 1980, manufacturers of such boats, including Freedom Boats were using hoisted mainsails with only modest positive roach. Despite the fact that their designs had eliminated rigging wire, notably permanent backstays, Freedom designers took no initiative to optimize even mainsails, let alone headsails. Thus boats with free standing masts initially used two masts to achieve adequate sail area and later added single-mast versions with minimal triangular jibs.

A newfound interest in freestanding rigs did nothing by way of inducing the appearance of optimized mainsails or headsails, thus proving that such sails were considered unfeasible even in the most favorable context, one void of rigging wires. Clearly, if optimized mainsails and more so, optimized headsails were entirely unimaginable to designers of boats with no rigging wires whatever, such sails were even less conceivable to designers of conventionally rigged sailboats with a full complement of rigging wires.

2. FUNCTIONAL BOOM FURLING TECHNOLOGY: By 1990 functional furling booms had appeared, marking a significant point in the history of sail handling equipment and also marking the most recent point, historically, in sailboat-related prior art. Furling boom technology targeted convenience-oriented boat owners with its apparent furling ease and also targeted performance-oriented owners with their booms' ability to furl full-batten mainsails.

1. Why did furling boom technology, with its ability to furl fully battened sails, never even suggest a possible deployment of optimized mainsails or headsails by means of a boom furling mechanism? First, the mechanisms themselves in no way enable or relate to roach size or geometry. Second, the designers of such booms and sails for them were happy with their not inconsiderable achievement. Third, the mechanisms themselves exhibit diverse incompatibilities with optimized sail form and dimensions. Fourth, for functional, cost and safety reasons, furling booms are far too heavy to be considered for use with headsails. Finally, the historic assumptions that had thus far prevented designers from conceiving optimized mainsails and headsails for conventionally rigged boats dominated design thinking in 1990 and still do.
2. Because they were costly, and because they offered no clear, overwhelming performance or sail-handling advantages over alternate sail-handling configurations, furling booms have not enjoyed major market proliferation, as did mast-furling configurations. This phenomenon further proved that the market demands convenience and safety above all, and that it was cost conscious even where performance priorities are concerned.
3. In fact, furling boom technology did not pertain in any way to sail shape or rig overlap. Going even further, designers of furling booms and sails for them clearly deemed overlapping mainsail roach incompatible with furling boom function. Furling boom designers ignored entirely two basic and powerful market and feasibility issues:
   A. Could a sail deployment system ever combine the functional and economic advantages of furling configurations and hoisted sail configurations while accommodating a sail with a maximum-size roach, or an "Optimized" mainsail?
   B. Were predetermined maximum roach overlap parameters for conventionally rigged sailboats feasible?
6. Quite obviously, furling boom designers ignored the feasibility of optimized headsails because their products were in no way appropriate for use with headsails set at the front of a boat from a forestay. More significantly, furling boom designers ignored equally any possibility that optimized mainsails might be deployable by a furling boom. Once again, as in the case of free-standing masts, even the appearance of a favorable context failed to produce designs for optimized mainsails. Clearly, the latest, most favorably disposed functional concepts did nothing to induce even speculation that optimized sails for conventionally rigged boats might one day be feasible.

Such sails were as inconceivable on a practical level as they were in 1925 when Manfred Curry discovered the theoretical advantages of elliptical sail form. The foregoing statement is confirmed both by manufacturer's specific instructions to sail makers and secondly by underlying furling boom patents.

First, where manufacturers' instructions did set mainsail roach limits, such limits related exclusively to a boom's mechanical functions such as the fore and aft location of furling claws, requiring roach curves that coincided with furling claw location. In all cases, such instructions set limits well inside any that might have been posed by any consideration relative to a companion permanent backstay.

By way of example, a sampling of boom furling patents reveals that each such patent exclusively addresses only the front end of a mainsail, and that leech geometry, roach size, and rig overlap have never been relevant topics in furling boom prior art.

Deployment, Reefing and Recovery of Hoisted Working Sails: 1980 to Date

1. Lowering or reefing an externally boomed, hoisted mainsail or jib was difficult and dangerous. By 1980 improved reefing for hoisted mainsails had appeared, but not for hoisted headsails. Because reefing hoisted jibs was dangerous and ineffective, such sails were obsolete by 1980 having been replaced by headsail furling configurations. Notwithstanding, the benefits of this phenomenon would be questioned almost immediately due to diverse deficiencies in furling sail design as well as designs for the furling gear, itself.

2. Furling genoas proved only marginally satisfactory as a heavy weather alternative to multiple hoisted headsails. Nonetheless, a majority of boat owners chose furling genoas, accepting compromised performance in exchange for safety and ease of use.
3. Mainsail deployment, reefing, and recovery has been facilitated by Lazy Jacks and Dutchman configurations, which are vertical lines that control a mainsail during deployment, reefing, and recovery maneuvers.

Topping Lifts and Vertical Deployment Control Lines: 1980 to Date

1. A "Topping lift" is a line running from a boom's aft end to a point just below a boat's masthead that prevents the aft end of a sailboat's boom from falling to the deck.
2. Lazy jacks" are paired lines running upwards from a boat's boom to a point near its mast along either side of a companion mainsail. Lazy Jacks contain mainsail during deployment, reefing, or recovery. Lazy jacks are notorious for snagging a sail's battens during hoisting maneuvers, thus being inconvenient, even dangerous in difficult conditions or confined quarters.
3. U.S. Pat. No. 4,688,506 to Van Breems (1987) introduced a sail deployment control System that combined a topping lift and vertical lines running through eyelets in a sail to prevent flogging during sail handling maneuvers and to automatically fold or "flake" a mainsail as it is reefed or lowered. Unlike lazy jack lines, Dutchman lines run through a sail to avoid snagging battens as the sail is hoisted. Both Systems have been widely used for mainsails, but most sailors have chosen lazy jacks, which are easier to install and do not require punching a series of holes in a mainsail.

In a subsequent section Applicant will describe the present invention, which can use either the Dutchman or Lazy Jack system as a component part of the invention. It is appropriate at this point to state that Applicant will make no proprietary claim to either of those devices, nor will he make any claim to any other individual device used in building the invention of the present Application. As examples, Applicant will make no proprietary claims to a patented type of sailcloth or sail hardware item.

Market Potential for Hoisted Working Headsails: 1980 to Date

By 1980 furling configurations had replaced most hoisted jibs except for racing applications. Hoisted working jibs were considered hard-to-use, fatally underpowered sails with no further functional or commercial potential.

Segregated Performance and Convenience Priorities as a Marketing Strategy: 1980 to Date For a certain time, segregated design priorities enabled sailmakers to sell five sails instead of two to performance-oriented boat owners, and to sell furling configurations to convenience-oriented ones. However, owners progressively came to understand that sail area gained via free flying sails imposed more than an acceptable measure of work and risk, and that furling configurations hardly satisfied a wide range of conditions. In response, sailmakers and boat builders intensified promotion of tall mast configurations, or "tall rigs" to gain sail area. However, tall rigs were costly and did not meet market or functional demands satisfactorily.

Tall Rigs Cannot Alter the Inefficiency of Triangular Sails: 1980 to Date

"Tall rigs" add weight aloft, which impose major structural modifications to a boat's deck and perhaps to its ballast and, consequently, major increases in boat cost. In addition, a taller mast interferes with a boat's passage under bridges. At a minimum, the cost of a new mast and rigging represents an important percentage of a boats original cost.

Raising the small, drag-inducing head area of a triangular sail to a higher wind zone may have a minimal performance benefit, but not one that most boat owners consider justifiable. In the final analysis, the performance-reducing turbulence and the heel-inducing effect of triangular sails is inescapable regardless of mast height.

Tall Rigs have not Proven Cost Efficient: 1980 to Date

Tall rigs are found on less than 5% of existing sailboats because their limited practical benefit does not justify their cost for a predominance of boat owners.

Reference Calender

1925: Manfred Curry identified the elliptical distribution of force over a sail as ideal for minimizing heeling forces while obtaining maximum forward drive, or optimum performance. (Aerodynamics of Sails and the Art of Winning Races, Collection Biblio Voile, 1925)).

1940: By WWII, elliptical airplane wings exemplified by the British Spitfire were common, whereas elliptical sails for boats remained theoretical.

1945: Postwar designers segregated "racing performance" and "cruising convenience" objectives. The primary postwar design obstacle would be achieving increased sail area within the confines of conventional sailboat rig configurations.

1960: Progressively, racing technology such as powerful winches, aluminum spars, and lighter sailcloth began to "cross over" to cruising, enabling smaller crews to manage more sail area with less effort.

1975: Mainsail and headsail furling devices had enabled cockpit-control of inefficient triangular working sails. Designers would promote long-footed genoas and free flying sails to compensate for the shortcomings of available working sails.

1980: External jib booms had fallen into disuse. Furling headsails dominated the headsail market, replacing hoisted headsails except where specified by racing rules, 1985: Full batten non-overlapping hoisted mainsails appeared as did the first functional in-boom furling devices.

1990: Various in-boom furling devices appeared, but they could not accommodate large-roach mainsails. No furling boom design addressed maximum rig overlap.

2004: Cockpit-controlled, hoisted, overlapping self-tacking semi-elliptical sails for all-condition sailing remained inconceivable for even the most knowledgeable boat owners, sail makers and marine architects.

Sail Design for the Twenty-first Century

"Universally compatible Optimized" sails remain unavailable; indeed, unimaginable, as designers persistently segregate performance and convenience objectives.

"Sail System design" is still only an exotic term, and the turbulence generated by triangular working sails excludes optimum working sail interface.

Sail Design for the Twenty-first Century

Available Hoisted Working Sail Designs

Available hoisted working sails for conventionally rigged boats consist of:

A. Underpowered triangular jibs, or, as a compromised substitute, long-footed, overlapping triangular furling genoas, and B. Triangular or small-roach full-batten mainsails.

Sail Design for the Twenty-first Century: Unavailable Working Sail Designs

As seen above, prior art infers nothing concerning Optimized working sails, and designers continue to ignore the following design objectives altogether, or to regard them as unfeasible:

1. Cockpit-controlled, hoisted all-condition, self-boomed, self-vanged Optimized working sails that impose no modification to boat or rig;
2. Hoisted mainsails and self-tacking jibs that reconcile optimum convenience, safety, and performance;
3. Overlapping self-tacking hoisted headsails and mainsails;
4. Reliable predetermined roach overlap parameters for Optimized headsails and mainsails;
5. Optimum interface yielding synergism between working sails;
6. Self-boomed semi-elliptical hoisted sails to lower boat cost for boat buyers and increase profit for boat builders; and
7. A sail System that reduces operating costs for commercial users.

SUMMARY OF THE PRESENT INVENTION

In accordance with the present invention, a universally compatible System of hoisted Optimized working sails for conventionally rigged sailboats comprising new combinations and new uses of known and new materials and concepts.

System-specific Terminology

Although a skilled sailmaker would have no problem understanding and using the following terms, they are set forth below for reasons of precision and reader convenience:

1. A "semi-elliptical sail" is a sail having a linear leading edge and an approximately elliptical trailing edge.
2. "System" denotes the embodiments and ramifications of the present invention.
3. An Optimized sail is a semi-elliptical sail that conforms to predetermined roach overlap parameters that reconcile the greatest possible rig-compatible-sail-area with the most efficient possible leech curve.
4. "predetermined maximum roach overlap parameters" denote parameters for predictably assigning the following properties to a sail:
   A. reliable tacking and jibing;
   B. maximum feasible sail area; and
   C. an approximately elliptical leech curve.
5. "Maxmain" denotes an Optimized mainsail:
6. "Maxjib" denotes an Optimized headsail;
7. "Optimized working sails" denotes a Maxjib and Maxmain combination;
8. "overlapping" and "non-overlapping" are terms describing the relationship between a sail's leech and a companion rig element.
9. A non-overlapping Maxjib is a headsail whose approximately elliptical leech contacts neither a companion mast nor companion rigging while tacking and jibing.
10. An overlapping Maxjib is a headsail whose approximately elliptical leech does contact a companion mast or rigging while tacking and jibing.
11. An overlapping Maxmain is an Optimized mainsail whose approximately elliptical leech contacts a companion permanent backstay while tacking and jibing.
12. A "self-boomed System" sail is one whose foot is held in horizontal extension by the sail's System batten or batten substitute layout rather than an external spar.
13. A "self-vanged" sail is one whose System batten or batten substitute layout, as opposed to an external spar/vang combination, resists upward movement as the sail's sheet is eased.
14. "Counterpart" triangular and semi-elliptical sails have identical foot and luff lengths but different leech profiles.

Repetitive Identification Numbers

The drawings of the present cause, "the drawings", in combination with its Specification and claims, describe the System in detail sufficient to enable a skilled sailmaker to make and use the System. In the interest of clarity, where many identical parts appear in a drawing, only exemplary reference numbers are used. For example, FIG. 1 shows only an exemplary number of Dutchman eyelets 69 and Dutchman vertical control lines 72 in order to avoid an excess of reference numerals, which would mitigate clarity.

System Design Objectives

The System reduces to practice the following objectives:

1. Cockpit-controlled working sails that eliminate on-deck sail handling, costly sail inventories, and below-deck sail stowage.
2. Optimized self-boomed, self-vanged positive roach working sails compatible with the rig elements of any sailboat.
3. Elimination of rigid external spars as well as new, unexpected embodiments for use with rigid external spars, according to boat owner preference;
4. Working sails with fully integrated deployment, single-line reefing, and recovery functions.
5. Predetermined maximum roach overlap parameters enabling universally compatible, overlapping mainsails and self-tacking headsail without modification to boat or rig.
6. Optimum interface between a boat's working sails;
7. New combinations of existing batten and sailcloth technology that enable lighter batten configurations or, alternatively, batten free sails.
8. Cost efficient alternatives to tall rig configurations; and
9. A new form of sail power that was neither taught nor anticipated by the prior art.

Prior Art Ignored the Possiblity of Hoisted, Overlapping Self-tacking Headsails and Mainsails Since furling booms represent the most recent use of hoisted sails, a close review of furling boom patents and other publications concerning furling booms is particularly revealing as concerns whether prior art addresses specific leech parameters and rig overlap. Furling booms can accommodate full-length horizontal mainsail battens, and they pretend to rival the convenience of in-mast furling devices, which cannot accommodate such battens.

The fact that a sail has full-length battens in no way addresses specific leech parameters or rig overlap. For example, it is possible for a triangular mainsail to have full-length battens, but it is geometrically impossible for the leech of a triangular mainsail sail to have a convex leech, let alone a leech that overlaps a companion permanent backstay. Therefore, the fact that a patent may reference battens in no way mandates that such a patent pertains to specific leech curve geometry, rig overlap, or rig compatibility.

Furling Boom Manufacturer's Instructions to Sail Makers

Furling boom manufacturer's instruction to sail makers as well as the related patents are examined immediately below with a view to exposing the total body of furling boom prior art, not just the patents themselves. Those instructions provide manufacturer-specific mainsail roach limits relating only to a boom's interior volume and mechanical features. Such proscriptions dictate a minimal mainsail roach that would inevitably fall "inside" of a companion permanent backstay.

"Super-high-roach mainsails are therefore not suited for in-boom-furling." (Mc Geary, *Cruising World*, October 2000).

Furling boom manufacturers restrict mainsail roach to a percentage of "E", or usable boom length, which bears no relationship whatever to a boat's permanent backstay. The end of a boat's boom may be well removed from its backstay at the level of the boom-end.

Furthermore, varying boom lengths can be used for a given boat, thus presenting various "E" measurements relative to a boat's permanent backstay. Accordingly, "E" is not pertinent to predetermined parameters for leech shape or rig overlap.

A sail making manual for a recently introduced furling boom recites a maximum roach limit of 25% of "E", stating that "The P [maximum hoist of the luff of a mainsail] and E [horizontal distance from the aft surface of mast to mainsail clew] are rig measurements and the sail must fit within these parameters." (*Schaeffer sail making guide,* 2001). Reference to a boat's permanent backstay is notably absent from the text of this manual.

Another recently introduced furling boom's sail making manual limits mainsail roach to "the lesser of either 20% of "E" [horizontal distance from a mast's aft surface to a mainsail's clew] or 10% of the leech length," (*Furlboom sail making manual* p. 13, revision 010212 RBS), thus specifically excluding a mainsail roach that overlapped a sail's permanent backstay.

Furling Boom Manufacturers Reiterate that Boom Furling Mainsail Shape Relates to a Boom's Interior Volume and I Mechanical Features: 1990 to Date Manufacturers' responses to Applicant's furling boom inquiries invariably made clear that neither rig overlap nor elliptical leech form were pertinent furling boom design issues. To the contrary, manufacturers took pains to preclude large roach mainsails in order to avoid mechanical problems attributable to excessive luff friction.

What furling boom manufacturers did consider relevant was how a furling boom's mechanism interacted with the luff of its companion mainsail and whether the sail's furled volume fit into the boom. Limits on roach size pertained uniquely to a boom's furling capacity. Neither specific leech form nor rig overlap was a relevant consideration. Furling boom manufacturers were content to look no further than specifying a boom that passed clear a boat's permanent backstay and furled a companion mainsail that might or might have a nondescript roach.

The relationship between a boat's permanent backstay and the leech of its mainsail never concerned furling boom manufacturers. Exemplary responses to Applicant inquiries follow. Those responses establish that furling boom manufacturers view predictable rig overlap as extraneous to the subject matter of their booms' operation:

A. "I've spoken with our Lead Engineer regarding your many questions. Basically, our feeling is that the only limiting factor on roach is twofold:

1. Getting the sail past the backstay
2. Keeping the battens parallel to the foot of the sail to allow proper furling. (Schaefer Marine correspondence with Applicant, Oct. 24, 2001)

B. "To begin with, our sails can allow a maximum roach of 20% of "E". This roach has to be evenly distributed along the leech. (read, no fathead as in an America's Cup or Race Multihull sail.) The reason for this is twofold. First, the sail must fit inside our internal claw and roller assembly. Second, as you stated, the compression of "fat head" roach tends to add too much unnecessary friction to the System. "On our test boat, a Newport 41, we have about four inches of overlap . . . in [the lightest conditions] we have to bang on the backstay to clear it." (Furlboom correspondence with Applicant, Oct. 15, 2001)

"Furlboom's roach is the most generous in the industry. The maximum roach is described in the Sail Making Instructions. Furlboom is tapered so it is important that the sail roll forward somewhat evenly or the volume at the aft end of the sail becomes too large for the boom shell." (Furlboom correspondence with Applicant, Oct. 24, 2001)

Thus, even the most recently introduced furling boom designs restrict maximum roach according to interior boom volume and usable boom length. A Percentage of usable boom length bears no relation to whether a sail's leech will tack or jibe across a companion rig element of a boat's rig. A four-inch roach on a forty-one foot boat is negligible in the context of large-roach mainsails.

A percentage of usable boom length neither prescribes nor suggests an elliptical or any other specific leech curve form. Banging on a boat's backstay to clear a nondescript four-inch mainsail roach confirms assumptions that furling boom manufacturers consider jibing and tacking a mainsail with any backstay overlap, however small, as a hit-and-miss proposition.

In this context, furling boom manufacturers and designers obviously consider predetermined maximum roach overlap parameters unfeasible. In the final analysis, furling boom manufacturers have no desire or intention to consider issues beyond the function of their products.

C. "Back to your backstay overlap [question], it is really more a question of wear and tear on your leech as it scrapes on the backstay . . . . I can not even guess what the maximum percentage of overlap can be so I will have to leave that to a sail maker. As long as you don't exceed our maximum roach limitations, getting your battens around the backstay is up to you." (Furlboom correspondence with Applicant, Oct. 15, 2001)

Reliable predetermined maximum roach overlap parameters are as unimaginable to sailmakers as they are to boom manufacturers. Even less conceivable is the idea that contact between a mainsail and a permanent backstay might result in a performance benefit as opposed to "wear and tear".

Furling Boom Patents Preclude Large Roach Mainsails: 1990 to Date

Functionally, the increased batten length of a larger mainsail roach impedes furling boom operation by increasing forward batten pressure against a sail's mast track. As seen above, furling boom manufacturers preclude mainsail roach that might interfere with the smooth functioning of their respective products. Quite naturally, furling boom patents avoid self-defeating elements, notably friction-inducing roach specifications that might exceed a furling boom's operational limits. Simply stated, maximum roach mainsails are the apparent, even obvious enemy of smooth furling boom function.

The specific language of furling boom patents issued during the 1990's neither teaches nor suggests anything concerning backstay overlap or predetermined maximum roach parameters. Those patents address only a mainsail's leading edge while teaching or suggesting nothing about a mainsail's trailing edge.

Marechal Addresses only the Leading Edge of a Mainsail

Furling booms promised two advantages over rival in-mast furling devices: first, a boom furling sail can be lowered in the event of mechanical problems; second, and most important commercially, furling booms can use full length battens to minimize mainsail flogging, thus increasing mainsail life.

U.S. Pat. No. 5,445,098 (1994) to Marechal covered the use of supplementary sail slides at a mainsail's luff. Marechal taught nothing whatever about the trailing edge of a mainsail. The sail depicted in Marechal might as well have been triangular so long as the boom could accept the market-mandated full-length battens. Marechal's text (p. 1, line 52) specifically excludes any possibility that it taught or anticipated anything concerning an overlapping mainsail or rig compatibility.

"The head and the possible battens of the sail are attached to said luff (emphasis supplied) . . . "

For Marechal, battens were optional. For a positive roach sail, battens (or batten substitutes) are obligatory. Thus, Marechal taught nothing whatever about the specifics of mainsail roach or rig compatibility.

Marechal simply allowed that its luff-furling device provided a new and improved means to furl mainsails. Its text and drawings reveal a battened mainsail of arbitrary form that might as well have had a straight leech or even one that was concave. The text of Marechal would have been equally served had the drawings merely shown an exploded view of a mainsail that omitted the aft end of the sail altogether.

Nowhere does Marechal depict or describe a boat's rigging wires, notably a permanent backstay. Nor does Marechal ever refer to or identify a sail's leech. Contrarily, Marechal did specifically identify its mainsail's luff, while omitting to identify the sail's leech:

"In accordance with the invention, the luff 7 of the mainsail 3 (emphasis supplied) is mounted . . . " (Marechal, p. 2, line 37–40).

Marechal's failure to identify the sail's leech confirms that the patent does not pertain to either roach specifics or rig compatibility.

In FIG. 1, of Marechal, the numeral "3" identifies Marechal's mainsail. The patent reveals no separate identifying number or descriptive text pertaining to a leech of a sail. Had Marechal intended to teach anything about a sail's leech, it would have assigned a specific number for the sail's leech, as it did for the sail's luff.

As a corollary, the fact that the patent issued confirms that the pertinent prior art considered leech curve specifics irrelevant to the subject matter of Marechal, which neither explicitly nor implicitly refers in any way to a sail's leech curve.

Marechal cited no prior art that teaches or infers anything whatever concerning a sail's leech, even as it might concern the functioning of the Marechal boom. Nor did Marechal or the referenced prior art suggest that the either a sail's leech curve or a sail's compatibility with a conventional sailboat rig was pertinent to the subject matter of the patent.

Had pertinent prior art taught or suggested that either a sail's leech curve or its rig overlap was relevant and critical to the subject matter of Marechal. Marechal's failure to address and distinguish those issues from its claims would have resulted in a denial of the patent.

Marechal's claimed novelty consisted of a boom for furling a mainsail with supplementary luff slides attached to its full-length luff tape, as opposed to one having no such supplementary luff slides. The shape of the sail furled by the Marechal boom was irrelevant so long as it fit into the Marechal boom.

Neither Marechal nor the prior art taught or inferred anything about an Optimized mainsail, that is, a semi-elliptical mainsail having predetermined maximum roach overlap parameters that overlapped a companion permanent backstay. In fact, after initial boat show appearance in reduced display form, the Marechal furling boom was not offered for sale.

Nor did the boom claimed in U.S. Pat. No. 5,445,098 (1994) to Moessnang ever reach the market. Moessnang claimed a boom that furled a supplementary sail slide, suggesting a parallel with Marechal. Nonetheless Moessnang received a patent even though its supplementary slide was at the companion sail's head and did not furl into the boom. As indicated below, this patent may have issued because it disclosed a small advance in a crowded category.

Moessnang did not Anticipate any Specific Sail Profile or Rig Compatibility

U.S. Pat. No. 5,445,098 (1994) to Moessnang addresses the mechanics to rolling a sail into a boom, not a sail. As seen below, the patent issued for an advance in the narrow field of furling boom mechanisms without regard to the shape of the leech of a companion sail. Moessnang exemplifies furling boom patents that ignored entirely the trailing edge of a companion mainsail, as did the prior art covered in that patent. Furthermore, Moessnang, like Marechal, neither taught nor inferred anything concerning maximum mainsail roach parameters for conventionally rigged sailboats, elliptical leech curves or rig compatibility.

The Text of Moessnang Explicitly Confirms that its Subject Matter in no Way Pertainst to a Mainsail's Leech Curve Neither Moessnang's text nor its drawings specifically described or identified a mainsail leech or a companion rig.

Rather, Moessnang described a mainsail in the abstract, nowhere depicting a sailboat's supporting wires, or rigging. As such, the patent mirrored Marechal, teaching and inferring nothing about a mainsail's leech curve, roach dimensions, or rig overlap.

Moessnang's drawings and text each confirmed that neither prior art nor the patent, itself, taught or implied anything whatever pertinent to a mainsail's leech curve, even as it might concern the claimed furling boom. FIGS. 1*a* and 1*b* depict a boom furling mechanism and an approximate outline of a mainsail, to which the patent never refers.

FIG. 6 of Moessnang shows a typical full-batten mainsail with a narrow head, one that could not contact a permanent backstay if surrounded by a proportionally scaled conventional sailboat rig. Nor does the mainsail seen in Moessnang's FIG. 7 infer any specific leech characteristics. That figure concerns only the front end of the sail. The leech curve of the sail of FIG. 7 was entirely arbitrary and irrelevant to the patent's claims, as was the leech curve shown in Marechal.

As with Marechal, Moessnanag's claims depended exclusively its boom's capacity to furl a sail's leading edge. The text and drawings of both patents ignored entirely the specifics of a mainsail's aft end. No sail described or depicted in Marechal or Moessnang reveals or anticipates anything about maximum roach parameters overlap or rig overlap for conventionally rigged sailboats. In fact, Moessnang's drawings show no rig whatever.

Moessnang's text purports to show a "rig" at its FIG. 7, but no rig is shown, only a generic mast, a generic sail, and a boom. No forestay, shrouds or backstay is shown. Thus the word "rig" as used in Moessnang is limited to a boom and companion mast. Since no permanent backstay or specific leech curve parameter is shown in the drawings or referred to in its text, there is no reason to suppose that Moessnang incorporates, teaches, or implies anything about those subjects. Had the prior art considered such subjects pertinent to boom furling art. Moessnang's omission of them would have resulted in denial of the patent.

Moessnang's Deteailed Luff Specification had Specific Identifying Numbers

Moessnang's Mainsail Leech had no Specific Identifying Number Whatever

Not only does FIG. 5 of Moessnang assign the number 27 to the luff of the depicted mainsail, but it goes further, assigning specific numbers to the physical components of luff 27, namely: boltrope 72, luff tape 74 and even assigns a specification for the boltrope: "in the illustrated embodiment the boltrope 72 is manufactured of polyurethane having a Shore hardness of 90 in the extrusion method. It has turned out that this combination of materials has an optimum stability. (p. 7, lines 12–26).

Moessnang could have assigned a number to the leech of the sail depicted in its drawings. It did not. Moessnang could have specified a reinforcing tape at the sail's leech to assure the optimum stability and durability of the leech area of the sail, as is invariably furling boom sail making manuals invariably specify Moessnang disclosed no such specification.

Clearly, Moessnang's failure to address the aft end of the depicted sail was intentional. The aft end of the sail was irrelevant to Moessnang's claims. As in Marechal, the leech of the Moessnang mainsail could have been omitted entirely from the drawings without affecting the subject matter of the patent or the ability of one skilled in the art to make and use the invention.

At page 9, line 4, Moessnang assigned the number 27 to the mainsail. No number is assigned to the sail's leech. Reference to the sail's leech appears in a context of stress paths at page 9, line 10:

"the direction B (FIG. 7) applied via the leech by the sheet tension . . . ."

In fact, the force controlled by sheet tension is transmitted along the sail's straight clew-to-head line, not along its convex curved leech. In yet another aspect, the sail's roach is irrelevant for purposes of Moessnang.

Moessnang's vague description of its mainsail in no way anticipates or teaches whether an overlapping mainsail would be feasible for conventionally rigged sailboats, or whether predetermined parameters for such mainsails would be feasible.

" . . . the mainsail can (emphasis supplied) have a roach, especially in the top area." (p1, line 43).

In reciting explicitly that roach was optional, and that roach need not be evenly distributed along the length of a sail's leech, Moessnang specifically precludes the relevance of a sail that not only must have a roach, but a roach whose area is limited by a regularly distributed elliptical leech curve:

1. Necessarily, a semi-elliptical sail that overlapped its companion permanent backstay would have an evenly distributed roach, but
2. Moessnang explicitly stated that its mainsail did not need any roach at all. Thus, the Moessnang mainsail leech curve could have had a linear or even concave profile. The back end of the Moessnang mainsail and its relation to a boat's rig was entirely outside the subject matter of Moessnang or the prior art it referenced.
3. The text of Moessnang recited that back end of a sail could have any form whatever. The Moessnang drawings depict a sail with an arbitrary shape that bears no relation to a boat's rig or an elliptical leech curve. The description of drawings refers to a boat's rig, but only a mast is shown. The patent's "top heavy" roach description is mutually exclusive of an evenly distributed elliptical leech curve. Moessnang could not possibly have taught or inferred anything concerning a semi-elliptical mainsail with a roach that overlapped a boat's permanent backstay.

Furthermore, Marechal and Moessnang both disclosed a mainsail that needed neither battens nor roach for purposes of their respective claims. Accordingly, neither patent nor the referenced prior art could possibly have taught or inferred anything concerning an overlapping semi-elliptical mainsail, which, by definition, has a roach. Thus, neither Marechal nor Moessnang related in any way to predetermined maximum roach overlap parameters, elliptical leech curves or rig overlap. Rather, the specific language of those patents is pertinent to none of those sail properties.

Mainsail "1" of Moessnang is an Arbitrary Artists Conception that Relates only to the Front End of a Mainsail Moessnang referred to only one mainsail, assigning to it the identifying number 1, yet drawings 1*a*, 1*b*, 2*a*, 6, and 7 show diverse mainsails, each having a different, arbitrary back end. No identifying number for a leech appears anywhere in Moessnang. In fact, the only parts of a mainsail that Moessnang does identify specifically are its boltrope 72 and its headboard 24.

The issuance of Marechal and Moessnang establishes that maximum roach parameters, elliptical leech curves and rig compatibility were extraneous to the subject matter of those two patents. The pertinent prior art teaches or suggests nothing about such subjects. Pursuant to the foregoing analysis, it may be concluded that neither Marechal, nor Moessnang, nor the prior art pertinent to either teach or suggest anything concerning the back end of a sail.

Rigid Boom Prior Art Reveals Nothing About Predetermined Parameters for Specific Leech Shape or Rig Overlap U.S. Pat. No. 5,463,969 to Hoyt (1995) covered a pedestal-mounted, curved rigid boom that rotated in only a horizontal plane, as opposed to known designs that had both a vertical and a horizontal articulation. The patent is notable in that it teaches nothing about leech parameters or rig overlap, and that it issued for a small variation on a well-known device.

Pedestal-mounted booms, and socket-mounted "balestron" booms similar to the Hoyt boom are well-known devices that had fallen into disuse by the time the Hoyt boom appeared. Accordingly, a Possibility for commercial revival of an outdated device may have influenced patentability in Hoyt. In addition, since the Hoyt boom was compatible with furling sails, it could benefit from their long-established market success.

Hoyt identified its sail's luff "42", but did not identify its sail's leech. The sail depicted in FIG. 1 is an artist's conception of a small boat mainsail with partial, not full battens. Neither the patent's text nor its drawings in any way address a sail's leech curve. Since the patent describes a sailboat that has no rigging, its subject matter necessarily discloses nothing pertinent to rig overlap or the back end of a sail. FIG. 4 of Hoyt omits every part of a sail except its lower forward corner, yet the patent issued. As in Bierig, Marechal, and Moessnang, Hoyt ignored entirely the back end of its sail; so much so that Hoyt's FIG. 4 does not even bother to depict the back end of the sail.

Bierig, Hoyt, Marechal, and Moessnang, Each Presented a Small Variation of a Well Known Device in a Crowded Classification The abovementioned patents have the following common denominators:

1. Each issued in a crowded classification;
1. The claimed inventions differed only slightly from well known counterparts;
2. Each issued subsequent to widespread acceptance of convenience and safety-oriented roller furling configurations;
3. Each covered an outdated device that had fallen into disuse: rudimentary around-the-boom mainsail furling booms in the case of Marechal and Moessnang; symmetrical rigid wishbone spars in the case of Bierig; and pedestal-mounted jib booms in the case of Hoyt;

Although Bierig, Marechal, Moessnang, and Hoyt presented solutions to long-standing problems; those solutions were only minor variations on known devices and concepts. Nonetheless, patents did issue in each case, illustrating the patentability of relatively minor advances in a crowded classification.

Each of the abovementioned patents occupied a crowded rigid external spar classification that is distinct from the sail-power subject matter of the System. Notwithstanding, the present Sail System Application presents patentability issues similar to those underlying issuance in the above rigid spar patents:

In addition, the market context of the present cause resembles that which preceded issuance of the abovementioned rigid spar patents:

1. Increasing and ongoing acceptance of convenience and safety-oriented sail control devices: mainsail and headsail furling configurations already dominated the market despite compromised performance;
2. Ongoing but unsatisfied demand for an unavailable product; No available working sail configuration enabled optimum convenience and safety as well as optimum performance;
3. Replacements for outdated devices and concepts are unavailable: underpowered triangular working jibs and rigid external jib spars had fallen into disuse despite the convenience and safety advantages of self-tacking jib configurations; and
4. The present application presents major advances in a crowded classification. Far beyond the minor advances of the abovementioned rigid spar patents, Applicant's System introduces major advances in the art of sail power in contrast to minor variations on well known rigid boom devices.

The System's Subject Matter Diametrically Opposes Rigid Spar Patents and Introduces Major Advances in the Art of Sail Power By definition, rigid spar patents pertain to rigid spars. In sharp contrast, the System addresses a comprehensive sail power system that eliminates rigid spars. Furthermore, the System introduces major advances in a crowded classification including:

1. Universally compatible, low-cost Optimized working sails that imposed no modification to boat or rig;
2. Predetermined maximum roach overlap parameters;
3. Self-boomed sails made from presently available sailcloth and battens; new combinations and uses of known materials and methods that enabled reduced batten weight and even batten-free sails; and
4. Overlapping self-tacking sails.

Objects and Advantages of the System Advantages of Optimized Hoisted Working Sails over Triangular Working Sails 1. Savings to boat buyers and greater profits to sail makers and boat builders.
2. 30% more sail area and 15% less heel on average;
3. Unique, unexpected overlapping self-tacking headsails that deliver both optimum performance and optimum convenience across a wide range of conditions.
4. A single self-tacking headsail sheet replaces alternately tensioned port and starboard headsail sheets
5. A self-tacking sail replaces hard-to-handle long-footed genoas.
6. Two Optimized cockpit-controlled self-tacking working sails eliminate on deck sail handling, below-deck sail stowage, expensive sail inventories, and costly modifications to boat and rig;
7. Rigid external spars give way to lighter, less costly self-booming batten configurations;
8. Ideal interface between working sails;
9. Low initial cost, no special equipment, no modification to boat or rig; and
10. An unexpected cost-effective performance alternative to taller masts, free flying sails and high crew risk and effort.

Advantages of Self-boomed System Sails: Optimum Convenience and Safety 1. 100% cockpit-controlled Self-tacking jib convenience and safety combined with overlapping elliptical sail area creates an entirely new class of sail for new-user markets while satisfying existing demands;

2. Increased power over small triangular jibs enabling truly versatile self-tacking working sails without resort to costly, heavy furling genoa configurations and hard-to-handle, free flying sails.
3. Elimination of heavy, rigid jib spars for optimum safety and convenience;
4. New combinations of diagonal battens and vertical deployment control lines enable cockpit-controlled deployment, single-line reefing, and recovery of hoisted headsails and mainsails.
5. Automatic increase in self-booming rigidity as sail is reefed;
6. Lightweight, integral booming, vanging, deployment, reefing, and downhaul functions;
7. Dynamic sail response to changing conditions;
8. Stable at unstable downwind sailing angles where triangular sails are unstable;
9. Small incremental cost over triangular working jibs.

Advantages of Self-boomed System Sails: Optimum Performance

1. One specific performance objective was to get a maximum of efficient sail area as high as possible without changing a boat's rig. Unexpectedly, the resulting mainsails enabled and complemented more easily handled, task-specific headsails;
2. Self-boomed working sails with sufficient combined area can serve as an effective, easily controlled alternative to hard-to-handle free-flying headsails, and
3. Stable, powerful working sails can produce average speeds for shorthanded boats that equal or better those promised by long-footed genoas and free-flying headsails.

"Many sailors don't want to exert themselves sheeting in large headsails. During last fall's boat shows we couldn't help but notice the number of boats offered standard with self-tacking jibs. . . . A modern boat can sail quite nicely with a large mainsail and [100%] working jib" (*Practical Sailor*, May 15, 2000).

The foregoing confirms that owners would increasingly choose self-tacking jibs if only performance and safety compromises could be eliminated. The System eliminates those compromises, resolving problems designers have never even considered, let alone solved.

Advantages of Self-boomed System Sails: Optimum Convenience

System convenience objectives were 100% cockpit control of self-tacking Optimized working sails without resort to rigid external spars or costly, heavy furling configurations. Reducing those objectives to practice enabled unprecedented economies for boat builders and buyers alike.

A New, Unexpected Self-tacking Sail Type

As opposed to a convenient self-tacking headsail, a hoisted overlapping genoa inevitably imposes port and starboard sheets, high effort tacking and jibing, and dangerous on-deck sail changes. According to the entire history of sail design, "overlapping" sails simply could not be "self-tacking", Choosing to ignore this dictum, Applicant closely observed and compared the tacking and jibing cycles of overlapping sails with port and starboard sheets as well as those of sails with only a single self-tacking sheet. These comparisons led to a concept for sails with a non-overlapping foot and an overlapping upper section. The method and the results were diametrically opposed to long-established design approaches. Reducing that concept to practice was anything but obvious. The unexpected results had theretofore been unimaginable.

Why Overlapping Self-tacking Hoisted Sails were Unimaginable Restoring Order to Misused Terminology Sail makers and boat builders have inextricably linked the term "self-tacking" with the term jib", and the term "overlapping" with the term "genoa". Thus ensued the assumption that a self-tacking jib, as opposed to an overlapping genoa, could not overlap any of a boats rig elements. While apparently sound, that assumption is invalid.

To restore order: "Self-tacking" is a term that describes the movement or function of only the clew of a sail, without regard to whether any other part of the sail overlaps a companion boat's mast or rigging. Overlapping" describes a static physical relationship between a sail's leech and companion rig elements.

Despite prevailing assumptions to the contrary, if the clew of a self-tacking sail passes clear of companion rig elements, no physical law prohibits contact between its leech and a companion rig element. It remained for Applicant to develop predetermined parameters that assured consistent, safe passage of a self-tacking sail's leech across rig elements when tacking and jibing.

Overlapping Self-tacking Sails: Contradiction or Syneregism?

In functional terms, designers might have asked, "Can a headsail have both light air power and self tacking convenience?" or, "Can an overlapping headsail comprise a self-tacking function?" Designers never posed such questions because such questions would have been considered absurd. Had a designer dared to air such a question, glib answers might well have included, "genoas can't self-tack, and pigs can't fly."

1. Applicant's extensive Maxmain prototype tests proved that an Optimized, overlapping mainsail not only tacked and jibe reliably and safely across a companion permanent backstay, but that the sail-backstay interaction significantly enhanced the test boat's speed through tacks and jibes.
2. Following the initial contact of the Optimized Maxmain's leech with the test boat's permanent backstay, the sail roll smoothly across the backstay until the backstay momentarily held the head of the sail "aback". Historically, holding a sail aback required that crew delayed releasing the tensioned, or "old" sheet until the boat passed through the axis of the wind, at which time crew quickly released the old sheet and tensioned the "new" sheet. This maneuver was possible only for headsails with separate port and starboard sheets. It was neither safe, practical, or even useful to attempt to hold a mainsail aback.
3. A self-tacking sail that could automatically remain aback just long enough to accelerate a boat through the axis of the wind had never even been considered. Maxmains achieved precisely that inconceivable result, remaining aback automatically, and then completing the tack or jibe automatically without crew intervention, and with a release of energy that enhanced speed through the end of the maneuver.
4. While Applicant has not yet built an overlapping Maxjib, such sails should tack across the large, smooth radius of a companion mast even more easily than the test boat's prototype Maxmain tacked across the boat's permanent backstay. A parallel is found in the greater ease of passage provided by increasing the diameter of a pulley or, inversely, reducing the diameter of the cordage that passes through a pulley.

Unexpected Single-line Reefing Results

1. Unexpectedly, semi-rigid battens enabled System objectives that Bierig had deemed unfeasible. Mr. Bierig and other designers never imagined that semi-rigid battens could self-boom a sail, let alone resist the compression forces imposed by a reef line. Nonetheless, the System's unique diagonal semi-rigid batten layouts produced precisely what those designers had uniformly ignored. The result was produced by an unexpected batten triangulation.
2. As a self-boomed Maxjib is lowered for reefing, its bottom, upwards-oriented diagonal batten descends along its diagonal forestay until it assumes a horizontal attitude. At this point, the now-horizontal bottom batten constitutes the base of a triangle whose two other sides are the sail's second diagonal batten and its companion forestay. This triangulation significantly reinforces the sail's resistance to reef line compression forces.
3. Going beyond the unexpected self-booming result, this triangulation enables optimum sail shape and dynamic sail response to a wide range of wind and wave conditions that a sail set from a rigid external spar does not possess. Self-boomed System sails respond dynamically to changing conditions while holding a sail's foot in horizontal extension through a wind-speed range from five to thirty-five knots. Unlike sails attached to rigid booms, self-boomed System sails can move, or "breathe" in response to changing conditions.
4. Similarly, as a self-boomed Maxmain is lowered for reefing, a triangle forms between its stationary downwards-oriented, bottom diagonal batten; its first parallel batten; and its companion mast. If more than one reef point is present, subsequently lowered horizontal battens progressively reinforce the reef-configuration triangle to meet increasing wind speeds.
5. Progressive reinforcement of a System sail's reef triangulation unexpectedly enabled lighter-than-anticipated battens, which reduced weight aloft and also improved light air performance and ease of tacking and jibing. This effect would be further extended by use of batten reduction and batten substitute technology.
6. Finally, self-boomed System sails displayed optimum shape and durability over an extended test period covering thousands of sea miles in a wide range of wind and sea conditions with no batten breakage or unusual sail wear whatever Unexpected Economic Results FIG. 6 of the drawings of this Application superimposes two working sail configurations having equal sail area:

1. Optimized Maxmain 30 and overlapping Maxjib 26 fitted to a "standard" height mast; and
2. An "optional" tall rig configuration 113 comprising a taller triangular mainsail 112 and triangular jib 111 fitted to a taller mast.
3. As seen below, batten reduction and batten substitute technology can reduce manufacturing costs for furling boom manufacturers as well as sail shipping and storage costs for users and sail makers alike.
4. Achieving triangular sail area equivalent to that of the Optimized sail configuration shown in FIG. 6 required a 20% increase in mast height. Comparative costs appear below for a tall rig as a new boat options for a 35-foot, "reference boat," costing $200,000 new, and for an after-market or "retrofit" modification to a used reference boat.

Tall Rig Effect on Boat Stability and Performance

1. For counterpart boats, a standard-height mast setting System Maxmain and Maxjib would undoubtedly enable equal or greater average boat speed than a tall rig setting conventional sails. In addition, the standard-height mast with System sails would impose less crew effort and risk.
2. The effect of increased mast height on boat stability can be mitigated somewhat by using a more expensive, but lighter carbon fiber one. In all cases, longer, heavier rigging wires are required; adding weight aloft, which negatively affects stability. Finally, increasing the weight and length of the lever above the water typically increases heel and requires earlier reefing. Contrarily, System sails reduce heel, thus enabling delayed reefing despite their increased sail area.

Optimized Sail Cost Compared to Tall-rig Cost

1. Depending on whether an aluminum or carbon fiber mast were chosen, in cost terms, a tall rig option for a new reference boat would add $15,000–$30,000 to new boat cost. Retrofitting a tall rig to a used reference boat would cost approximately $17,500 for an aluminum mast and $35,000 for a carbon fiber mast, not including labor costs, not including the time value of the period the boat was immobilized, and not including conventional counterpart tall rig sails costing approximately $4300.

Consequently, average cost for an optional tall rig for a new, reference boat would be approximately $27,5000. Average cost to retrofit a tall rig to a used reference boat, including new hoisted mainsail and roller furling genoa would be approximately $32,000 plus labor and the time value of the period during which the boat was immobilized.
2. A System Maxmain and Maxjib having tall-rig-equivalent-sail-area would add a $1200 increment over the cost of conventional sails for the standard-height mast, or 4% of the cost of a tall rig. Truly versatile System sails impose no modification to boat or rig, they involve no installation cost, and they reduce heel by 15%, delivering optimum boat speed with minimum crew intervention.
3. In percentage terms, fitting an Optimized Maxmain and Maxjib to a reference boat having a standard-height mast would increase the reference boat's sail area by 30% for less than 1% of new boat cost. While a tall-rig retrofit with conventional mainsail and furling genoa could provide a similar increase in surface area, minimum cost would be 20% to 30% of the price of a new reference boat. Naturally, the 30-to-one percentage-of-cost advantage of System sails over tall rig conversions would increase significantly in the case of a used reference boat, according to its age and condition.
4. Where System sails are an easily installed, highly cost-effective performance product, tall rigs are not cost-effective, either as new boat options or retrofits.
5. In marketing terms, a $1200 increment to the cost of a $200,000 boat amounts to a "must have" item for a boat owner looking at a $30,000 cost for a tall rig conversion that cannot deliver equivalent performance or convenience advantages for a shorthanded boat. To the owner of a used reference boat worth, for example, $120,000, the cost-to-performance ration further favors the choice of System sails over a tall rig configuration.

6. It is justifiable to view these numbers as the basis of a "new economics" for boat builders and sail makers.

Tall Rig Versus Optimized Sails: Summary

In summary, a boat with Optimized sails fitted to a standard-height mast would be lighter than one with a tall rig, would heel 15% less, and would go as fast or faster than the tall rig counterpart with less crew effort and risk. A 1% or $1200 increment to new boat price would yield 30% more sail area and greater sail efficiency, plus increased safety and comfort. Clearly, simply installed System sails that equal or better tall-rig-performance would be highly attractive and marketable at less than 5% of the cost of a tall rig.

Unexpected Convenience and Safety Results

1. Surprisingly, reefing or recovering prototype hoisted Maxjibs proved easier than furling the test boat's roller furling genoa headsail, particularly in heavier wind conditions. The test boat's twin-headstay configuration enabled direct comparison of a hoisted Maxjib and various furling genoas.
2. Gravity and the Maxjib downhaul line invariably helped lower or reef the 100% cockpit-controlled, hoisted Maxjib in all conditions, whereas natural forces, notably wind and wave conditions progressively mitigated genoa furling as conditions deteriorated. The harder the wind blows, the more difficult the furling process, and the greater the possibility of problems with the furling mechanism, the furling line or the sail, itself.
3. Even worse, as a genoa increases in size, the force required to reef or fully recover it increases exponentially, and the length of line required to recover it increases proportionately. Consequently, in heavy weather, a fouled furling line or mechanism may render furling impossible. In the event the sail is already partially furled, cutting the sail away would be the only means of reducing sail area to a safe level.
4. In a best-case scenario, a fully deployed furling headsail would require a dangerous on-deck lowering maneuver at the front of the boat where conditions would be worst. Reefing or lowering a hoisted Maxjib in heavy weather actually produced less anxiety and required less effort than furling a supposedly safer and more convenient roller furling counterpart in like conditions.
5. As for light air conditions, if supplementary free flying sails are used, even furling ones, crewmembers must go forward frequently to lower and stow such sails and set or strike a spinnaker pole if one is used. Freestanding sails are not left in place permanently. Contrarily, a hoisted Maxmain and Maxjib combination eliminates on-deck sail handling while providing appropriate self-boomed sail, self tacking sail area for wind speeds as low as five knots; and while causing the least possible heel regardless of wind speed.
6. Cases will undoubtedly arise where a boat owner might elect to use less than maximum feasible sail area yet still access the System's convenience and safety properties. System design accommodates such demands.
7. For example, the owner of a traditional sailboat might wish to retain a traditional triangular sail profile for aesthetic reasons but still enjoy the convenience benefits of a comprehensive System control configuration. Such an election sacrifices performance but would cost somewhat less than a full System configuration. Similar priorities might exist in applying System sails to commercial navigation such as fishing trawlers or larger sail-powered passenger or cargo vessels.
8. Conversely, a performance-oriented boat owner who sails with a full complement of skilled crewmembers might wish to forego the convenience of comprehensive System cockpit control, thus limiting his sail configuration to a System batten layout and leech curve conforming to universal System maximum roach parameters. As above, such an election sacrifices convenience but would cost somewhat less than a full System configuration.
9. The foregoing applications of System properties are unexpected in that Applicant envisioned applications demanding an integration of optimum performance and optimum convenience and safety. In fact, the design fusion of System properties is divisible to advantageously satisfy particular marketing requirements.
9. System solutions thus filter through, either separately or jointly, to meet the needs of the entire spectrum of boat-owners. Applicant tailored the System for short-handed boats, yet System configurations unexpectedly meet the needs of fully crewed race boats as well those of boats that opt for traditional sail profile.
10. The unexpected breadth of the System's marketing potential attests to the fact that the System presents unprecedented solutions to a diversity of performance, convenience, and safety demands; solutions that were heretofore unavailable and, indeed, unobvious.

Step-by-step Development Process

A sail controlled by a single sheet provides "hands-off" self-tacking because its sheet and clew do not contact rig elements when the sail tacks or jibes. Incorrectly, designers assumed that if the clew of a sail must clear companion rigging, so must the entire back end of that sail. Applicant's extensive prototype testing established that a sail combining overlapping leech whose clew was non-overlapping tacked and jibed reliably and safely. Following extensive testing of two prototype designs Applicant sought to develop predetermined maximum parameters that would make the discovery applicable to both mainsails and self-tacking headsails for any conventionally rigged sailboat. The eventual product would be a new sail type drawn with new, unexpected universal geometric parameters; one which could replace external spars with new, unexpected semi-rigid batten layouts; one that would unexpectedly enable self-boomed, self-tacking overlapping headsails and mainsails.

Reduction of Theory to Practice

Once wind fills a sail, its cambered three-dimensional profile is "narrower" than its flat, two-dimensional profile might suggest. In operation, the test boat's Maxmain contacted companion permanent backstay 18 without violence, then "rolled" across the backstay from initial Maxmain rig contact point 82 upwards. Crossing last, the sail's head 98 paused "aback" momentarily, complementing the momentum of the boat as it turned toward the axis of the wind. As the Maxmain's head finally crossed the backstay, a release of energy automatically accelerated the test boat through the axis of the wind. Thousands of successful tacking and jibing maneuvers with overlapping Maxmain prototypes confirmed this unexpected phenomenon.

1. While Applicant has not yet produced a working, overlapping Maxjib, his Maxmain backstay-batten deflection tests should apply equally to an overlapping Maxjib 26. With each tack or jibe, an overlapping maxmain crosses its companion mast 10, which has a large, smooth radius, and forward lower shrouds 16, which incline inwards, thus favoring a sail's tacking and jibing momentum. Those rig elements should prove significantly less obstructive to tacking and jibing an overlapping leech than does a permanent backstay consisting of a rigging wire having a less favorable radius and inclination.

2. Predetermined, universally applicable maximum roach parameters for each System sail are based on embodiment-specific, rig-element-related reference points. Basing roach calculations on a measurement taken from the sail, itself, such as "E" cannot provide sailmakers with functional, predictable roach overlap parameters. An overlapping sail must clear companion rig elements, and it is a sail's relationship with those rig elements that must engender universally applicable roach parameters, not calculations drawn from the length of the sail's foot. Applicant's predetermined maximum roach parameters were derived from sail-to-rig spatial relationships. As such, those parameters generate leech limit points 96 that insure maximum functional sail area and an elliptical leech for each System sail, regardless of a boat's rig configuration.

Apparent Design Obstacles

Applicant encountered seemingly insurmountable design problems:

1. Could a hoisted, overlapping self-tacking headsail be compatible with any conventionally rigged sailboat? Since the terms "overlapping" and "self-tacking" had always been considered contradictory, the obvious answer was, "no."
2. Could a relatively small hoisted, self-tacking headsail for heavier conditions somehow become a "big", overlapping headsail yet still tack and jibe automatically? The obvious answer was, "no."
3. Could predetermined maximum roach overlap parameters enable large roach overlapping mainsails for conventionally rigged sailboats with permanent backstays? The obvious answer had always been, "no."

Transcending those problems was anything but obvious. The relatively small sail area and inefficiency of triangular working sails and persistent assumptions that had perpetuated the role of triangular working sails were virtually inescapable facts of life.

> "From the perspective of induced drag, the worst shape for an airfoil is a triangle, [which is] the shape of a headsail and, to a lesser extent a main (Whidden, *The Art and Science of Sails*, St. Martin's Press (1990).

Unexpected Theoretical Conclusions Reduced to Practice

Reducing Optimized working sails to practice demanded predetermined maximum roach overlap parameters that at once assured maximum sail area and consistent tacking and jibing without unusual sail wear in actual sailing conditions. Low wind speeds Presented the greatest problem because a sail might not have sufficient momentum to tack or jibe across companion rig elements.

Applicant developed and reduced to practice predetermined maximum roach parameters for overlapping, self-tacking System sails that tacked and jibed reliably without unusual sail wear, even at winds speeds as low as three knots. Hoisted System sails introduced an unprecedented combination of attributes:

1. Adequate sail area for truly light conditions of 3–5 knot wind speeds.
2. Reliable tacking and jibing in wind speeds as low as three knots.
3. Integrated cockpit controlled deployment, recovery, and single-line reefing functions.
4. Single-line reefing without resort to a rigid external spar.
5. 30% more sail are than triangular counterparts.
6. Optimum sail form for downwind sailing without resort to an external spar.
7. Overlapping semi-elliptical performance combined with hoisted sail economy and safety.
8. Convenience equal or better than that of furling configurations.

Specific Prototype Test Results: Summary

1. The test boat's prototype non-overlapping Maxjib 28 and external-spar Maxmain 32, had approximately 30% more surface area than triangular counterparts and tacked and jibed reliably in all wind conditions. Entirely cockpit-controlled, the sails increased the test boat's speed by fifteen-percent and reduced heeling by five degrees, or thirty-percent.
2. The test boat's non-overlapping Maxjib's diagonal batten layout provided lightweight, low cost self-booming and vanging, enabling cockpit-controlled single-line reefing.
3. Cockpit-controlled sail-deployment, reefing, and recovery reduced effort and anxiety levels.
4. The test boat's overlapping Maxmain tacked and jibed smoothly across the boat's permanent backstay in winds as low as three knots and exhibited no unusual wear.
5. Applicant's predetermined maximum roach parameters proved reliable through a series of prototype Maxmains, proving the feasibility of such parameters for series boat builders and sailmakers.

Prototype Test Results Lead to Unexpected New Sail Types

Prototype tests proved that new semi-rigid batten layouts could support an Optimized sail's roach while providing self-booming. Those batten configurations combined with innovative batten and luff connection configurations enabled self-boomed designs for Maxmain 30, overlapping Maxjib 28, and non-overlapping Maxjib 28 as well as one for external spar Maxmain 32, each producing new, unexpected results.

Unexpected New Sail Types Suggest New Batten and Sailcloth Uses

"Batten substitute technology", an alternate embodiment of the System, enables lighter battens or even batten-free construction for semi-elliptical sail System sail embodiments. Thus lightening sail weight aloft further extends System sail advantages.

Alternate Embodiment: External Batten Reduction Technology: Overview

The mainstream sail market is less receptive to reduced sail weight than is the racing market. For the mainstream market, sail-weight-reduction must be attractively priced and must not compromise sail life. Lightweight but costly carbon fiber battens, for example, would have little, if any, mainstream market potential. Mainstream sail buyers still prefer heavier Dacron™ sails to less durable but lighter sails made with exotic, expensive materials such as Kevlar™.

Using presently available technology such as Dacron™ sailcloth and fiberglass battens, the System introduces cost-effective reduction of weight aloft while actually enhancing the tacking and jibing of overlapping sails. Synergism is seen in the following:

External batten reduction technology, applicable to any sail, would combine a smaller, lighter-than-usual flat or round conventional batten and a task-specific, high-density batten reduction sleeve 37 in place of a larger, heavier conventional batten pocket and batten. An example of external batten reduction technology is seen in FIGS. 11, and 11*a:*

FIG. 11*a* shows a smaller-than-usual conventional fiberglass batten in combination with a correspondingly smaller, task-specific high-density batten reduction sleeve 37. Such a batten reduction combination could achieve weight reduction at a lower cost than, for example, a lighter but stiffer carbon fiber batten, which would impede tacking and jibing an overlapping sail. One skilled in the art specifies battens for given sail area and boat weight according to well-known parameters. The relative strength, weight, and resistance of available sailcloth and batten material is known to such individuals, thus enabling specifically identifiable, reductions of batten resistance coupled with purely proportional increases in batten pocket resistance. This proportional approach will effect a reduction of weight aloft because batten stock is heavier than the batten pocket cloth used for making batten substitutes.

Task-specific high-density batten reduction sleeves 37, as more fully described below, could be made from sewn or laminated combinations of available sailcloth having fabric orientation such as that seen in FIG. 11*a*. Batten reduction sleeves would also have external variable density batten sleeve zones 37*a* situated at rig contact points that would optimize tacking and jibing.

Alternatively, such external batten reduction sleeves could be fabricated using existing fiber-orienting-sail-making-technology to create design-specific local fiber orientation and densities. They could then be attached to panel-cut, or even fiber-oriented laminated sails. Fiber orientation technology, which is the most costly sail construction method, could even be used to effect reduced sail weight for less expensive, panel-cut sails.

Manufacture of such batten reduction sleeves is a new and unanticipated use of fiber-orientated sail making technology that would generate unexpected new sail making products and revenues. Such batten reduction sleeves would be easily transportable in large quantities and could carry high profit margins. Each such batten reduction sleeve could additionally incorporate a low-friction outer skin to further facilitate tacking and jibing and to reduce wear.

FIG. 11*a* also shows a semi-rigid batten having a variable density batten zone 37*d*. Reducing the thickness of a batten in a zone proximate a to rig contact point could further facilitate reliable tacking and jibing without detracting from a batten's ability to maintain sail shape. Such reduction in an intermediate zone of a batten rather than at its extremity is, in itself, a new use of a conventional batten. Battens with variable density zones can be manufactured using existing technology. The combination of a high density batten reduction sleeve and a variable density batten zone is a new one, and the combination leads to an unexpected result: significantly lighter overlapping headsails and mainsails that tack and jibe safely and reliably across the rig elements of any conventionally rigged sailboat.

Alternate Embodiment: Integral Batten Substitute Technology Batten-Free Sails: Overview FIG. 11*b* illustrates how a new use of existing fiber orienting technology could be used to eliminate battens and batten pockets entirely. Sails made with integral batten substitutes would have a self-supporting roach. This unanticipated result deriving from a new use of fiber-oriented sail making technology would combine specific densities and orientations of horizontal fibers and "diagonal or vertical fibers along each batten-substitute axis.

Each such combination, or integral batten-substitute 37*b*, would replace a corresponding batten and pocket. One skilled in the art knows the sail-support resistance required at each level of a sail and uses that knowledge systematically to specify battens for specific sail area and boat weight. Similarly, such individuals know the resistance of the fibers used in making sailcloth with fiber-oriented technology. Thus would known concepts and material be used to effect a direct, proportional substitution effected in deriving new, unexpected uses of known concepts and materials.

As seen in FIG. 11*b*, placement of task-specific integral variable density zones 37*c* at rig contact and sail-folding points would enable batten substitutes to deform and recover their original configuration, thus facilitating sail maneuvers as well as sail folding. The specifics of both external batten reductions and integral batten substitutes are set forth immediately below.

How to Make a Sail with External Batten Reduction Techonology

FIGS. 11 and 11*a* show a self-boomed Maxmain 30 in a partial side view, and in an exploded side view, respectively. The batten shown in FIG. 11*a* represents a 10-millimeter-wide flat fiberglass batten, which has replaced a 20-millimeter-wide counterpart. A correspondingly smaller, lighter, closed end, task-specific high-density batten reduction sleeve 37 contains the 10-millimeter batten. That relatively lighter batten can further enhance tacking and jibing if it comprises a variable density batten zone 37*d* proximate to a rig contact point, as seen in FIG. 11*a*. A high-density batten sleeve in combination with a batten having a rig-contact-zone-reduction 15% should produce optimum tacking and jibing across rig elements without prejudicing sail shape.

The combination would provide adequate roach support while reducing sail weight. In the case of a hoisted mainsail fitted to a furling boom, furled sail volume is a critical consideration. Reducing the volume of a furling boom's companion sail allows yet another unexpected result: a single boom boom size could accommodate a larger range of sail sizes as opposed to having an expanded range of boom sizes to accomplish the same end.

Unexpectedly, an economical combination of new batten and batten pocket configurations reduces sail volume for boom-furled sails where formerly expensive tri-radial sail construction and costly, less durable sail cloth were the only means to reducing sail volume.

Task specific high-density batten sleeves and variable density batten zones would be located and oriented according to a sail's design and could incorporate a low-friction outer skin in areas of rig contact to further facilitate tacking and jibing. External variable density batten sleeve zones 37*a* as seen in FIG. 11 also facilitate rolling or folding a sail.

Unexpected Results: External Batten Reduction Combinations

Violent contact between a heavy, rigid external boom and rig elements can break a boom or even worse, sever rigging, perhaps dismasting a boat in the case of a violent accidental jibe. A semi-rigid batten transmits minimal shock as it contacts a rig element, even in the case of an accidental jibe. The self-boomed configurations shown in FIGS. 11*a* and 11*b* would transmit less shock than rigid spar counterparts and would be less susceptible to damage. External variable density batten sleeve zones 37*a* would further mitigate rig contact impact. In no event would a semi-rigid batten menace a boat's rig elements.

Reducing sail volume without resort to costly, exotic sail materials and sail construction methods is yet another unexpected result of batten reduction and batten substitute technology. For example, furling boom manufacturers frequently specify maximum luff lengths that furl into their booms only under perfect conditions, leaving no room for crew error or difficult weather conditions. A furling boom for even a small boat such as Applicant's test boat typically costs over $5,000, and the marginal boom specification for the test boat's sail obliged Applicant reluctantly replaced his original furling boom with a larger one at considerable expense and effort.

Use of a furling boom is a personal choice for each boat owner. In sharp contrast, safe mainsail reduction and recovery in all conditions is not a matter of choice, but one of absolute necessity. As an example, the manufacturer of Applicant's furling boom specified a maximum luff length of eleven meters. The boom was incapable of furling even ten meters of luff length. The manufacturer increased the capacity of later boom versions to correct the deficiency.

Failing a change of boom, a boat owner can attempt to "make do" with an undersized furling boom by discarding his existing sail, or to replacing it at great expense with a marginally less voluminous sail made from exotic materials such as a Kevlar™-based laminations. In such cases, volume reductions effected by batten substitution would be greater than any reduction effected by resort to exotic sail cloth. Accordingly, in many cases, structurally sound but unusable furling boom sails could be restored unexpectedly to years of safe, efficient use by means of batten substitution technology. As a corollary, that same technology would apply to an eventual an unexpected reduction of the weight and volume of mainsails used with for in-mast furling mechanisms.

Thus far, furling booms have failed to reach a wider market because they require a high level of operator skill as a sail is furled down into a boom. Batten reduction and substitute technology can mitigate those furling-boom-specific problems. Of wider importance, a reduction in a sail's volume and weight reduces the effort required to handle it and more importantly, extends the margin for crew error in furling the sail. Those advantages apply to all sailboat configurations, not simply boom furling configurations.

System sails that integrate batten reduction or batten substitute configurations can be of economical panel-cut Dacron™ construction yet still assure reduced sail volume for furling boom applications and reduced weight aloft for all applications. For furling boom manufacturers and resellers, batten reduction and batten substitute technology enables a smaller range of boom sizes as opposed to a more diverse range, greatly reducing manufacturing, storage, and shipping costs.

Making a Batten-free Sail with Integral Batten-substitute Technology

FIG. 11*b* is an exploded partial side view of a batten-free sail constructed with existing fiber-orienting technology. The combination comprises:

1. Synthetic sail making fibers such as Dacron™ locally laminated along horizontal paths, thus substituting in part for semi-rigid battens; and
2. "Diagonal or vertical", task-specific laminations of synthetic sail making fibers such as Dacron™ laminated in combination with the horizontal fibers to complement their rigidity. The diagonal fibers shown In FIG. 11*a* have areas of reduced density near backstay contact points, constituting external variable density batten sleeve zones 37*a*.

For purposes of illustration, only diagonal fibers have been depicted in FIG. 11*a*. A basic or reference density ratio of approximately two diagonal or vertical fibers to one horizontal fiber should provide roach support while allowing the folding of a sail for stowage or transport. The combined rigidity of an external batten reduction sleeve and its companion batten should be equivalent to that of the batten the combination replaces.

With the foregoing "reference density" as a point of departure, densities for external variable density batten sleeve zones 37*a* would be derived as follows:

1. In variable density zones, "vertical or diagonal" fiber density would be approximately 85% of reference density, and horizontal fiber density would be approximately 70% of reference density. Those lamination densities should ensure roach support while facilitating tacking, jibing, and folding a sail for storage or shipment.
2. In variable density zones, "diagonal or vertical" fibers would separate, or "deform" upon rig contact or sail folding by virtue of locally reduced density, then return to their original configuration as intermittent loading decreased. Similarly, horizontal fibers would yield upon rig contact or folding then return to original configuration as point loading decreased. The aggregate deformation should enable tacking and jibing a batten-free sail as well as folding it.

External and Integral Batten Substitute Technology in Operation

A high-density external batten reduction sleeve 37*a* would present no obstacle to tacking, jibing. Once its companion batten was removed, the pocket would not prevent folding the sail for storage. Folding instructions for each System sail would explain folding procedures based on permanently marked variable density zones. As an added benefit, reducing the weight and rigidity of a sail's battens facilitates storing them.

As a sail with either external batten reduction technology or integral batten substitute technology tacks or jibes, leech-to-rig contact initiates a repeatable energy cycle. First, respective variable density areas of the sail would yield at each such contact, storing energy. Next, the sail's respective variable density areas would roll sequentially across companion rig element/s, beginning with a lowermost rig contact point and ending at the head the sail, which will be automatically held aback. As the head crosses the intervening rig element, a final release of energy accelerates the boat through the end of the tack or jibe.

A reduced density zone forward of permanent backstay 18 in FIGS. 11*a* and 11*b* is approximately ⅔ the size of the zone of reduced density aft of the backstay. Such zone proportions should maximize initial flexing and shock absorption as a sail contacts rig contact points. As the energy cycle continues through a tack or jibe, as each batten reduction or batten substitute bends, a consequent storing of energy results, much as energy is stored by cocking a bow; as the sail clears a corresponding rig element, that energy releases, thus optimizing completion of the tack or jibe. This unexpected power booster adds to the safety of tacking in large waves where boats can fail to complete a tack for want of adequate momentum. Unexpectedly, instead of hindering tacking and jibing, this automatic "aback" phase of each maneuver enhances the maneuver.

The energy cycle repeats from an initial rig contact point upwards, progressively accelerating a boat through a tack or jibe, as each variable density zone 37*a* yields and rebounds, thus augmenting the acceleration process and establishing a synergism. That synergism resembles one created by the individual coils a 1950's "slinky" spring toy as it magically descended a flight of stairs.

Performance and Marketing Advantages of Batten Substitute Technology

1. System batten reduction and batten substitute configurations would each enhance a sail's shock absorbing and flexing capabilities while lowering overall sail weight. Each configuration would assure roach support and synergistic energy cycles for optimum tacking and jibing.
2. System design brings to conventionally rigged boats entirely new overlapping sail types, utilizing permanent backstays and other rig elements advantageously, whereas permanent backstays had always severely limited mainsail shape and size.

Use of Known Materials and Methods, Patented and Unpatented

The System parts list includes the Dutchman™ deployment control system 73. In addition, diverse patented fiber orienting sail making methods could be used to produce the System's high-density batten reduction sleeves 37*a* or entire System sails. Use of a patented component does not obviate an invention's patentability. Furthermore, as concerns Applicant's System, each use of patented methods or materials is a new use, which produces unexpected results neither taught nor impliled by the prior art.

The following examples illustrate unforeseeable as opposed to foreseeable uses of patented products or technology:

1. Unforeseeable Uses: use of patented fiber-orientating sail making technology to make external high-density batten reduction sleeves 37, integral batten substitutes 37*b* and variable density zones 37*a* and 37*c* for use on conventional, panel-cut sails.
2. Unforeseeable uses: use of patented Dutchman deployment System 73 in combination with a self-boomed sail to enable single line reefing. Dutchman systems were conceived uniquely for use with a rigid external boom setting a sail having battens parallel to the boom. U.S. Pat. No. 4,688,506 to Van Breems (1987) clearly limited its invention to sails having battens lying parallel to external booms:

[A Dutchman system consists of] . . . one, two, or three control lines which run parallel to the mast from the boom to a topping lift . . . . Equidistant . . . battens run parallel to the boom . . . " The sail control system . . . will employ the existing boom . . . . (Van Breems, p. 1, lines 30–65).

Confirming the foregoing, each of the Van Breems drawings shows a "boom" identified with the number "16" in the case of both mainsails and jibs. Thus limited, the coverage of Van Breems could in no way, explicit or implicit, extend to System sails that have diagonal battens disposed pursuant to predetermined maximum roach parameters, and that eliminate booms altogether. System sails are, therefore, distinct from Van Breems and referenced prior art, which nowhere described, depicted or suggested a headsail or mainsail having the foregoing properties, either separately or in combination.

Applicant's use of the Dutchman deployment system in an unforeseeable context produced unexpected new results that had been ignored entirely or even deemed impossible by the Van Breems patent. For example, self boomed Maxmain 30 attaches a Dutchman deployment system 73 at an angle to and well above the Maxmain's foot, whereas Van Breems specifies attachment at foot level and in the axis of a sail's foot.

Where Van Breems required an external boom, the System eliminates them. Van Breems required boom-parallel horizontal battens, whereas the System employs diagonal battens. The System employs Dutchman deployment systems 73 in diverse new contexts, each providing not only deployment control but also uniform foot support and horizontal foot extension in both fully deployed and reefed configurations, all in the absence of a boom.

Finally, System sails can produce their entire range of functions and results without resort to a Dutchman system. Preferred System embodiments can use the Dutchman system, but lazy jacks or no deployment control device at all are other alternatives. Those alternatives facilitate addressing a broader market. A Dutchman deployment system 73 is simply one possible item of the parts list for System embodiments. In summary, the System's new and unexpected results mark a qualitative advance in the art of sail power, notably as concerns sails that eliminate external booms. Van Breems discloses only a narrow advance in deployment control methods for a sail set from an external boom.

Similarly, use of a patented fiber orientation construction method to build a System sail or to build high-density batten reduction sleeves 37*a* represents no more than contracting for application of existing methods and materials by an authorized vendor to the execution of Appliant's new, unexpected, and proprietary designs. Such use of fiber orientation sail making technology is a new and unforeseen use of known, patented technology for the production of third-party designs yielding new and unexpected results; in this case designs provided by Applicant.

3. Unforeseeable Uses: Diagonal batten configurations as well as Batten substitute configurations including diagonal ones. Van Breems is exemplary in teaching only conventional, horizontally oriented batten configurations.

"6. A sail control system as recited in claim 2 and further comprising a plurality of vertically spaced battens fixed to the sail and extending horizontally across the sail . . . " (Van Breems, p. 4, lines 25–29.)
4. Foreseeable Uses: Use of a patented mainsheet boom pulley System as a mainsheet vang pulley system. In such case, the pulley system would be performing its intended force-multiplication-function between different, but nonetheless foreseeable attachment points necessarily and customarily controlled by such a block-and-tackle device.

Summary of Unexpected New Results and System Innovations

The System's unexpected new results and innovations include the following:

1. Unique predetermined maximum roach parameters enable Optimized, overlapping self-tacking, self-boomed headsails and mainsails compatible with the rig of any conventionally rigged sailboat.
2. Overlapping, self-tacking System sails use permanent backstays and other rig elements to advantage, whereas permanent backstays had always posed a negative restriction on sail size and shape. System sail leech-to-last-rig-contact-point interaction automatically accelerates System sails through tacking and jibing maneuvers. Heretofore, such a result was inconceivable.
3. Self-tacking System sails optimize the sail area and efficiency of any sailboat without modification to boat or rig; unexpectedly constituting an unexpected, cost-effective alternative to tall rig configurations.
4. System sails can eliminate external booms, which have heretofore been indispensable to single-line reefing. Diagonal semi-rigid batten layouts automatically and progressively resist reef line compression forces as a System sail is reefed, eliminating external booms.
5. System Sails combine comprehensive, 100% cockpit-controlled deployment, reefing, and recovery with true working sail versatility for optimum performance and convenience in wind speeds from three to thirty-five knots and above.
6. Unexpectedly, both boat builders and buyers can realize savings by realizing optimum performance while avoiding costly rig and boat modifications.
7. Optimum interface between Optimized sails replaces the turbulent interface between inefficient triangular headsails and mainsails.
8. Full dynamic sail response to changing wind and sea conditions resulting from elimination of rigid external spars.
9. Headboard-end end plate combination 74 unexpectedly combines safety results with aerodynamic results usually related to the foot of a sail to produce intersail synergism while optimizing safety and performance.
10. Unforeseen use of a Dutchman™ vertical deployment control lines to evenly support the foot of a boomless System sail enables cockpit controlled single-line headsail and mainsail reefing in the absence of an external boom.
11. Compatible with both "lazy bags" as well as lazy jacks, System sails assure maximum marketability.
12. New semi-rigid batten layouts produce self-booming, self-vanging, and reinforced reef triangulation functions.
13. Unprecedented applications of fiber-oriented laminated sail making methods enable smaller, lighter battens or eliminate battens altogether.

Unexpected Results Produced by Solving Insolvable Problems

In finding solutions to insolvable problems, Applicant's System produced new and unexpected advances in the art of sail power including the following:

1. 30% more sail area without resort to long-footed genoas, free flying sails, or costly tall rig transformations.
2. Universally compatible predetermined maximum roach parameters
3. New batten; batten reduction; or batten substitute configurations that enable self-boomed, self-tacking overlapping semi-elliptical headsails and mainsails as well as lighter, less voluminous sails.
4. Converting a permanent backstay and other rig elements from an absolute disadvantage to an operational advantage when tacking and jibing.
5. Hoisted, overlapping, self-tacking sails that rival or better the performance as well as the convenience and safety of furling counterparts.

Hoisted System Configurations Better Conventional Furling Configurations

Relatively inefficient furling configurations achieved market dominance because they were convenient and safe to use. The System's hoisted working sails provide equal or better convenience and safety plus lower cost, true versatility, and Optimized performance.

The System's hoisted sails impose no compromise. Indeed, no imaginable configuration, hoisted or furling, approaches the functional and economic advantages of System working sails for conventionally rigged sailboats. For example, the System eliminates external spars, not with a loss of capability, but rather, with gains in convenience, safety, and performance that only increase as conditions deteriorate.

Market Precedents: Unexpected Products and Commercial Success

1. "Big Bertha" golf clubs "invented" their own market just when golf club design seemed to have reached an impasse.
2. A surfer and a sailor combined their ideas; decided a human body could replace a mast; and created sailboards. Sailboards still sail faster than even the most radical sailboats.
3. In a similarly unprecedented synergism, the System combines the bottom of a unique self-tacking sail, the top of an overlapping sail, and universally applicable roach parameters to create unprecedented overlapping self-tacking headsails and mainsails.
4. The mainstream sail market has long demanded easily controlled, truly versatile self-tacking sails that are cost-efficient and aesthetic. Applicant's System reduces those demands to practice using existing sail making materials and methods to produce entirely unprecedented sail types and results.

Marketing Claims and Downwind Sailing Realities

A truly convenient free flying sail a contradiction in terms. All free-flying sails require poles for optimum downwind sailing.

"Pole-less cruising spinnakers are great on a reach, but they can collapse or oscillate too much as the boat bounces around in ocean swells . . . a traditional [poled] symmetrical spinnaker is more versatile than an asymmetrical cruising spinnaker since you can use it on more numerous points of sail." (*UK sailmakers Newsletter*, December 2001).

A truly safe and convenient system for fast downwind sailing that could eliminate on-deck sail handling would be both a market success and a revolution in sail power. Self-boomed, self-tacking Maxjibs and Maxmains provide just such a result; assuring balanced surface area for cockpit-controlled, high performance-low effort downwind sailing regardless of crew size or conditions. The System makes having "the right sail at the right time" a routine matter for shorthanded crews.

Advantages and Objectives of the System—Summary

1. Optimized mainsails and self-tacking headsails providing optimum performance, convenience and safety in all conditions regardless of crew size or skill.
2. Optimum performance, convenience and safety for any conventionally rigged sailboat without modification to boat or rig.
3. A sail System that at once reduced costs for boat buyers and improved profits for the sailboat industry.
4. A System sail design that produced synergism and cost-effective wind power for both recreational and commercial users of wind-powered craft.

Additional Content

In addition to the foregoing Specification, the present Application also includes:

1. A list of reference numerals.
2. A description of drawings.
3. A review of the System's theoretical basis.
4. Instructions for making and using the System.
5. A description of main and alternative embodiments of the invention and its additional ramifications.
6. Three main claims plus twelve dependent claims; and
6. An Abstract.

List Of Reference Numerals mast 10
mast track 11
forestay 12
inner forestay 14
halyard 15
forward lower shroud 16
permanent backstay 18
wishbone 19
boom 20
pulley 21
clew ring 22
tack ring 23
head ring 24
padeye 25
overlapping Maxjib 26
non-overlapping Maxjib 28
self-boomed Maxmain 30
external-spar Maxmain 32
diagonal closed batten pocket 34
diagonal open batten pocket 35
horizontal closed batten pocket 36
high-density external batten reduction sleeve 37
external variable density batten sleeve zone 37*a*
integral batten substitute 37*b*
integral variable density zone 37*c*
variable density batten zone 37*d*
round batten 38
flat batten 40
leech batten box 41
ring-end luff batten box 42
sail slide luff batten box 43
flat-end luff batten box 44
fork-end luff batten box 45
sail hank 46
sail slide 48
jackline 50
downhaul 52
reef line 54
topping lift 55
strop 58
luff reef point 60
leech reef point 62
self-tacking sheet 64
port and starboard sheets 66
Lazy jacks 68
Dutchman eyelets 69
Dutchman tab 70
Lazy jack tab 71
Dutchman vertical control line 72
Dutchman deployment control system 73
headboard-end plate combination 74
metal grommet 75
headsail furling mechanism 76
initial Maxjib rig contact point 80
initial Maxmain rig contact point 82
backstay contact diagonal 84
head-to-clew diagonal 85
overlapping Maxjib rig contact diagonal 86
horizontal construction line 88
vertical extremities construction line 89
leech measurement intersection 90
forward girth segment 92
aft girth segment 94
leech limit point 96
head 98
luff 99
tack 100
foot 101
clew 102
reinforced foot band 103
overlapping Maxjib leech curve 104
non-overlapping Maxjib leech curve 106
Maxmain leech curve 108
ellipse 110
tall rig jib 111
tall rig mainsail 112
tall rig mast 113
counterpart overlapping triangular genoa 114
snap shackle 116
mast track insert 118
mast track gate 120

DESCRIPTION OF INVENTION

Figure 1:
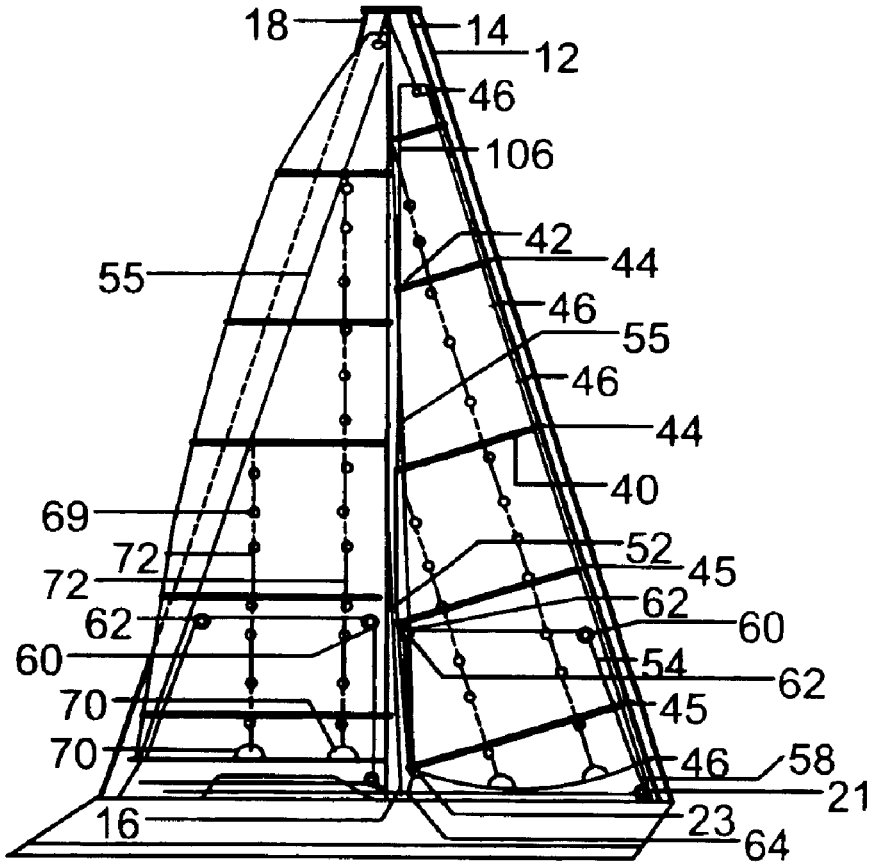
FIG. 1 is a side view of a sailboat with a conventionally boomed Maxmain and a non-overlapping Maxjib with comprehensive integral control functions.

System headsail embodiments include overlapping Maxjib 26 and non-overlapping Maxjib 28. System mainsail embodiments include self-boomed Maxmain 30 and external-spar Maxmain 32. System sail embodiments may be used in various combinations, and each conforms to a predetermined, embodiment-specific set of maximum roach parameters.

Making and Using Applicant's Sail System

A person skilled in the art pertinent to the present Amendment will be referred to as "a skilled sailmaker". The Amendment's text and drawings will explain each System sail's construction, installation and use in a manner sufficient to enable An ordinarily skilled sailmaker to make and use Applicant's sail system. The Amendment's drawings show various System sail embodiments in the scale of Applicant's thirty-three foot "test boat".

Test Procedures

Applicant performed System prototype test series over an extended period of time and approximately three thousand sea miles. System sails employed materials readily available from suppliers such as Bainbridge International. A description of each System embodiment's materials, construction methods, and cost follows.

Main Embodiments

Applicant's sail system or the "System" comprises the following main embodiments, which are compatible with any conventionally rigged sailboat:

1. Overlapping Maxjib 26;
2. Non-overlapping Maxjib 28;
3. Self-boomed Maxmain 30; and
5. External-spar Maxmain 32.

Making the Claimed System Using Embodiment—Common Sailmaking Materials and Methods Elements of a Conventionally Rigged Sailboat Each System sail embodiment is compatible with any conventionally rigged sailboat. A conventionally rigged sailboat comprises:

1. A mast 10 having a mast track 11 along the length of its aft surface;
2. Rigging wires connecting mast 10 to the sailboat, such wires comprising:
   A. forward rigging including a forestay 12; and in the case of a twin-headstay sailboat, an inner forestay 14;
   B. lateral rigging including a port and a starboard forward lower shroud 16; and
   C. aft rigging including a permanent backstay 18.

FIGS. 1, 2, 3, 6, 7*a*, 8*a*, and 9*a* each depict examples of conventionally rigged sailboats. For clarity, only rigging elements pertinent to the text of this application are shown explicitly.

Figure 4:
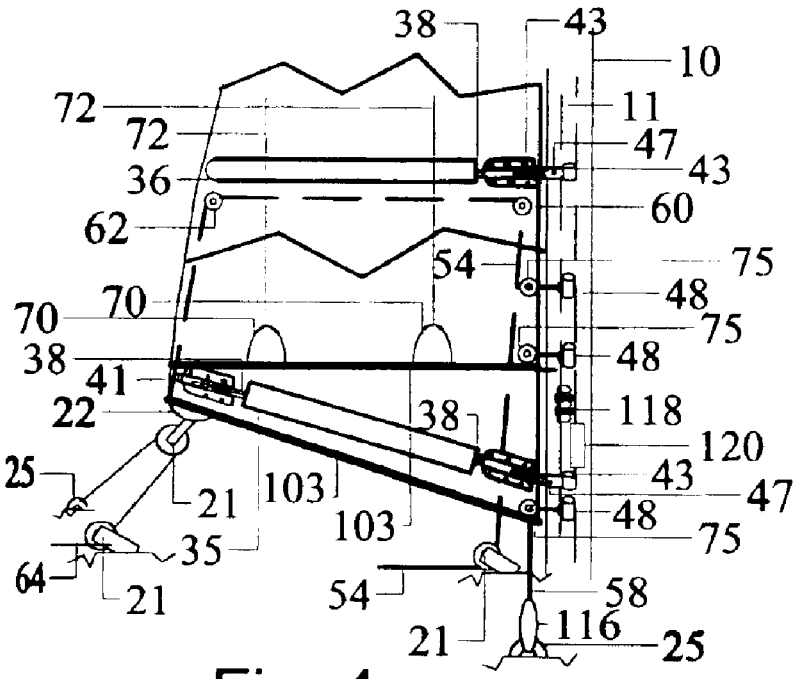
FIG. 4 is a partial side view of a fully deployed, self-boomed Maxmain showing its single-line reefing system, its two lowermost battens, and the connection of those battens to a companion mast track by respective leech batten boxes.
Figure 5:
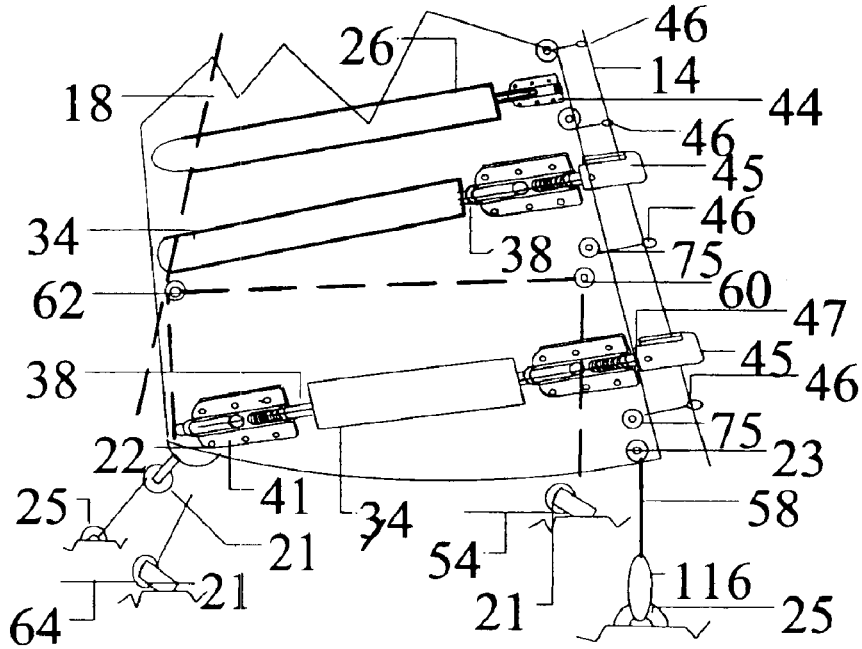
FIG. 5 is a partial side view of a fully deployed, overlapping Maxjib showing its single-line reefing System, its three lowermost battens, and their connection to an inner forestay.

Embodiment—Common Sail Making Materials and Methods A System Sail's Flexible Body, Battens, and Batten Accessories 1. Each System embodiment's flexible body and its batten pockets may be made of either woven or laminated sail cloth; its batten pockets connecting to the sail's body by sewing or gluing. Alternatively, a System sail may be made using patented fiber-orienting lamination sail making technology such as North Sails' "3D"™ or UK Sails' "Tape Drive"™.
2. In a manner known to skilled sailmakers, closed batten pockets are reinforced at their closed leech ends to eliminate separate leech batten boxes. A more detailed description of batten pocket alternatives appears below in connection with System embodiments using "Batten Substitute" technology.
3. The text and drawings of the present cause, "the text" and "the drawings", respectively, disclose System sails incorporating various combinations of horizontally or diagonally oriented conventional round battens 38 and/or flat battens 40.
4. Corresponding conventional batten boxes contain the luff ends of each System sail's battens as seen, for example, in FIG. 4. Typically, the two parts of such batten boxes are screwed together with the sail between them.
5. Readily available leech batten boxes 41, as seen in FIG. 4, can contain a batten's leech end in the case of non-overlapping battens. Typically, closed-end batten pockets contain the leech end of overlapping battens as seen in FIGS. 4 and 5. FIG. 5, for example, shows diagonal closed leech batten pockets 34 containing the sail's overlapping upper diagonal battens, whereas a leech batten box 41 contains the leech end of the sail's non-overlapping bottom batten.

Figure 9:
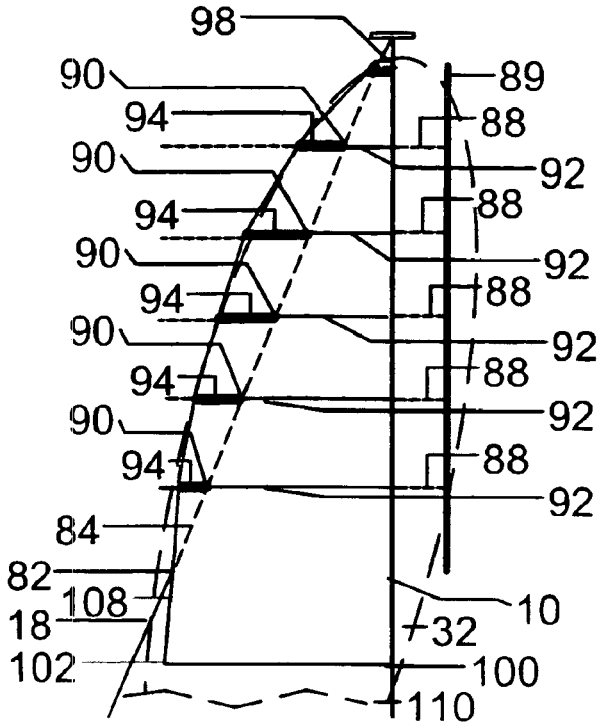
FIG. 9 is a side view of a Maxmain and a superimposed oriented ellipse along with specific leech curve calculation reference points and lines.
Figure 9B:
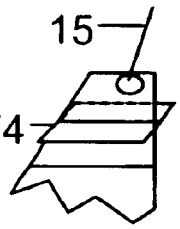
FIG. 9*b* is a partial perspective view of the head area of a Maxmain showing details of a headboard-end plate combination.
Figure 9A:
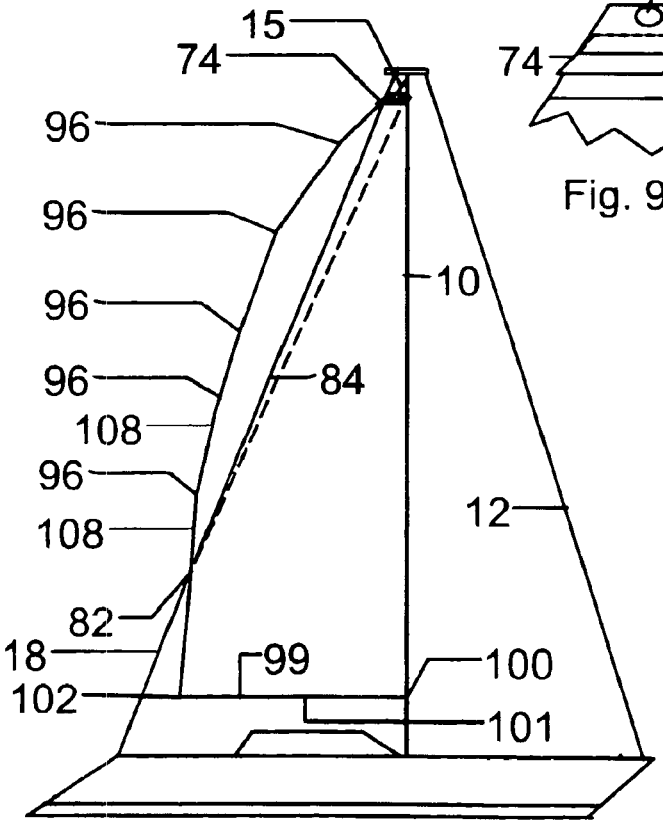
FIG. 9*a* is a side view of a Maxmain set from a sailboat's mast showing the relation of the sail's leech curve with companion rig elements.

Embodiment—Common Sail Making Materials and Methods Head Area, Halyard, and Downhaul 1. Each System embodiment has a wide head 98 as opposed to the pointed apex of a triangular sail. For example, the head of the test boat's current Maxmain and Maxjib are each over twenty-five centimeters wide. Head area detail including headboard-end plate combination 74*a* appears in FIGS. 9*a* and 9*b*.
2. A halyard 15 attaches to the head of each System embodiment then leads upward over a conventional mast pulley, or sheave, then down to deck level in a conventional manner, as seen in FIG. 9*a*.
3. As seen in FIG. 9*b*, headboard-end plate combination 74 made from a rigid metallic or composite material combines the functions of a two-part sail headboard, having a hole for halyard attachment plus port and starboard wings, or end plates. Typically, the sail is riveted between the two parts of the combination, which extends aft from the sail's luff to its leech.
4. Downhaul 52, which is tied or shackled to a metal grommet 75 just below the sail's head, leads downward to a deck-mounted pulley 21 in the axis of the sail's luff, and then aft to a boat's cockpit area as seen in FIG. 1.
5. The tack ring 23 of System sails typically connects to a strop 58, which connects the sail and the boat's deck as seen in FIG. 1.

Embodiment—Common Sail Making Materials and Methods Foot Area and Connections

1. Self-tacking sheet 64 attaches to a deck padeye 25, then leads to a pulley 21 attached to Clew 102, then leads downwards to a deck-mounted pulley 21, then leads aft to a sailboat's cockpit area as seen in FIG. 1.
2. A Maxjib's luff 99 connects to a forestay 12 or inner forestay 14 as seen in FIG. 1; a Maxmain's luff 99 connects to a mast track 11 as seen in FIG. 4.
3. With one exception, the foot of each self-boomed System sail embodiment has a single reinforced foot band 103 along the full length of its foot 101 from tack to clew. The exception, self-boomed Maxmain 32, as seen in FIG. 4, has a second reinforced foot band running above the sail's foot from leech to luff. The reinforced foot bands may be made of the same material as the sail, itself; from a more stretch-resistant fabric such as Kevlar™; or even incorporated into the sail by fiber-orienting technology. Skilled sailmakers are familiar with materials and methods appropriate to such a reinforced foot band.

Figure 4A:
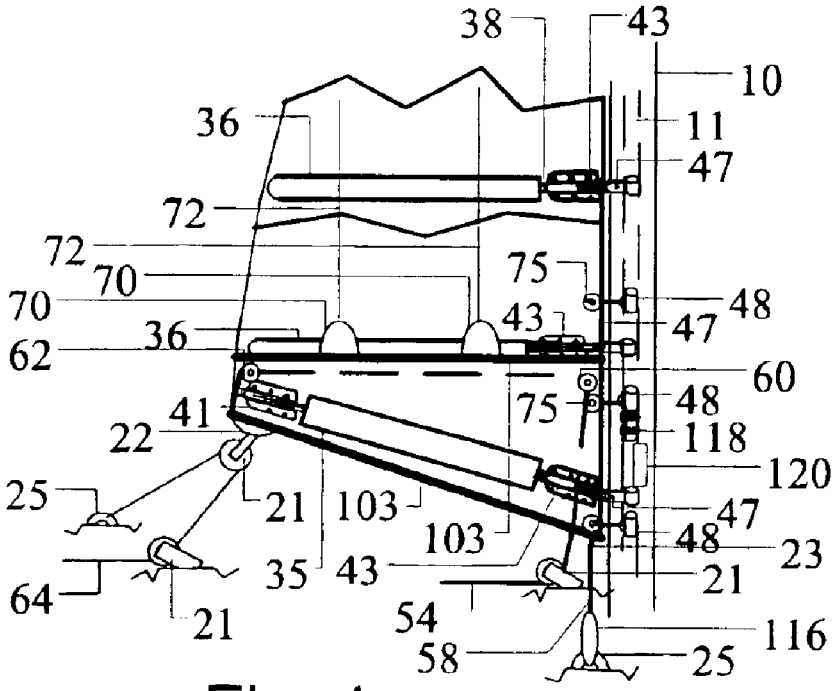
FIG. 4*a* is a partial side view of a reefed, self-boomed Maxmain showing a reefing triangulation comprising the sail's two lowermost battens and companion mast.

Embodiment-Common Sail Making Materials and Methods Topping Lift and Deployment Control System 1. System sail embodiments typically employ a topping lift 55 connecting its clew to a point near the top of its companion mast as seen in FIG. 1. An external spar Maxmain 32 set from a rigid boom having a rigid external boom vang support strut could dispense with a topping lift.
2. Each System embodiment may comprise a deployment control System, either lazy jacks 68, as seen in the amidships sail in FIG. 2, or a patented Dutchman deployment control System 73 as seen in the forward and aft sails of that figure. Preferred embodiments use a Dutchman system. Since both deployment control systems are known to skilled sailmakers, it will suffice to note that Lazy Jacks for self-boomed System sails would attach directly to the foot of a System sail embodiment, as opposed to their usual attachment to an external boom 20:
   A. In the case of lazy jacks 68, line pairs may attach directly to locally reinforced areas along the foot of any System sail embodiment, or to similarly spaced lazy jack tabs 71 made of heavy fabric or webbing sewn to the sail.
   B. In the case of a Dutchman deployment control System 73, two or more Dutchman tabs 70 are sewn to a System sail embodiment at specific points along its foot. Two or more Dutchman vertical control lines 72 connect to each such Dutchman tab. Each such control line leads upwards through a series of Dutchman eyelets 69 attached to the sail at specific vertical intervals. After passing through a final eyelet near the sail's leech, each vertical control line attaches to a topping lift 55. Instructions for the above installation elements are provided with each Dutchman system and are well-known to skilled sailmakers.
   C. Dutchman or Lazy Jack attachment points for a self-boomed Maxmain are placed along a horizontal line running between the sail's clew and its luff, as seen in FIGS. 4 and 4*a*.

Embodiment-Common Sail Making Materials and Methods Single Line Reefing Configurations Each System sail embodiment can have one or more sets of reef points. Typically, a Maxjib would have one set of reef points and a Maxmain would have two. Since a single-line reefing configuration applies inward force between a self-boomed sail's luff and leech reef points, the sail's semi-rigid batten layout must resist that force in order to remain in horizontal extension. Heretofore, it has been assumed that a rigid external spar was the sole means of accomplishing such horizontal extension. FIGS. 1–5 show single-line reefing configurations for self-boomed System sails. Those drawings enable any skilled sailmaker to produce the sail and companion reefing system given the knowledge and skill of those individuals.

Each such single-line reef level comprises a reefing line 54 that attaches to or near to a sail's clew ring 22 then leads upward through a first pulley 21 attached to a reinforced area of the sail's leech at a desired reef level; then horizontally forward through a second pulley 21 attached to a reinforced area of the sail's luff; then downwards through a deck-mounted pulley 21 to terminate in a sailboat's cockpit, as seen in FIG. 4. The mechanical attachment of reef pulley to a sail is well-known to skilled sailmakers.

Embodiment-Common Sail Making Materials and Methods Optimized Roach Parameters

Each System sail embodiment's convex, approximately elliptical leech curve conforms to embodiment-specific predetermined Optimized roach parameters based on the relationship of a sail's specific rig contact points and companion rig elements. Details of those parameters are fully developed below as to enable one skilled in the art to produce System Sails conforming to the disclosures of the present Application without resort to supplemental information.

Embodiment-Specific Sail Making Materials and Methods

Overlapping Maxjib 26: Foot Area and Connections

Figure 2:
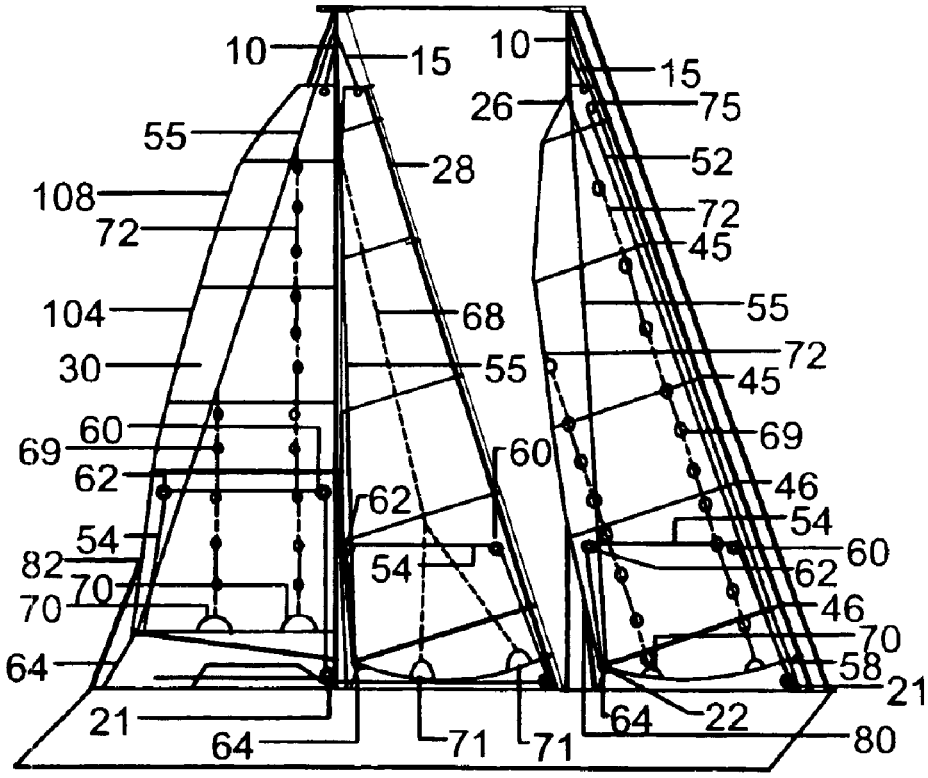
FIG. 2 is a side view of a two-masted sailboat with an overlapping Maxjib forward, a non-overlapping Maxjib amidships, and an overlapping, self-boomed Maxmain aft, each sail having comprehensive integral control functions
Figure 7:
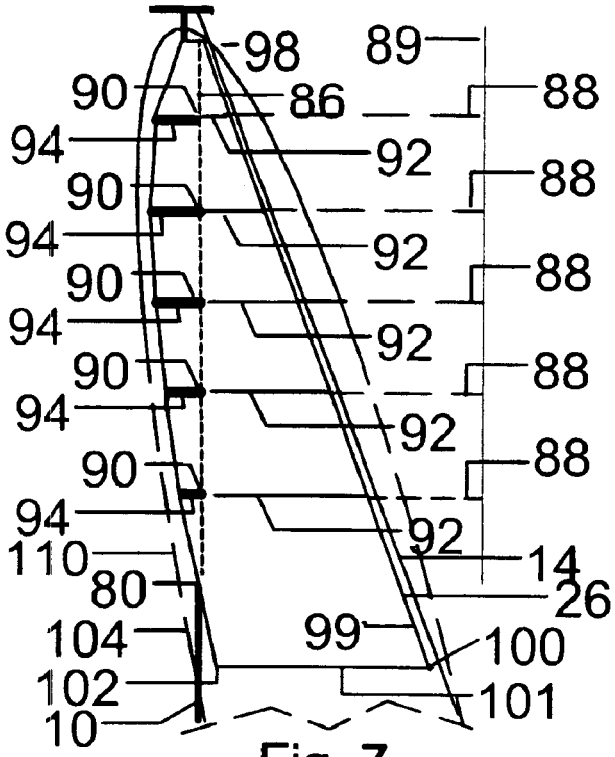
FIG. 7 is a side view of an overlapping Maxjib superimposed with an oriented ellipse along with specific leech curve calculation reference points and lines.
Figure 7A:
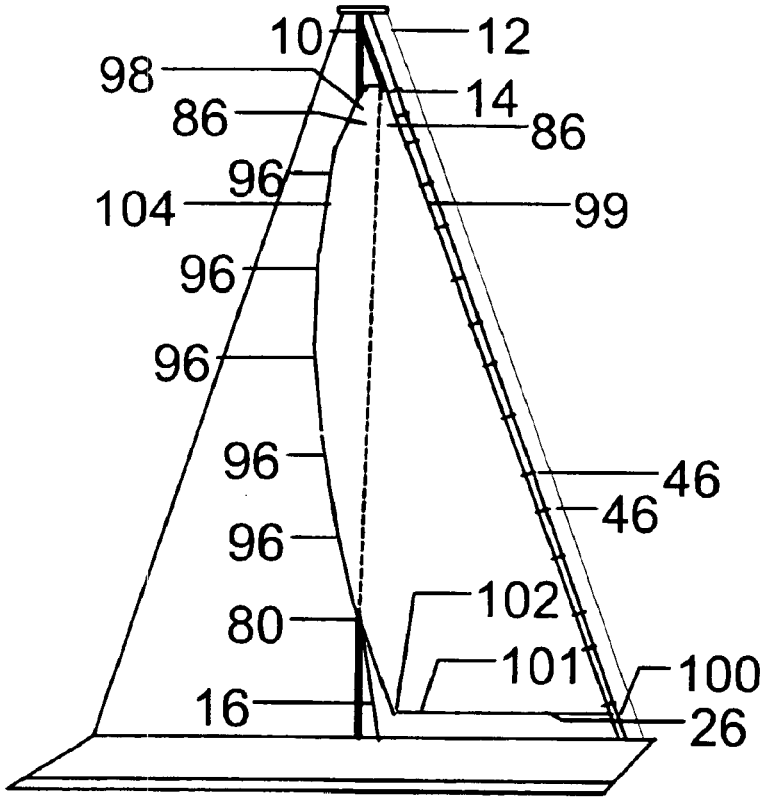
FIG. 7*a* is a side view of an overlapping Maxjib set from a sailboat's inner forestay depicting the relationship between the sail's leech curve and companion rig elements.

The foot of an overlapping Maxjib 26 terminates at its clew 102. Examples of fully deployed overlapping Maxjibs 26 are seen in FIGS. 2, 7 and 7*a*. Partial exploded views of overlapping Maxjibs are seen in FIGS. 5 and 5*a*.

1. A deck-mounted strop 58 connects the foot 101 of overlapping Maxjib 26 to the deck of the companion sailboat at the sail's tack ring 23. At its clew ring 22, the sail attaches to topping lift 55 that leads upward to a point near the head of mast 10. Self-tacking sheet 64, which has been tied or shackled to a deck-mounted padeye 25, on one side of the companion sailboat, passes through a pulley 21 shackled to clew ring 22. The sheet then leads through another pulley 21 connected to the boat's deck on the opposite side of the boat, then aft to the sailboat's cockpit. Foot connection details for overlapping Maxjib 26 are seen in FIGS. 5 and 5*a*.

Overlapping Maxjib 26: Embodiment-specific Luff Connections

Figure 5A:
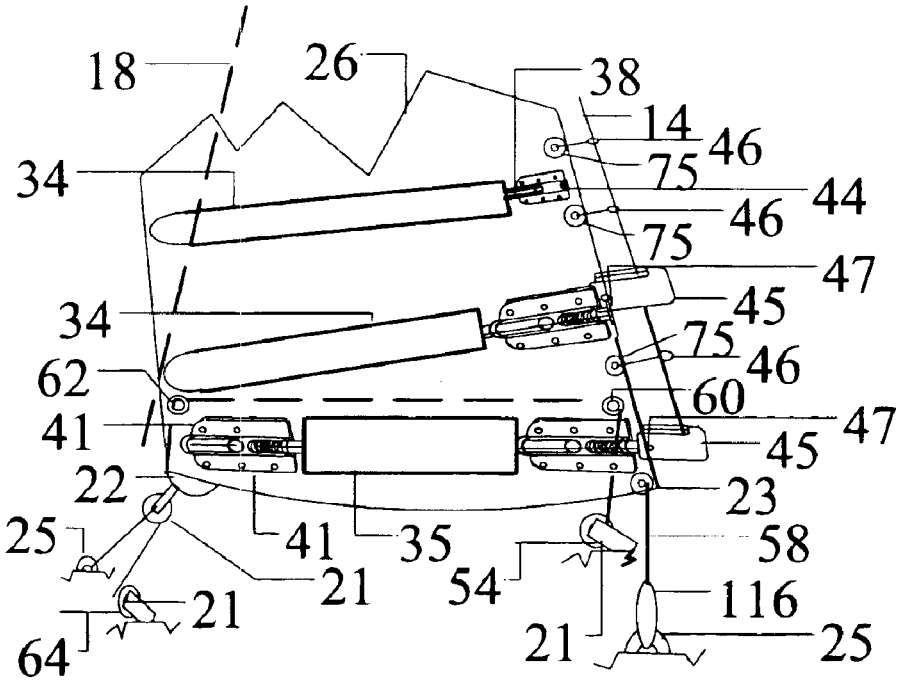
FIG. 5*a* is a partial side of a reefed, overlapping Maxjib showing a reefing triangulation comprising the sail's two lowermost battens and companion inner forestay.

FIGS. 5 and 5*a* show a combination of fork-end luff batten boxes 45 and sail hanks 46 connecting the luff of an overlapping Maxjib 26 to a diagonal inner forestay 14 at a series of connecting points. Each such luff batten box comprises two parts which are assembled on either side of the sail then screwed to each other. Each such sail hank is pressed or sewn to a metal grommet 75 fixed along the length of the sail's luff 99. Each such sail hank clips onto inner forestay 14. The present Application enables one skilled in the art to produce fully functional System sails without resort to further specifics concerning the invention.

Overlapping Maxjib 26: Embodiment-specific Batten and Reef Configurations

FIG. 5 shows a lowermost, or first round batten 38 of overlapping Maxjib 26, contained at its luff end by a fork-end luff batten box 45 attached to the sail's luff at a right angle and closed around inner forestay 14 by a batten box fixing pin 47. That first round batten passes through a diagonal open batten pocket 35, which is sewn to the sail in the diagonal axis of the sail's first round batten 38, which batten terminates at or near the sail's clew 102, being contained by a leech batten box 41.

The sail's second batten is also a round batten 38, which may have a slightly smaller diameter than the bottom round batten. For example, if the appropriate diameter for the bottom round batten 38 is twelve millimeters, as in the case of the test boat, a diameter of ten millimeters would be appropriate for the second round batten 38.

The sail's second round batten 38 attaches to the sail parallel to and above the first round batten 38 by means of a diagonal closed batten pocket 34 and a fork-end luff batten box 45. Vertical spacing between the bottom and second round battens controls the amount of sail reduced by a first reef level. For example, setting the first reef could reduce total sail area by twenty-percent.

Above the sail's second round batten, at approximately equal vertical intervals, additional, or "upper battens", are contained at their respective luff ends inside corresponding flat-end luff batten boxes 44 fixed to the sail's luff at a right angle, as seen in FIG. 5*a*, and at their respective leech ends by diagonal closed batten pockets 34. Such upper battens can be round battens 38 or flat battens 40, the former being shown in FIG. 5*a* and the latter in FIG. 3.

Upper battens can be more flexible than lower battens. For example, a flat batten twenty millimeters wide could typically serve as an upper batten for a Maxjib whose bottom and second battens were round battens with a diameter of twelve and ten millimeters, respectively, as was the case with the test boat. Similar batten rigidity ratios would apply to sails of diverse size. Batten specifications known to one skilled in the art in combination with the present disclosures would allow one skilled in the art to make System Sails.

Figure 6:
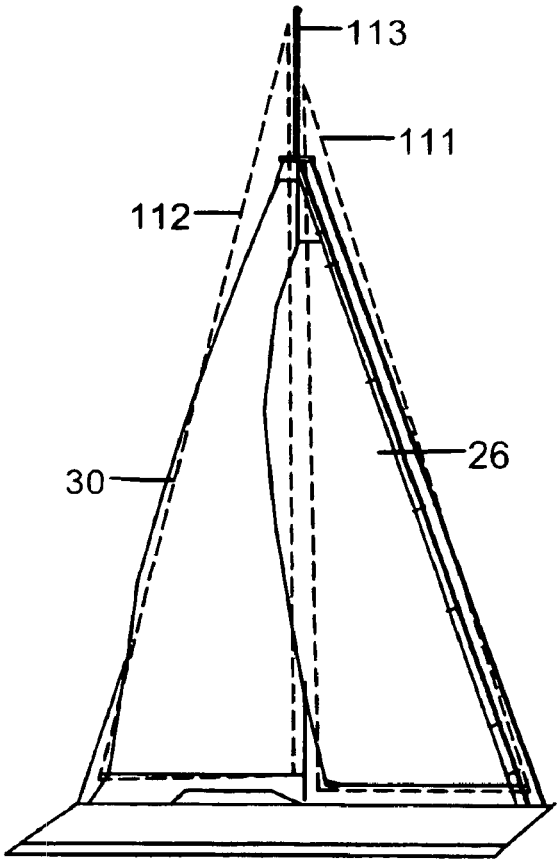
FIG. 6 is a side view of a sailboat with a tall-rig mast and companion tall-rig triangular mainsail and working jib superimposed over a standard height mast with companion semi-elliptical Maxmain and Maxjib working sails equivalent in area to the counterpart tall rig triangular sails.

In addition to batten-end connection points, single or paired sail hanks would connect any System sail to a companion forestay 12 or inner forestay 14, as seen in FIG. 6 and FIG. 1. Interbatten sail hanks typically have equidistant spacing, as seen in FIG. 1. Skilled sailmakers may specify more than two inter-batten sail hanks according to boat and sail size.

As seen in FIGS. 5 and 5*a*, leech reef point 62 of overlapping Maxjib 26 comprises a metal grommet 75 pressed into a reinforced area near the sail's leech at a level just above the leech end of diagonal closed batten pocket 34 containing the sail's lowest diagonal round batten 38. The sail's luff reef point 60 also comprises a metal grommet 75 pressed into a reinforced area of the sail near its luff. Reef line 54 attaches to the sail 's clew ring 22, then leads upwards to a pulley 21 attached to the sail at leech reef point 62, then leads horizontally through a pulley 21 attached to the sail at luff reef point 60, then downwards through a deck-mounted pulley 21 and aft to the boat's cockpit, as seen in FIGS. 5 and 5*a*.

Where one or more additional reef points is desired, a relatively flexible upper batten is replaced with a less flexible round batten 38 and, if appropriate, a batten-specific corresponding batten box and closed batten pocket for each additional set of reef points. A fork end luff batten box 45 would connect the sail to its forestay at each reef point as opposed to a sail hank. An additional reef line 54, and corresponding sail-mounted and deck-mounted pulleys 21.

The configuration seen In FIG. 1 would be appropriate for most Maxjib applications and the configuration of FIG. 5 for most Maxmain applications. One skilled in the art would be familiar with appropriate batten and reef line specifications according to sail and boat size and intended use.

Emobodiment—Specific Profile: Overlapping Maxjib 26

FIG. 7 shows perimeter lines for overlapping Maxjib 26 running from Maxjib head 98 to tack 100, to clew 102. The convex aft segment of the sail's perimeter line is its overlapping Maxjib leech curve 104. FIGS. 7 and 7*a* show in detail the sail's overlapping Maxjib leech curve 104 as well as calculation reference points and lines for drawing it.

The overlapping Maxjib leech curve 104 seen in FIG. 7*a*, descends from the head 98 of overlapping Maxjib 26 through five successive leech limit points 96 to terminate at the sail's clew 102, forming an angle of ninety degrees or more with the foot of overlapping Maxjib 26. For example, the leech-to-foot angle shown in the overlapping Maxjib 26 of FIGS. 7 and 7*a* is 102-degrees.

Embodiment—Specific Maximum Roach Parameters Overlapping Maxjib 26

Overlapping Maxjib leech curve 104 conforms to five leech limit points 96, which derive as follows:

A. FIG. 7A depicts the foot 101 and luff 99 of overlapping Maxjib 26 relative to companion mast 10 and forward lower shroud 16, thus defining a lowermost point of contact between the leech of the sail and companion rig elements, including a companion mast or forward lower shroud, B. FIG. 7 depicts a diagonal line descending from the sail's head 98 to its initial Maxjib rig contact point 80, that line being the sail's initial Maxjib rig contact diagonal 86.

C. A provisional or "construction" ellipse 110 having a midpoint width approximately equal to the prospective sail's foot length is oriented with its horizontal midpoint line over the sail's foot, as in FIG. 7. The ellipse has been oriented so that its aft perimeter approximately intersects the sail's clew 102.

D. As in FIG. 7, a vertical line disposed just forward of the sail's tack 100 runs upwards from the level of initial overlapping Maxjib contact point 80 to the level of the sail's head 98, tracing the sail's vertical extremities construction line 89.

E. Vertical extremities construction line 89 consists of six equal segments delineated by equally spaced departure points. Applicant considers a six-segment vertical extremities construction line to be universally applicable and to assure a smooth leech curve.

Dividing a vertical extremities line into less than six segments would not produce a sufficiently smooth leech curve. Dividing a vertical extremities line into more than six segments would yield a smooth leech curve, but in Applicant's opinion, no significant advantage would be gained by such an increase in line segments. Contrarily, the calculations would become cumbersome and increase the possibility of sailmaker error.

F. A provisional or horizontal construction line 88 line runs horizontally aft from each such departure point to the forward surface of the sails' companion mast 10.

G. The intersection of each horizontal leech point construction line 88 with rig contact diagonal 86 establishes a corresponding leech measurement intersection 90.

H. From each leech measurement intersection 90, measure horizontally forward to the sail's luff 99. Each such measurement defines the length of a forward girth segment 92.

I. From uppermost to lowermost, the following percentage of the length of each forward girth segment 92 yields the approximate length of each corresponding aft girth segment 94: a. 90%, b. 72%; c. 43%, d. 24%, e. 6%, f. 0%.

J. Combining corresponding forward and aft girth segments, measure the resulting distance aft from the sail's luff along each horizontal construction line 88.

K. Each such measurement delimits a corresponding leech limit point 96. Thus, if uppermost forward girth segment 92 were twenty-centimeters long, a 90% aft girth segment 94 would be eighteen-centimeters long.

L. Combining the uppermost forward and aft girth segments would yield an uppermost leech limit point 96 thirty-eight centimeters aft of the sail's luff along the axis of the prospective sail's uppermost horizontal construction line 88. The prospective sail's other leech limit points 96 are similarly derived.

M. Overlapping Maxjib leech curve 104 begins at the prospective sail's head 98, descends successively through respective leech limit points 96 to its clew 102, to form an angle with the prospective sail's foot 101 equal to or in excess of ninety-degrees. For example, the sail shown in FIGS. 7 and 7*a* has a leech-to-foot angle of approximately 102-degrees and a wide head area that clears the forward surface of the sail's companion mast 10 by at least five centimeters.

N. To achieve an optimum leech curve, overlapping Maxjib leech curve 104 conforms approximately to oriented ellipse 110 while respecting leech limit points 96. Once the sail's two-dimensional profile is finalized, batten spacing appropriate to specific use and sail budget are specified. Leech limit points are not necessarily batten placement points. One skilled in the art can readily specify batten specifications appropriate to the size, weight, and use of each client's boat.

O. Fine synchronization of construction ellipse 110 and overlapping Maxjib leech curve 104 allows transition from the perimeter calculation stage shown in FIG. 7 to the final design configuration seen in FIG. 7*a*.

Embodiment—Common Sail Making Materials and Methods

Non-overlapping Maxjib 28: Foot Area and Connections

1. The connection of a non-overlapping Maxjib 28 to a companion vessel is identical to that of an overlapping counter part, as depicted in FIGS. 5 and 5*a*. The two Maxjib types are best compared by reference to FIG. 2, which depicts the two Maxjib types on the same vessel.

2. In the following respects, non-overlapping Maxjib 28 can replicate overlapping Maxjib 26:

a. sailcloth and batten specification as well as construction methods;

b. leech and luff batten box specifications;

c. sail hank specification and spacing;

d. reef line configurations;

e. downhaul configurations; and f. topping lift configurations.

Embodiment—Specific Sail Making Materials and Methods Non-overlapping Maxjib 28: Perimeters FIG. 1 shows the perimeter lines of a non-overlapping Maxjib 28. The sail's perimeter line runs from its head 98 to its tack 100, to its clew 102. The convex aft segment of the sail's perimeter line is its non-overlapping Maxjib leech curve 106.

Figure 8:
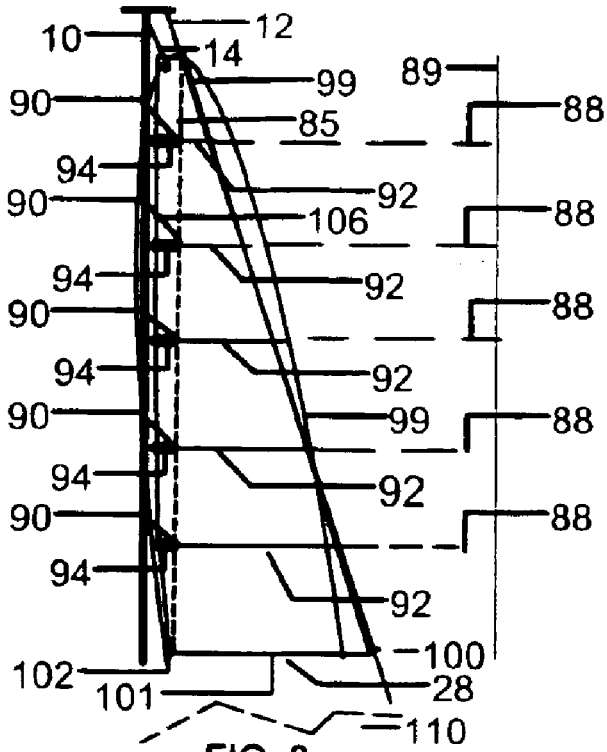
FIG. 8 is a side view of a non-overlapping Maxjib superimposed with an oriented ellipse along with specific leech curve calculation reference points and lines.
Figure 8A:
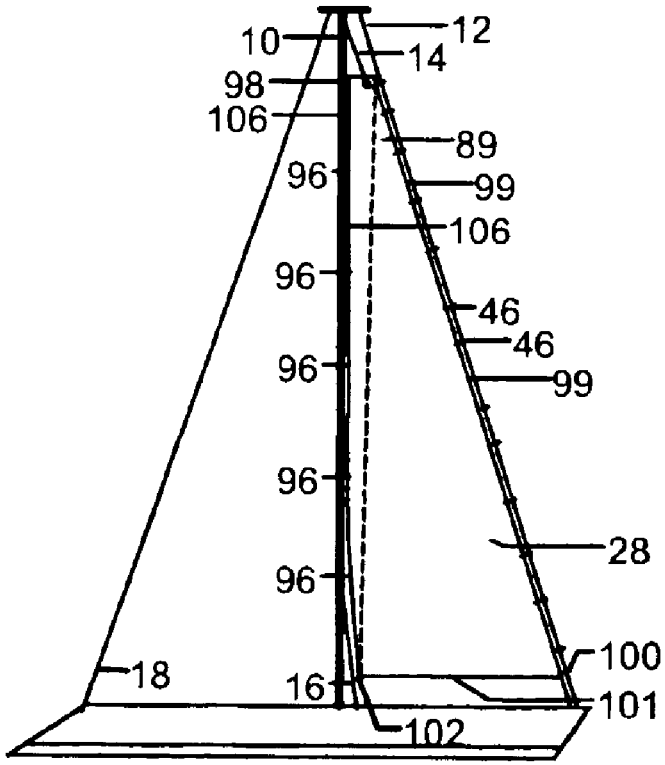
FIG. 8*a* is a side view of a non-overlapping Maxjib set from a sailboat's inner forestay depicting the relationship between the sail's leech curve and companion rig elements.

FIG. 8*a* shows a non-overlapping Maxjib leech curve 106, and FIG. 8*b* shows calculation reference points for drawing the depicted, non-overlapping Maxjib. As seen in FIG. 8*a*, non-overlapping Maxjib leech curve 106 descends from the sail's head 98 through five successive leech limit points 96 to terminate at the sail's clew 102, forming an angle of approximately ninety degrees with the foot of non-overlapping Maxjib 28. For example, the leech-to-foot angle shown in the non-overlapping Maxjib 28 of FIGS. 8 and 8*a* is 91-degrees.

Embodiment—Specific Optimized Maximum Roach Parameters: Non-overlapping Maxjib 26

Non-overlapping Maxjib leech curve 106, as seen in FIG. 8*a*, conforms to five leech limit points 96, each of which is derived as follows:

1. FIG. 8*a* depicts the foot 101 and luff 99 of a prospective non-overlapping Maxjib 28 relative to companion mast 10 and port and starboard forward lower shrouds 16, The sail's clew 102 passes no closer than approximately five centimeters forward of companion mast 10 and port and starboard forward lower shrouds 16 as the sail is tacked or jibed.

2. As seen in FIG. 8, a descending diagonal line from the sail's head 98 to its clew 102 is the sail's head-to-clew diagonal 85.

P. A provisional or "constructon" ellipse 110 having a midpoint width approximately equal to the prospective sail's foot length is oriented, as in FIG. 8, so that its vertical midpoint line lies parallel to the sail's foot, and its aft extremity approximately intersects the sail's clew 102. The horizontal midpoint line of the ellipse lies over the sail's foot.

3. Along an axis approximately above the companion sailboat's bow, a vertical line runs upwards from the level of the prospective sail's tack 100 to the level of its head 98, tracing the sail's vertical extremities construction line 89.

4. Vertical extremities construction line 89 consists of six equal segments, thus deriving five equally spaced departure points between the top and bottom of vertical extremities construction line 89.

5. A provisional or "construction" line runs horizontally from each such departure point aft to the forward surface of the prospective sails' companion mast 10. Each such horizontal construction line is a horizontal construction line 88.

6. The intersection of each of the five horizontal construction lines 88 with the sail's head-to-clew diagonal 85 establishes five leech measurement intersections 90.

7. From each leech measurement intersection 90, measure horizontally forward to the sail's luff 99. Each such measurement defines the length of a forward girth segment 92.

8. From uppermost to lowermost, the following percentage of the length of each forward girth segment 92 yields the approximate length of a corresponding aft girth segment 94: 80%, b. 30%; c. 20%, d. 6%, and e. 1%.

9. Combining corresponding forward and aft girth segments results in a horizontal distance aft from the sail's luff along each of the sail's five horizontal construction lines 88.

10. Each such combination of forward and aft girth segments terminates at one of the sail's five leech limit points 96. Thus, if uppermost forward girth segment 92 were twenty-centimeters long, an 80% aft girth segment 94 would be sixteen-centimeters long.

11. Combining the uppermost forward and aft girth segments would yield an uppermost leech limit point 96 thirty-six centimeters aft of the sail's luff along the axis of the prospective sail's uppermost horizontal construction line 88. Each of the prospective sail's five leech limit points 96 is similarly derived.

12. As seen in FIG. 8*a*, non-overlapping Maxjib leech curve 106 begins at the head 98 of the prospective sail, descends successively through its five leech limit points 96 to its clew 102, forming an angle of approximately ninety-degrees with the prospective sail's foot 101. For example, FIGS. 8 and 8*a* each show a non-overlapping Maxjib 28 having a leech-to-foot angle of approximately 91-degrees and a wide head area that clears the forward surface of the sail's companion mast 10 by at least five centimeters.

13. The resulting non-overlapping Maxjib leech curve 106 conforms as closely as possible to oriented ellipse 110 while respecting all leech limit points 96.

14. Fine synchronization of construction ellipse 110 and non-overlapping Maxjib leech curve 106 completes the transition from the perimeter calculation stage shown in FIG. 8 to the final design configuration seen in FIG. 8*a*.

Figure 3:
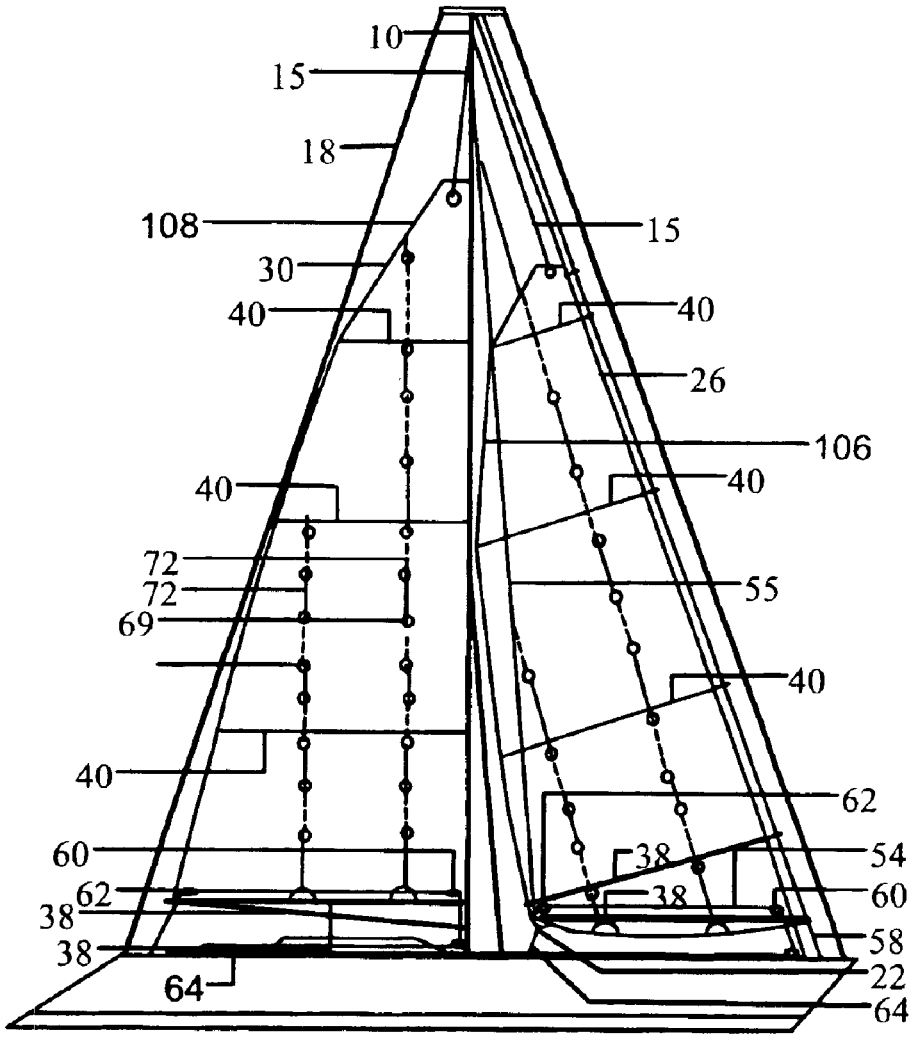
FIG. 3 is a side view of a sailboat with a reefed, self-boomed Maxmain aft and a reefed, overlapping Maxjib connected to an inner forestay forward.

Embodiment—Specific Sail Making Materials and Methods Self-boomed Maxmain 30: Battens, Batten Boxes, and Reef System 1. As seen in FIG. 3, self-boomed Maxmain 30 employs a first diagonal round batten 38, which runs downwards from its clew to its tack.

2. Batten, batten pocket, and mast connection details are seen in FIGS. 4 and 4*a*. As seen in those figures, the aft end of the sail's first diagonal round batten 38 passes through a diagonal batten pocket 35 sewn to the sail and terminates and terminates in a conventional screwed-on leech batten box 41 attaching to the sail at or near its clew.

3. A sail slide luff batten box 43 attached to the sail's luff contains the forward end of the sail's first round diagonal batten 38, which forms a batten-to-luff angle of approximately 72-degrees.

4. At its tack, its head, and at each reef point, the sail connects to companion mast track 11 by a combination of a sail slide 48 sewn to a metal grommet 75. A similar grommet-slide combination connects the sail to companion mast track 11 along the sail's luff from at intervals that one skilled in the art would specify according to sail size, boat weight and intended use.

5. Self-boomed Maxmain 30 has two reinforced foot bands 103; a first, diagonal one along the length of its diagonal foot 101 and a second, horizontal one running from the sail's leech to its luff just above the sail's lowest set of reef points 60 and 62.

6. Dutchman tabs 70 are sewn to the sail at the level of a self-boomed Maxmain's second, horizontal reinforced foot band 103, as seen in FIGS. 4, 4*a*, 10, and 10*a*.

7. At the point approximately 10 mm. below the intersection between a fully-hoisted Maxmain's clew 102 and its companion mast track 11, a mast track insert 118 screws into mast track 11.

8. Above mast track insert 118, a second, horizontally oriented round batten configuration is attached to the sail; connecting at its leech end by a horizontal closed batten pocket 36 and at its luff end by a sail slide luff batten box 43 as seen in FIG. 4.

9. At intervals above the sail's second, horizontal batten, additional horizontal, "upper battens" attach to the sail as seen in FIG. 2. The sail's upper, horizontal battens may be round or flat, and are typically more flexible than the sail's two lower, diagonal battens. Each upper batten is contained at its leech end by a horizontal closed batten pocket 36, and at its luff end by a sail slide luff batten box 43.

10. Leech reef point 62 of self-boomed Maxmain 30 comprises a metal grommet 75 pressed into a reinforced area near the sail's leech at a level just below the horizontal closed batten pocket 36 corresponding to the sail's second lowermost batten. The sail's luff reef point 60 comprises an identical metal grommet pressed into a reinforced area near the sail's luff at a point horizontally opposite the leech reef point.

11. Reef line 54 attaches to the sail's clew ring 22, then leads upwards through a pulley 21 attached to the sail at leech reef point 62, then horizontally through a pulley 21 attached at the sail's luff reef point 60, then downwards through a deck-mounted pulley 21 and aft to the boat's cockpit.

12. For each additional reef level, replace an upper batten with a round batten 38 with rigidity approximately equal to the diagonal batten immediately below it. Each such additional reef level would also requires a corresponding batten box; batten pocket: luff and leech reef points; corresponding pulleys and an additional reef line.

13. One reef point would be typical for coastal sailing and two reef points for offshore use. Skilled sailmakers are familiar with specifying the placement and number of reef points according to diverse factors including the sail's intended use and size; boat size; and local weather conditions.

14. FIG. 4 show details of a self-boomed Maxmain 30 with one reef level in a fully deployed configuration while FIG. 4*a* shows the sail in a reefed configuration. The sail's self-tacking sheet attaches to a deck-mounted padeye 25 from which point it runs through a pulley 21 attached to clew ring 22, then through a deck-mounted pulley 21 on the opposite side of the sailboat's deck, then aft to the boat's cockpit.
15. The self-tacking sheet layout shown in FIGS. 4 and 4*a* gives sufficient mechanical advantage for boats up to about eight meters long, but a four or six-part mainsheet pulley System would be typical for boats over nine-meters long, such specification being well-known to one skilled in the art.
16. The number of battens used for Maxmains can vary according to boat size and other factors known to skilled sailmakers, but the five-batten layout seen in FIG. 1 is appropriate for most Maxmains.

Embodiment—Specific Perimeters: Self-boomed Maxmain 30

1. The aft sail of FIG. 2 shows the perimeter line of self-boomed Maxmain 30, which traces a convex line from the sail's head downwards to its clew, then forward along its foot, and finally upwards along the sail's luff to join the sail's head. The convex aft segment of the sail is Maxmain leech curve 108.
2. FIGS. 9 and 9*a* show details of overlapping Maxmain leech curve 108 as well as underlying calculation reference points and lines that would enable one skilled in the art to make the sail. Calculation of a leech curve for a self-boomed or external-spar Maxmain are identical.
3. As seen in FIG. 9*a*, Maxmain leech curve 108 descends from the sail's head 98 through five successive leech limit points 96 to terminate at the sail's clew 102, forming an angle of approximately ninety-degrees to the horizontal at the level of the sail's clew. That angle, for example, is 85-degrees for the sail shown in FIGS. 9 and 9*a*.

Self-boomed Maxmain 30: Optimized Roach Parameters

Maxmain leech curve 108 conforms to five leech limit points 96, which are derived as follows FIG. 9*a* depicts the Maxmain leech curve 108 and luff 99 of a prospective self-boomed Maxmain 30 relative to a companion mast 10 and permanent backstay 18 and also depicts the prospective sail's foot 99 measurements and the lowest point at which the sail could contact the backstay, that point being the prospective sail's initial Maxmain rig contact point 82.

1. As seen in FIG. 9*a*, a provisional or "construction" line descends from the level of the sailboat's masthead to the point at which permanent backstay 18 connects to the sailboat. The resulting line is the sail's backstay contact diagonal 84.
2. As seen in FIG. 9, a provisional or "construction" ellipse 110 having a midpoint width approximately equal to the prospective sail's foot length is oriented so that its aft perimeter approximately intersects the sail's clew, and its forward perimeter approximately intersects the sail's tack.
3. A vertical line runs upwards in an axis forward of the sail's tack 100 from the level of initial Maxmain contact point 82 to the level of the sail's head 98, tracing the sail's vertical extremities construction line 89.
4. Vertical extremities construction line 89 consists of six equal segments, thus deriving five equally spaced departure points between the top and bottom of vertical extremities construction line 89.
5. A provisional or construction" line runs horizontally aft from each such departure point through and aft of permanent backstay 18. Each such horizontal construction line is a horizontal construction line 88.
6. The intersection of each of the sail's five horizontal leech point construction lines 88 with its rig contact diagonal 86 establishes five leech measurement intersections 90.
7. From each leech measurement intersection 90, measure horizontally forward to the sail's luff 99. Each such measurement defines the length of a forward girth segment 92.
8. From uppermost to lowermost, the following percentages of the length of each forward girth segment 92 yields the approximate length of corresponding aft girth segments 94: a. 90%, b. 72%; c. 43%, d. 24%, e. 6%.
9. Combining corresponding forward and aft girth segments results in a horizontal distance aft from the sail's luff along each of the sail's five horizontal construction lines 88.
10. Each such combination of forward and aft girth segments terminates at one of the sail's five leech limit points 96. Thus, if uppermost forward girth segment 92 were twenty-centimeters long, a 90% aft girth segment 94 would be eighteen-centimeters long.
11. Combining the uppermost forward and aft girth segments would yield an uppermost leech limit point 96 located thirty-eight centimeters aft of the sail's luff along the axis of the prospective sail's uppermost horizontal construction line 88. Each of the prospective sail's five leech limit points 96 is similarly derived.
12. Overlapping Maxmain leech curve 108 begins at the prospective sail's head 98, descends successively through its five leech limit points 96 to its clew 102, forming an angle with the prospective sail's foot 101 of approximately ninety-degrees. For example, the sail shown in FIGS. 9 and 9*a* has a leech-to-foot angle of approximately 85-degrees and a wide head area that clears the sail's companion permanent backstay 18 by at least five centimeters while tacking and jibing.
13. Adjust the resulting leech curve to conform as closely as possible to oriented ellipse 110 while respecting all leech limit points 96.
14. Fine synchronization of construction ellipse 110 and overlapping Maxmain leech curve 108 completes the transition from the perimeter calculation stage shown in FIG. 9 to the final sail design configuration seen in FIG. 9*a*.

Embodiment—Specific Sail Making Materials and Methods: External Spar Maxmain 32

External Spar Maxmain 32 differs from the self-boomed Maxmain seen in FIGS. 4 and 4*a* in that the external spar sail's foot is horizontal and is attached to an external spar, typically a boom 20, as seen in FIG. 1. In addition, the sail's battens are all horizontal.

Embodiment—Common Sail Making Materials and Methods: External Spar Maxmain 32 and Self-boomed Maxmain 30

External-spar Maxmain 32 replicates self-boomed Maxmain 30 in the following respects:

A. Sailcloth and batten material specification and construction methods:

B. Reef line configuration;

C. Downhaul configuration;

D. Sail-to-mast connections;

E. Topping lift configuration; and

F. Maxmain leech curve.

Embodiment—Specific Properties: Batten, Foot and Luff Connections External-Spar Maxmain 32

External-spar Maxmain 32, shown in FIG. 1, differs from self-boomed Maxmain 30 in its batten orientation and foot connections:

1. External-spar Maxmain 32 uses only horizontal battens. Typically, the sail's battens and corresponding batten boxes would all be of the same type, for example, twenty millimeter wide flat battens 40 with batten boxes appropriate to flat battens, as seen in FIG. 1.
2. FIG. 1 shows the tack 100 of external-spar Maxmain 32 connecting to the forward and aft ends of its companion boom 20.

History of the System

Cruising sailboats with freestanding masts had appeared by 1980, notably the Freedom cat ketch series. Despite their advantages, boats with freestanding masts would capture less than 5% of the market. Conventionally rigged sailboats would continue to dominate the mainstream sailboat market, and increased convenience would increasingly dominate market priorities.

By 1985 furling working sails had taken the market from hoisted counterparts, proving the market viability of easily handled sails, even if furling configurations compromised performance and cost more than counterpart hoisted configurations. Sailors and designers could not imagine hoisted sails with the convenience of furling sails. Nonetheless, Applicant set out to develop hoisted sails that surpassed furling counterparts on every point of comparison including cost, performance and convenience.

A majority of 1990 sailors wanted more power, but also wanted to work less while sailing. Designers ignored this, instead looking to costly, inconvenient performance compromises such as free-flying sails, tall rigs and exotic mast and sail materials for increased revenues. Contrarily, Applicant sought low-cost elliptical working sails that would work with any boat's rigging. Unexpectedly, the System delivered synergisms that assured optimum performance and convenience regardless of crew size or conditions using only two sails, a hoisted Maxmain and a hoisted self-tacking Maxjib.

System Design Objective Theoretical Background of the Present Invention

The practical problem for System design was first, getting a maximum amount of the most efficient type of sail area to work with any sailboat's existing rig; and second, controlling that sail area conveniently from the safety of a boat's cockpit.

Triangular sails were the worst possible aerodynamic solution. "From the perspective of induced drag, the worst shape for an airfoil is a triangle, the shape of a headsail and, to a lesser extent a main (Whidden, The Art and Science of Sails, St. Martin's Press (1990).

Apparent Design Obstacles

Reducing System design objectives to practice presented the following issues:

1. Could elliptical form, which had proven its efficiency for airplane wings be reduced to practice for working sails of conventionally rigged sailboats? The long-standing and obvious answer was, "no".
2. Hoisted self-tacking jibs, which offered maximum safety and economy, were necessarily small, hard-to-handle sails useful only in wind speeds above fifteen knots. Could a small hoisted self-tacking sail somehow evolve into a "big" self-tacking sail? The obvious answer was, "no."
3. Viewed inversely, could a big, hoisted overlapping headsail that required separate port and starboard sheets somehow keep its sail area yet tack and jibe automatically with just a single self-tacking sheet, then somehow get "smaller" again as wind speed increased? The obvious answer was "no".
4. Designers had systematically considered large-roach mainsails, which overlapped a companion permanent backstay 18 unfeasible for conventionally rigged boats. Large-roach mainsails were considered feasible only for "unconventionally rigged" boats having movable, or running backstays or free-standing rigs having no permanent backstay at all. Such boats constituted less than five-percent of modern sailboats.

Why Overlapping Self-tacking Hoisted Sails were Inconceivable

1. Overlapping hoisted headsails inevitably required separate port and starboard sheets and imposed high tacking effort, whereas self-tacking headsails controlled by only one self-tacking sheet enabled tacking and jibing without crew intervention. "Overlapping" and "self-tacking" sails had obviously incompatible properties.
2. In addition, designers invariably used the term "self-tacking sail" to describe a "non-overlapping jib" and the term "overlapping sail" to describe a "genoa".
3. To restore order, the term "self-tacking" describes a sail whose clew 102, controlled by only a only a single self-tacking sheet 64, tacks and jibes across a sailboat's deck without contacting rig elements. Used precisely, the term "self-tacking" is a term of function concerning only the clew and sheet configuration of a sail without regard to whether any part of the sail other than its clew or the sail's sheet overlaps the boat's mast or rigging.

Stated precisely and simply, a self-tacking sail is a sail controlled a single sheet that is capable of repeatedly tacking and jibing without crew intervention. The term has been misused because designers have always assumed that no part of a self-tacking sail could contact rig elements.
4. Used precisely, the term "Overlapping" describes the static physical relation between a sail's perimeters and a sailboat's rig elements without regard to whether the sail might be capable of repeatedly tacking and jibing without crew intervention. Designers have always assumed that tacking and jibing an overlapping sail required crew to alternately tension separate port and starboard sheets. Thus have two unperceived, invariable errors in terminology locked designers inescapably to the worst possible profile for working sails, the triangular profile. A transition to the optimum profile for working sails, the elliptical profile was heretofore unthinkable, as was a self-tacking overlapping headsail.

Questions Designers Never Asked

Had designers pursued functional inquiry rather than assumptions, they might have asked, "Can a headsail have both light air power and self-tacking convenience?" Stated otherwise, "can an overlapping headsail comprise a self-tacking function?" Glib answers might well have included, "genoas can't self-tack, and pigs can't fly."

Unobvious Questions

The following questions were so far beyond what the prior art deemed possible, that the questions, themselves, were ignored.

1. Could more efficient semi-elliptical hoisted headsails and mainsails overlap a boat's rig elements yet retain self-tacking convenience and safety?
2. Could hoisted, self-tacking semi-elliptical headsails and mainsails satisfy wind speeds from five to thirty-five knots yet offer self-tacking safety and convenience for any conventionally rigged sailboat?
3. Could an integral roach support System consisting of semi-rigid battens eliminate the need for costly, heavy external spars as well as external vangs?

Embodiment—Common Design Problems

1. Reducing to practice all-condition Optimized working sails obliged Applicant to develop predetermined maximum roach overlap parameters that reconciled optimum sail shape, maximum surface area, and safe, reliable, all-condition tacking without unusual sail wear. Heretofore, such parameters have been considered unfeasible.
2. To meet convenience and safety objectives, such sails would have to integrate cockpit-controlled downhaul, deployment control, and single-line reefing functions. Single-line reefing had always required that an external spar hold a sail's foot in horizontal extension against inward reef line forces. Design objectives called for self-boomed Optimized self-tacking sails with single-line reefing.
3. Finally, an integral sail framework would have to assure both roach support and optimum sail shape through a wide range of wind and sea conditions.

Maxmain—Specific Problems

Orienting the luff end of a Maxmain's lowest batten upwards might have provided a functional triangulation, but the upwards-oriented batten would have been longer than the sail's foot 101, making it impossible to safely lower or reef the sail.

1. Nor would safety or convenience allow leaving the lower part of a sail permanently hoisted and lowering the rest of the sail onto the permanently hoisted bottom batten.
2. Similarly, attaching the bottom diagonal batten and tack of the sail to the mast with an adjustable line, or "jackline" as in Bierig could not satisfy safety and convenience requirements. Theoretically, a jackline might enable lowering the sail. However, handling a sail with a free-floating tack would be unsafe in even slight seas. Even if a jackline were functional in the present context, a separate jackline would be required for each diagonal batten, creating a tangle of control lines that even the most skilled crew could not safely manage.
3. An inclined ramp inside a boat's mast might allow a diagonal batten to be raised and lowered, but would be economically unrealistic for broad market penetration and would interfere with internal mast halyards.

Downwards-oriented Bottom Batten: Self-boomed Maxmain 30

1. Orienting a self-boomed Maxmain's lower batten downwards between its clew 102 and companion mast 10 would reverse the Maxjib triangulation, bringing into force passive sail control, as opposed to active sail control. A Maxjib's lowest batten actively holds its foot in extension and controls upwards clew movement, actively converting forestay energy to pushing the sail's clew down and aft thus holding its foot in extension (self-booming) and resisting upward clew movement (self-vanging).
2. Unexpectedly, reversing the Maxjib concept yielded self-boomed Maxmain 30 whose bottom batten passively booms and vangs the sail. Unlike a headsail attached to a diagonal, semi-rigid forestay, a Maxmain attaches to a rigid, vertical companion mast 10, which does not transfer the wind's energy to the sail's lowest batten. Rather, a mast acts only as a rigid connection point for the forward end of a Maxmain's bottom batten, thus preventing forward or aft batten movement. Thus blocked in a fore and aft plane, a Maxmain's bottom batten passively resists both forward and upwards clew movement, thus booming and vanging the sail while enabling it to react dynamically to changing wind and sea conditions.
3. The unexpected "reverse triangulation" of Self-boomed Maxmain 30 satisfies reefing requirements while self-booming and vanging the sail. The sail's initial triangulation comprises its downwards-oriented diagonal batten, its bottom horizontal batten, and its companion mast. Lowering the sail's second horizontal batten onto its bottom horizontal batten meets reefing requirements precisely. As seen in FIG. 4*a*, lowering a Maxmain for reefing brings its second horizontal batten to rest on the sail's bottom horizontal batten, thus reinforcing the sail's initial, fully deployed triangulation.
4. A self-boomed Maxmain 30, like a Maxjib responds dynamically to changing wind and wave conditions through the flexing action of its inexpensive, lightweight semi-rigid batten layout. The sail's battens are less prone to breakage than a rigid external spar in the event of contact with a rig element, and they pose less danger to crew or boat in the case of an accidental jibe or other unforeseen maneuver.
5. Unexpectedly, self-boomed Maxmain 30 eliminates external spars while actually gaining functionality. The sail's downwards-oriented bottom diagonal batten provides a simple, low cost design solution as opposed to multiple jacklines or other complicated configurations that would not work in practice. The sail eliminates costly booms and the need for external vanging devices.
6. Adjusting the tension along an external-spar-mainsail's foot usually requires that a crewmember adjust an "outhaul" line that pulls the sail's foot aft. The flexing action of a Maxmain's semi-rigid battens performs this task continually without crew intervention, thus enhancing average speed by an ongoing automatic attention to sail shape.

Maxmain—Specific Unexpected Results

1. Unexpectedly, self-boomed Maxmain 30 eliminated external spars while actually gaining functionality without resort to multiple jacklines or other complicated line arrangements.
2. Shorthanded crews use outhaul lines infrequently because their use is inconvenient and sometimes dangerous. As a result, sail shape is infrequently adjusted to changing conditions. A System sail's semi-rigid battens allow them to "breathe", thus adjusting sail shape continually without crew intervention. Automatic sail shape adjustment both reduces crew fatigue and increases average boat speed.

Insolvable Problem, Unobvious Logic, and Functional Solutions

Applicant proceeded from the following logic: While a self-tacking headsail's clew must not contact rig elements, its upper leech may, indeed, contact rig elements provided that the sail can tack and jib reliably and safely in all sailing conditions. Ignoring the prevailing sail design assumption that overlapping sails could not self-tack, Applicant looked for a way to make overlapping headsails self-tack.

The solution lay in combining the foot length of a self-tacking jib with a convex leech curve, yielding a sail design whose integral structure could support a sail's roach area, yet allow it to tack and jibe reliably and safely across rig elements in all sailing conditions Overlapping Maxjib 26, which looks much like a butterfly's wing, provides surface area equivalent to that of a triangular genoa but self-tacks without crew intervention.

Maxmain prototype testing confirmed that battens with overlaps in excess of seventy-centimeters passed easily across the test boat's permanent backstay 18 without hanging up or breaking. Following initial rig contact, a self-boomed Maxmain "rolls" across its companion permanent backstay from initial Maxmain rig contact point 82 upwards.

Maxmain 28 backstay-batten deflection tests should apply equally to tacking and jibing an overlapping Maxjib 26. An overlapping Maxjib must be able to pass across companion mast 10 and port and starboard forward lower shrouds 16 as it tacks and jibes. A lower shroud is inclined diagonally inward, away from the sail's tacking arc, thus reducing the shroud's encumbrance to tacking and jibing. A mast 10 has a larger and smoother exterior surface radius than a rigging wire, thus presenting less resistance to a sail tacking or jibing across it than a backstay.

Optimized roach parameters for overlapping Maxjib 26 and self-boomed 30 or external-spar 32 Maxmains each use a calculation base line that accounts for potential rig element contact during tacking or jibing. This line relates to actual obstructions to tacking and jibing, not arbitrary points on the sail, itself. Thus, System roach parameter calculations relate to permanent backstay 18, to a line running from the sail's initial Maxjib rig contact point 80 to its head 98; a companion mast 10 or forward lower shrouds 16.

Typically, a System sail's clew 102 should clear a companion mast 10 and forward inner shrouds 16 by at least five centimeters. Subject to the foregoing, System sails' convex leech curves conform as closely as possible to an ellipse 110, as seen in FIGS. 7, 8, and 9.

Reduction of Theory to Practice

Prototype testing was performed with a non-overlapping Maxjib 28 and an external-spar Maxmain 32 on the thirty-three foot conventionally rigged "test boat". Prototypes proved entirely reliable in all wind conditions. Boat speed increased by fifteen-percent, and the test boat heeled five degrees or 15% less on average. The non-overlapping Maxjib's low-cost diagonal fiberglass battens provided dynamic self-booming and vanging in changing conditions, and the sail's cockpit-controlled sail-deployment, reefing and downhaul configurations eliminated on-deck sail handling entirely.

Maxmain prototypes having a maximum roach overlap of over 70-centimeters easily crossed the test boat's permanent backstay in winds of five knots or less and at boat speeds as low as three knots. The sails proved just as durable as a non-overlapping mainsail. Subsequent generations of Maxjib and Maxmain prototypes confirmed the feasibility and reliability of predetermined, Optimized maximum roach parameters for the mainsails and headsails of conventionally rigged sailboats.

Having reduced seemingly impossible predetermined maximum roach parameters to practice, Applicant extended the System's design concepts to create unique hoisted self-boomed, self-vanged sail designs for overlapping self-tacking Optimized headsails. Overlapping Maxjibs 28 embody those concepts. To extend the benefits of his predetermined maximum roach parameters to boats fitted with rigid booms, Applicant integrated those parameters into the design of external spar Maxmain 32.

Each prototype System sail proved fully functional using readily available sail making methods and materials. In addition, System designs were conceived with a view to accommodating and benefiting from evolving batten and sailcloth technology. An example of such accommodation is described subsequently in connection with "batten substitute technology".

Itemized Results of Ongoing Prototype Test Program

In overview, prototype testing resulted in cockpit controlled, all-condition self-tacking, hoisted Optimized headsails and mainsails that were easily deployed, reefed, and recovered. Ongoing prototype testing repeatedly confirmed the following, often unexpected results:

1. Optimized hoisted System sails emulate taller masts without the associated cost.
2. Optimized hoisted System sails create minimum inter-sail turbulence, thus assuring optimum interface with each other.
3. Reliable predetermined maximum roach parameters are feasible for mainsails and headsails any sailboats, provided that such parameters are related specifically to potential rig contact points.
4. Rig overlap of an Optimized sail not only increases boat speed and reduces heel, but also accelerates a boat through tacks, the contrary of what would have been expected.
5. In practice, extensive batten deflection tests confirmed easy mainsail passage across a permanent backstay even in light winds. At no time during extended prototype testing did a batten break, or was unusual sail wear perceptible.
6. Prototype overlapping Maxmain batten deflection tests and non-overlapping Maxjib batten tests further confirmed the feasibility of self-boomed overlapping Maxmains and Maxjibs, each of which should tack and jibe as easily as the test boat's external-spar Maxmain prototypes.

Unexpected Results in Practice

1. Among numerous unexpected results, perhaps the least expected was that a System sail's rig overlap actually enhanced boat speed through a tacking maneuver. For example, as a Maxmain tacked or jibed, the sail's head contacted companion permanent backstay 18; momentarily laid against the backstay, or "aback"; then crossed the backstay in a release of energy that accelerated the boat through the end of the tack or jibe. Heretofore, holding a sail aback required crew to manipulate two sheets and was not possible with a self-tacking sail. Overlapping Maxmains systematically enhance tacking and jibing, and overlapping Maxjibs 26 will undoubtedly replicate that performance.

Figure 10:
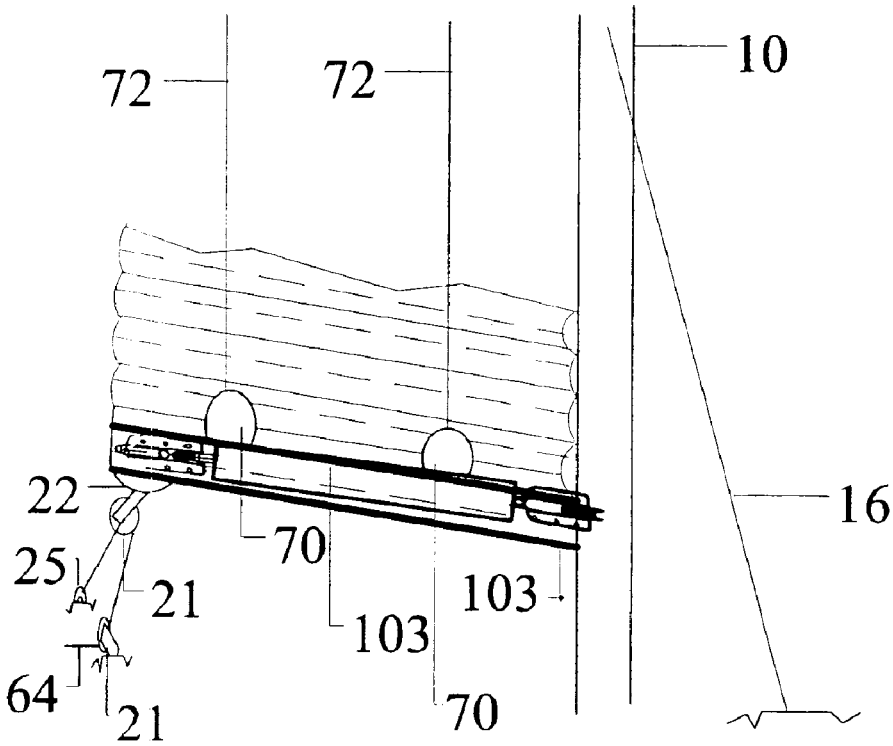
FIG. 10 is a partial side view of a lowered, flaked self-boomed Maxmain.
Figure 10A:
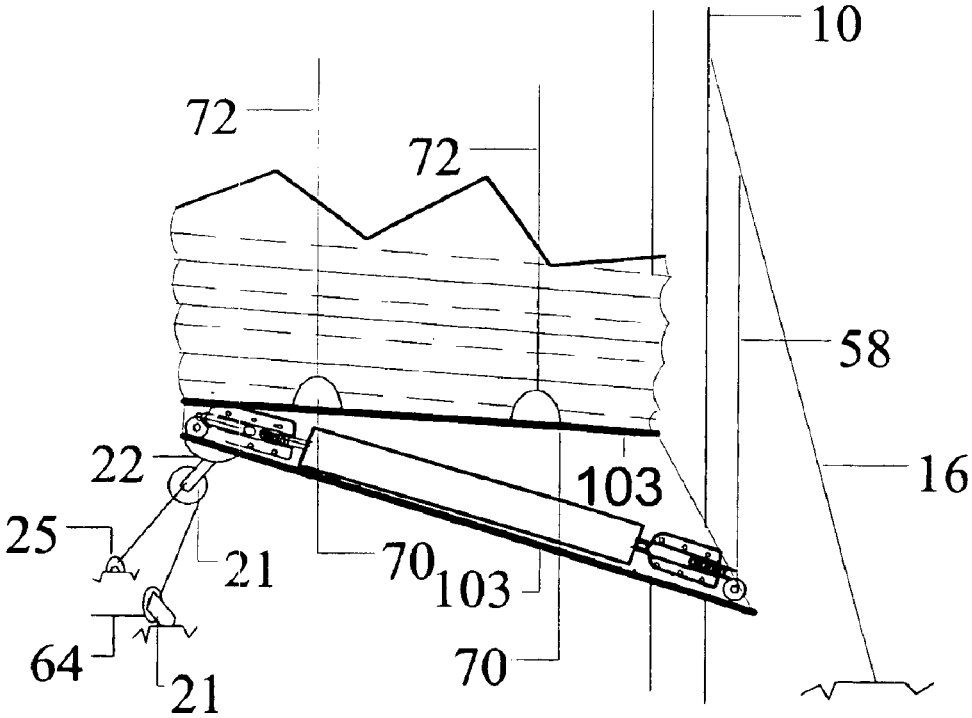
FIG. 10*a* is a partial perspective view of a lowered self-boomed Maxmain with its lowest batten in a sunshade-water catchment configuration.
Figure 11:
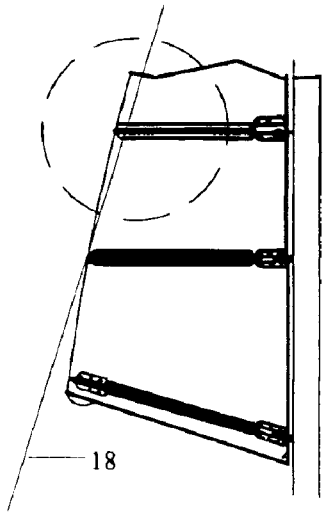
FIG. 11 is a partial side view of a fully deployed overlapping self-boomed Maxmain.
Figure 11A:
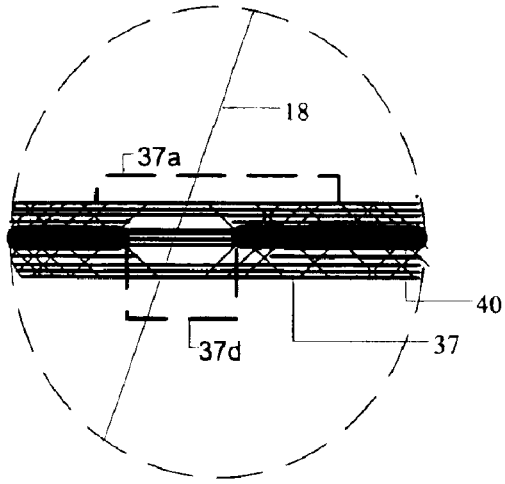
FIG. 11*a* is a partial exploded side view of a rig contact zone of a System sail having an external batten reduction sleeve, an external variable density batten sleeve zone, and a semi-rigid batten with a variable density batten zone.
Figure 11B:
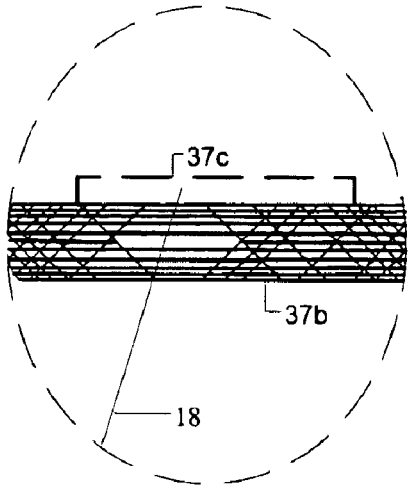
FIG. 11*b* is a partial exploded side view of a rig contact zone of a batten-free System sail having an integral batten substitute with an integral variable density zone.

2. System Maxjibs and Maxmains responded dynamically to changing wind and sea conditions thanks to the flexing of their semi-rigid battens, which also assured self-booming and vanging. Designers had long assumed that booming a sail required a rigid external spar, Contrary to the teachings of the prior art, the flexing properties of a semi-rigid batten enabled self-booming as opposed to undermining it.
3. Similarly, the bottom diagonal round batten 38 of non-overlapping Maxjib 28 prototypes not only held the sail's foot in horizontal extension, but also resisted inward reef line forces. Since the bottom round batten of an overlapping Maxjib 26 mirrors that of a non-overlapping Maxjib 28, the overlapping Maxjib will enjoy equal advantages.
4. Unexpectedly, self-boomed Maxmain 30 eliminated external spars while actually gaining functionality. Adjusting the tension along a mainsail's foot enhances sail performance by matching sail depth to wind speed but requires that a crewmember adjust an "outhaul" line that pulls the sail's foot aft. Small crews who want to sail conveniently without constant sail adjustment frequently ignore outhauls altogether.
5. Self-boomed Maxmain 30 at once gains functional and economic advantages by eliminating a rigid spar, which has heretofore been considered indispensable for reefable hoisted mainsails. In addition, a self-boomed sail reduces boat weight and cost.
6. The downwards-oriented bottom batten of Self-boomed Maxmain 30 self-booms the sail and provides a unique, self-reinforcing reef triangulation. The cockpit-controlled sail is fully functional without resort to jacklines or other cumbersome line configurations.
7. The downward, diagonal orientation of a self-boomed Maxmain's bottom batten enables use of the lower part of the sail for water catchment and as a sun awning once the tack of the sail is freed from its mast connections. FIGS. 10 and 10*a* show the sail in a stowed configuration, and in a sun shade-water catchment configuration, respectively.

The foregoing part of the present Application, which describes the physical aspects of Applicant's invention, discloses how to make as to allow one ordinarily skilled in the pertinent art to make the invention.

Main Embodiments: Rationale; Installation; and Operation

Below, the present Amendment discloses each main System embodiment along with particular "rationale", "installation", and "operation" details of each, as well as alternative system embodiments and additional System ramifications. The foregoing disclosures, along with those that follow have been drawn as to enable one ordinarily skilled in the pertinent art to make and use the invention.

Main Embodiments

1. OVERLAPPING MAXJIB 26
2. NON-OVERLAPPING MAXJIB 28
3. SELF-BOOMED MAXMAIN 30
4. EXTERNAL SPAR MAXMAIN 32

System Rationale

High performance solutions for fully crewed race boats demand highly skilled crew and important budgets. Only because they have alternately tensioned twin backstays or no backstays at all, can multihull and racing monohull sailboats use big-roach, semi-elliptical mainsails.

Large mainsails, even where feasible, do not compensate for underpowered triangular jibs or genoas. Accordingly, both racing and cruising sailboats still rely on a variety of free-flying sails and long-footed genoas to supplement triangular standing headsails. The high cost of such configurations and the danger to crew associated with such sails is increasingly clear, as seen in spinnaker-related accidents occurring during the recent America's Cup campaign.

To eliminate supplementary sail cost and on-deck sail handling entirely, System design rationale combined maximum sail area, maximum sail efficiency, in two permanently sails that can tack and jibe without crew intervention. Thus ensued a sail System that eliminated dangerous on-deck sail handling maneuvers, minimized crew effort and risk, and made sailing as comfortable as possible for passengers and active crew alike.

Overlapping Maxjib 26: Rationale

A longstanding market demand called for economical, cockpit-controlled self-tacking headsails with area and efficiency appropriate to a wind speed range of five to thirty five knots. As a first objective, for Overlapping Maxjib, Applicant sought to create a reefable, hoisted headsail that would cost less and carry less weight aloft than area-equivalent furling configurations that require separate port and starboard sheets.

Beyond specific cost, power, and self-tacking operation, the sail would need to provide cockpit-controlled deployment, reefing, and recovery. A combination of the foregoing would yield a sail capable or regaining market share hoisted headsails had lost to counterpart furling configurations. As the overlapping Maxjib design evolved, its cost-effectiveness was apparent, both as to triangular furling configurations and, surprisingly, as compared to tall rig configurations. FIG. 3 shows a reefed overlapping Maxjib 26.

Figure 6A:
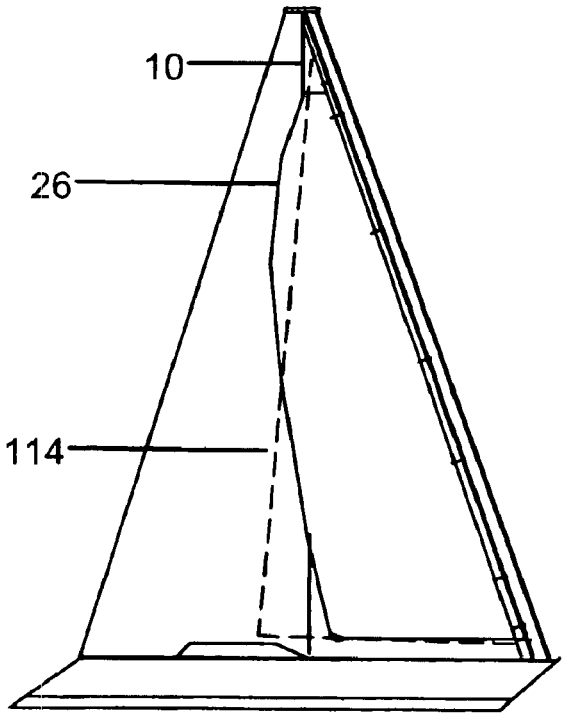
FIG. 6*a* is a side view of a sailboat with a standard height mast and a triangular 130% genoa superimposed with an area-equivalent overlapping, self-tacking Maxjib.

Not only does an overlapping maxjib have 30% more area than a triangular counterpart, but, the most effective part of overlapping Maxjib 26's sail area advantage is high up, at a level where a triangular sail presents no sail area whatever to the wind. FIG. 6*a* superimposes a triangular, area-equivalent genoa over a self-tacking overlapping Maxjib 26. The triangular, area-equivalent genoa requires crew to alternately tension port and starboard sheets and causes more heel than the Maxjib.

An overlapping rigid external spar is a contradiction in terms, whereas an overlapping self-tacking sail is not, so long as the latter sail's clew does not contact a rig element. Eliminating a sail's rigid external spar enables dynamic sail response to changing conditions. In addition, the foot of a flexible sail and its semi-rigid battens impose less risk of injury to crew than a rigid boom during tacking and jibing maneuvers.

Found on most modern boats, overlapping furling genoa configurations are costly and heavy. They are difficult to tack and jibe, and they require crewmembers to alternately release and tension port and starboard sheets. An overlapping genoa and its separate sheets must cross companion mast and upper and forward shrouds in a loud, violent manner, after which the sheet to be tensioned must be quickly hauled in, placed on a winch, and wound in to the desired point. In some cases a crewmember must go forward and lead a genoa's clew across mast and rigging manually. A failed maneuver poses risk to boat and crew in confined situations.

The violent, crew-intensive passage of a triangular overlapping genoa across companion rig elements contrasts sharply with the orderly, quiet, and automatic passage of an overlapping Maxjib 26 across rig elements. The foot 101 and self-tacking sheet 64 of all Maxjib cross in front of companion rig elements without contacting them.

The sail's momentum induces the upper part of the sail to roll across forward shroud 16 and mast 10 beginning at initial Maxjib rig contact point 80 and proceeding upward until the sail's head 98 crosses to the opposite side of the companion mast on the opposite tack or jibe. The sail's battens should actually assist the sail in smoothly transiting across mast and rigging, acting as "rails".

In sharp contrast, the passage of a flogging conventional overlapping genoa and its sheets across mast and rigging is anything but orderly, smooth, or effortless. The tacking sequence of long-footed genoas and self-tacking jibs was wryly described in a recent Practical Sailor editorial:

" . . . someone has just settled down with a paperback and a cup of coffee doesn't care after a few tacks whether you've sailed into a header, a persistent shift, or the twilight zone: They're bloody well not going to secure book and brew again, clamber down to windward, flail the new sheet around the winch, haul it in, stick it in the tailer, insert winch handle, and crank good and hard again until the sweat beads up. No sir.

This is why I believe we see so many boats headed upwind in a fine sailing breeze with the engine on and the mainsail flogging itself to death. [With] a close-sheeting, self-tending working jib . . . you'll sail well . . . simply by shifting the helm, [and] you'll begin to suspect that big genoas and their attendant winches aren't your true friends after all.

If tacking is taking its toll in your cockpit, and the alternative is divorce, or worse, golf, hie thee over to . . . self-tacking in the site-search box . . . think how nice it would be to tack fast without the asking." (Practical Sailor, Vol. 30, Feb. 1, 2004, p. 2).

Maxjibs' advantages over underpowered, conventional, triangular self-tacking jibs include the Maxjibs' efficient semi-elliptical shape for optimum performance even when reefed. Already compromised when fully deployed, an overlapping furling genoa 114 cannot furl to useful self-tacking size. Contrarily, a 100% triangular jib is virtually useless in less than 15 to 20 knots of wind. In addition to its performance deficiencies, the separate port and starboard sheets of a reefed furling genoa demand increasing levels of crew skill and strength as conditions deteriorate. A failed maneuver inevitably causes diverse problems ranging from loss of headway to winch-related crew injuries.

If a tack or jibe is abandoned, the boat loses even more headway, the genoa can be damaged, or failure to clear an obstacle or danger can result in damage to boat or crew. Tacking long-footed genoas is always fatiguing and often dangerous. In direct opposition, Crew error is not a factor in tacking and jibing a self-tacking sail, and the maneuver will always succeed if the boat has enough power to drive through the wind and wave action. Assuring that power is what the increased surface and efficient shape of System sails are about, and the "turbo" effect of overlapping system sails lends further assurance by virtue of their automatically energy storage and release cycle as a boat approaches the axis of the wind. The power is there when the boat most needs it.

Overlapping Maxjib 26 is self-boomed, making it stable while sailing downwind. Similar stability for overlapping genoas or free flying sails requires that crewmembers set a lateral support pole from the mast, Such multi-line maneuvers are crew-intensive and hazardous to boat and crew. In practice, free flying sails and lateral support poles go largely unused shorthanded boats. Unpoled genoas flog loudly and violently in downwind conditions, reducing sail life, comfort aboard and average boat speed.

Sailing downwind with a self-boomed Maxjib avoids the foregoing problems entirely by eliminating poles and external jib booms entirely, thus assuring higher average speeds and optimum safety and comfort for small crews. The shorthanded crew's natural tendency to avoid continual lateral pole sets, pole takedowns, and sail changes becomes irrelevant because just two easily managed self-tacking System sails provide the right sail area for any condition, upwind or downwind. Nor is a dangerous swinging jib boom an issue.

In fact, overlapping Maxjib 26 is a new type of sail, a self-tacking sail that reefs easily and has the surface area of an overlapping genoa. Lower cost and more efficient form make the sail a highly effective and unexpected alternative to costly, inconvenient free-flying light air sails and costly tall-rig options.

Overlapping Maxjib 26: Installation

1. A fully hoisted overlapping Maxjib 26 appears in FIG. 1. A reefed configuration appears in FIG. 3.
2. With overlapping Maxjib 26 on deck, attach halyard 15 to its head and deck-mounted strop 58 to its tack. Attach downhaul 52 to metal grommet 75 located approximately twenty-centimeters below the sail's head 98 and lead it through a deck-mounted pulley 21 and eventually aft to the cockpit area.
3. Tie or shackle self-tacking sheet 64 to a deck-mounted padeye 25 located on one side of the boat's deck then lead it through a first pulley 21 shackled to clew ring 22 then through a second pulley 21 fixed to a deck-mounted padeye the opposite side of the boat's deck, then aft to the cockpit, as seen in FIG. 5.
4. Begin hoisting the sail slowly, bringing successive sail installation components to a convenient working level. As each batten, batten box, sail hank, or other installation component attains a convenient working level, proceed as follows.
5. From the sail's head 98 downwards, insert successively the three uppermost battens through corresponding flat-end luff batten boxes 44 until each batten butts against the end of a corresponding diagonal closed batten pocket 34.
6. As each appears, clip sail hanks 46 onto inner forestay 14 or forestay 12, as the case may be.
7. Insert each of the two lowermost diagonal round battens 38 through a corresponding fork-end luff batten box 45, then into a corresponding diagonal closed batten pocket 34, or leech batten box 41 in the case of the lowermost diagonal round batten. Finally, secure the fork ends or each fork-end luff batten box 45 around the forestay with batten box fixing pin 47.
8. Measure the distance between the sail's luff at inner forestay 14 at the level of the sail's two lowest battens. That distance should be approximately twenty millimeters. If it is not, remove batten box fixing pin 47 from batten box fork ends as required, adjust the threaded stud accordingly, and replace the fixing pin, as shown in FIGS. 5 and 5*a*.
9. Once the sail has been fully hoisted and attached to its forestay, lower the sail, performing each of the following installation procedures as each element reaches a convenient working level.

10. Conforming to FIG. 5, tie one end of reef line 54 to clew ring 22, then lead that line upwards to a first pulley 21 attached to the sail at leech reef point 62; then lead the line through a second pulley 21 attached to the sail at luff reef point 60, as seen in FIG. 3; then downwards through a third, deck-mounted pulley 21; then aft to the boat's cockpit.
11. Install and adjust Dutchman System 73. As seen in FIG. 2. Dutchman tabs 70 have been sewn to the sail in accordance with the Dutchman installation manual supplied with each System. After attaching each Dutchman vertical control line 72 to its respective tab, lace each control line upwards through corresponding Dutchman eyelets 69, exit at the uppermost eyelet, and connect each line to topping lift 55 using the parts provided with Dutchman deployment control System 73. When fully installed, the Dutchman control lines will lie parallel to the sail's luff. Skilled sailmakers are familiar with deck layouts for self-tacking sheets as well as Dutchman installation and adjustment.

Overlapping Maxjib 26: Operation

1. Sail Deployment or "hoisting" requires only attaching halyard 15 to the head 98 of overlapping Maxjib 26 and pulling on the halyard. As the sail goes up, it automatically unfolds without flogging by virtue of its Dutchman deployment control System 73.
2. Self-tacking sheet 64 controls the angle of the sail to the wind.
3. To reduce the sail's area, or "reef" it, release halyard 15 and take in reef line 54, thus allowing the sail to descend to the desired reef level. Downhaul 52 is available to assist in lowering the sail where, for example, the wind direction is aft of a boat's beam.
4. As an initial reef level is set, the sail's first round batten 38 assumes a horizontal position and is held tightly against the foot of the sail by reef line 54. Topping lift 55, along with the Dutchman control lines, maintains equal upward tension along the sail's foot 101. This constitutes a new, unforeseen use for a Dutchman system.
5. The two lowermost battens of overlapping Maxjib 26 are of the same type and length, and they tack and jibe clear of companion rig elements whether the sail if fully deployed, reefed, or fully lowered.
6. Boats that frequently encounter heavy weather conditions might have more than one reef level. Procedure for setting a second reef is identical to that for the first reef. The lowermost and second round battens have identical length, hence both clear companion rig elements in a reefed configuration. Applicant used two reefs on a first prototype Maxjib but eventually found one reef sufficient. One skilled in the art will be familiar with placing reef levels that correspond to the conditions a boat most frequently encounters.
7. Tacking and jibing a sail controlled by a single self-tacking sheet 64 eliminates the need for crewmembers to alternate of port and starboard sheets. The helmsman simply turns the boat through the axis of the wind and continues on the new course.
8. Unexpectedly, a boat sailing downwind with a self-tacking Maxjib and a mainsail on opposite sides of the boat, or "wing and wing", can maintain a course 20-degrees beyond the point at which a conventional headsail would jibe. As a result, a boat's mainsail can be trimmed to a more stable, safer angle relative to the wind, that is, approximately 20-degrees inside of the point at which it would normally jibe. This leaves a margin of approximately 20-degrees for steering errors, which would not be available with conventional counterpart sails in comparable downwind circumstances.
9. Accidentally jibing a boomed mainsail imposes serious risk to boat or crew. Accidentally jibing with a headsail having port and starboard sheets puts the sail aback causing the boat to be uncontrollable until the sheets are alternated.
10. Accidentally jibing a Maxjib or Maxmain does not have such consequences. The sails' large roach area acts as an air brake as the sail jibes. Accordingly, reduced anxiety allows a helmsman's attention to focus on maintaining a stable course downwind as opposed to constantly correcting course to thread the fine line between safe, comfortable downwind sailing and an accidental jibe. The increased downwind safety margin makes for a more stable platform, thus minimizing both the fatigue that inevitably exposes crew and boat to increased risks and physical demands on helmsman and autopilot.
11. To lower overlapping Maxjib 26, release halyard 15 and, if necessary, pull on downhaul 52. The sail descends without flogging or on-deck sail handling. The "Dutchman" combines with the sail's specific batten disposition to eliminate flogging and assure automatic folding or "flaking" as the sail descends. As diagonal battens descends along a companion diagonal forestay, each one assumes a horizontal position as it approaches the foot area of the sail, automatically folding or "flaking" the sail without crew intervention.

Non-overlapping Maxjib 28: Rationale

Rationale for non-overlapping Maxjib 28 follows closely that for overlapping Maxjib 26. The smaller, non-overlapping Maxjib meets the needs of boats with twin headstay configurations or those of boats intended for use in consistently high wind speeds. Like all System sails, non-overlapping Maxjib 26 assures optimum sail efficiency, maximum area and reduced heeling.

Non-overlapping Maxjib 28: Installation and Operation

Installation and operation of non-overlapping Maxjib 28 mirror those of overlapping Maxjib 26.

Self-boomed Maxmain 30: Rationale

1. Self-boomed Maxmain 30 brings comprehensive advantages to hoisted mainsails and assures optimum interface between a boat's standing sails. Maxmain performance, convenience, and cost objectives resemble those for Maxjibs and will not be repeated.
2. If a rigid external spar hits the water in conditions of extreme heel or hits a boat's rigging during an accidental jibe, the spar can break or dismast the boat. Similar rig contact by a sail having only semi-rigid battens instead of a rigid spar would not produce such catastrophic results. At worst, a batten could break, a relatively insignificant event as opposed to what is usually a dangerous accident. Most importantly, contact between a semi-rigid batten and a boat's rigging or the water would not cause a dismasting.
3. As concerns tacking and jibing: during thousands of tacks and jibes the test boat's prototype Maxmains crossed permanent backstay 18 without a single instance of batten breakage or unusual sail wear. At no time was batten-backstay contact remotely hazardous to boat or crew.
4. Mainstream market demand has long called for economical, easily handled sail configurations that do not compromise sailing performance. The foregoing discussion of other System embodiments reveals how the System meets that demand with a wing-like, self-boomed hoisted sail costing less than a counterpart-hoisted mainsail set from an external spar.

Self-boomed Maxmain 30: Installation and Operation

In most respects, installation and use of self-boomed Maxmain 30 follows procedures set forth above for the installation and use of Maxjibs 26 and 28.

1. However, luff connection hardware differs somewhat. Self-boomed Maxmain installation involves inserting sail slides 48 through mast track gate 120 into mast track 11 then finally closing mast track gate 120 once the sail has been fully hoisted with all sail slides inserted into the track.
2. Aside from the above variance, Maxmain and Maxjib installation mirror each other as concerns installing halyard 15, the sail's battens, Dutchman deployment control System 73, a self-tacking sheet 64, and Dutchman or Lazy Jack deployment control lines.
3. Reefing self-boomed Maxmain 30 begins with releasing halyard 15, then taking in reef line 54 until the aft end of the sail's second batten has butted against the aft end of the sail's bottom diagonal batten, at which point its sail slide will be supported by mast track insert 118. If needed, downhaul 52 can be used to assist in lowering the sail. FIG. 4*a* shows details of a Maxmain in reefed configuration.
4. Secure reef line 54, fixing the triangulation between the sail's first horizontal batten, its bottom diagonal batten and the companion mast. Re-tension halyard 15 and secure downhaul 52.
5. If additional reef levels are present, each is set as above. Once set, each reef level sequentially reinforces the reefing triangle.
6. As it is lowered, self-boomed Maxmain 30 neatly flakes itself. Outhaul 52 is available to assist lowering as desired, for example, with the wind aft of the boat's beam.
7. Once the sail is fully lowered, it can be more compactly stowed by releasing the snap shackle 116 attached to the lower end of strop 58 from its corresponding deck-mounted padeye 25, then detaching the batten box fixing pin 47 from corresponding sail slide 48. Thus freed from mast track 11, the luff end of the sail's lowest batten can be raised to a horizontal level and fixed there using strop 58, thus enabling use of a conventional stowage bag. This configuration is seen in FIG. 10. Alternatively, the lower triangle of the sail can be used as a sunshade or water catchment ramp, as shown in FIG. 10*a*.

External Spar Maxmain 32: Rationale, Installation and Use

Like other System embodiments, External spar Maxmain 32 required universally applicably maximum roach parameters. Those parameters allow a large roach, overlapping mainsail attached to a rigid spar to be used on any conventionally rigged sailboat. The installation and use of external spar Maxmain 32 replicate those of self-boomed System sail embodiments except that the foot of an external spar Maxmain is horizontal, not diagonal. The sail's horizontal foot connects to a rigid, horizontal boom, and its foot tension is adjusted by an outhaul in the customary manner, a configuration well-known to one skilled in the art. A fully deployed external spar Maxmain 32 is seen in FIG. 1.

The rationale underlying external Maxmain 32 differs somewhat from that of self-boomed Maxmain 30. Nearly all existing sailboats set their mainsail from an external rigid boom, and many prospective boat owners will question the wisdom of abandoning the proven rigid boom concept for a self-boomed mainsail. These facts establish an inescapable mainsail-marketing issue that is resolved by providing an option that combines sailors' existing hardware habits with Optimized mainsail geometry. That rationale parallels that for marketing a self-boomed but triangular sail in order to target specific markets.

Logically, any sailmaker seeks to obtain maximum sales to a broad-based market segment. The mainsail market is presently composed of boats with rigid external booms. Boat owners are going to be unwilling to throw away those booms and, indeed, their existing mainsails. For that overwhelming majority of owners, the possibility of using an Optimized System Maxmain with their existing boom will be an extremely attractive idea. For many of those owners, retrofitting an Optimized Maxmain leech area to their existing mainsail will be an attractive initiation to Optimized sail performance and efficiency at low initial cost.

Applicant foresees that the sale of externally boomed Maxmains will constitute an important transitional phase in bringing the System and its unique advantages to the attention of the mainstream sailboat market. As this familiarization process evolves, Applicant foresees both boat builders and prospective boat buyers increasingly opting for self-boomed Maxmains since they are beginning without any boom whatever. Since most boats have no jib boom, Applicant believes that market penetration of self-boomed Maxjibs will be more immediate than self-boomed Maxmains, and that proliferation of self-boomed conventional headsails will provide even added emphasis to the advantages of self boomed Maxjibs and Maxmains.

Conclusions, Ramifications and Scope

Accordingly, the reader will see that the System enables a heretofore-inconceivable reconciliation of optimum performance and optimum convenience for any sailboat. The System delivers its benefits in what has been heretofore an impossible context: conventional sailboat rig geometry.

That rig geometry has perpetuated the worst possible form for a sail, the triangular form, and designers have simply "made do" with that geometry for the last hundred years. Not only has the System made semi-elliptical, overlapping sails feasible for any conventionally rigged sailboat, but it has converted that geometry to a considerable asset. Historically, rig elements have impeded tacking and jibing and precluded overlapping semi-elliptical sails entirely.

The system uses those apparently obstructive rig elements to trigger an energy storage cycle that automatically, and unexpectedly "turbocharges" a boat's forward movement at the end of each tack or jibe. It is at precisely that moment that a tack or jibe is most likely to fail for want of boat momentum or, in the case of conventional genoas, because of crew error. With System sails, maximum momentum is assured, and crew error is eliminated entirely.

Beyond enabling the foregoing unexpected benefits for any conventional sailboat, the system assures self-booming and self-vanging for its sails, thereby allowing boat owners to eliminate heavy, costly external spars for both headsails and mainsails. The consequent reduction in weight on deck and aloft combines with elliptical sail form to further reduce heel. The importance of reduced heel cannot be overemphasized, both in terms of forward motive power and crew comfort and safety. Triangular sails exacerbate heel. System sails minimize heel.

The heel-reducing synergism between reduced weight on deck and semi-elliptical sail form is at once formidable and unprecedented. The System's unique downwind sailing stability assures optimum boat stability and a 20% steering safety margin for the helmsman, constituting yet another synergism created by System sails. Similarly, maximum safety and for boat users combine with reduced cost for both the buyer and the builder. These results establish unprecedented economic possibilities and new markets for boat builders and sailmakers.

The system introduces entirely new types of sails, self-boomed sails including overlapping Maxjibs, which resemble the wing of a butterfly. Sailing technology that mirrors nature is not only functionally sound, but it also carries considerable market appeal. In the case of an overlapping Maxjib, a single sail combines safe, low effort self-tacking and optimal sail power in wind speeds as low as five knots up to maximum conditions. The Maxjib, like all System sails, enjoys 100% cockpit control cockpit thereby eliminating dangerous on-deck sail handling.

The market possibilities of the System are extensive in the present market climate, which favors convenience and safety priorities. Notwithstanding, The System's comprehensive properties enable an effective response to any shift in market sentiment towards performance priorities. Heretofore, conventional sail form imposed an election between performance priorities as opposed to convenience and safety priorities. The System renders that dilemma obsolete.

The System unites known and new elements to achieve unexpected new results that include:

1. Unprecedented hoisted sails that eliminate dangerous on-deck sail handling, converting risk to security.
2. Universal Optimized roach parameters for each System sail embodiment, enabling Optimized semi-elliptical self-tacking mainsails and headsails for any sailboat.
3. A cost-effective alternative to taller masts, yielding major cost savings for boat buyers and boat builders alike.
4. 30% more sail area with no increase in rig height: a new economics for boat building.
5. 15% less heel, thereby reducing crew fatigue and increasing safety.
6. Faster, relaxed upwind and downwind sailing. Reduced heel and less fatigue improve crew performance.
7. Self-boomed, hoisted self-tacking sails with sufficient area for light conditions and cockpit-controlled single-line reefing for heavier conditions. For maximum safety and convenience, all sail maneuvers are 100% cockpit-controlled.
8. Ideal interface between headsail and mainsail triggers synergism. Where conventional systems create negative turbulence, System headsails and mainsails interface with maximum harmony.
9. System design makes optimum use of currently available materials and methods while accommodating evolving technology.
10. New products for long-standing unsatisfied market demands.
11. Hoisted overlapping Maxjibs and Maxmains eliminate costly inconvenient free flying sails and lateral support poles.
12. System sails impose no modification to boat or rig but rather convert below-deck sail stowage space to comfortable living space. Space aboard a sailboat is precious. The system optimizes not only the sailing experience, but also life aboard.

System Sails: Additional Ramifications

1. Reduced heel is an important factor when conditions or boat use require "motor sailing". In such cases, a self-boomed, hoisted System headsail can be used fully deployed or reefed, reducing wear on a boat's larger, more costly mainsail, which may have an external spar. Taking such an external spar out of action while motor sailing is highly desirable from every point of view.
2. In addition, workboats such as fishing trawlers can benefit from the reduced heel of System sails to gain a more stable working platform. Minimum heel and a low center of effort naturally complement non-ballasted workboat hulls such as trawlers.
3. Optimized roach parameters can apply equally to furling mainsails and headsails.
4. The System is appropriate to other types of wind-powered vehicles such as beach-sailing craft and iceboats.
5. The System sail concept can extend to produce furling mainsail and headsail configurations as well as unique, aerodynamic and automatic on-deck headsail and mainsail stowage Non-restrictive Scope of the Invention Although the above description includes specific examples, these should not be construed as limiting the scope of the invention, but as merely providing illustrations of some of the presently preferred embodiments of it. Consequently, the scope of the invention should be determined by the appended claims and their legal equivalents, rather than by the examples given.

For example:

1. The System can be used on any wind-powered vehicle including iceboats or other land vehicles
2. The end-plate effect of the System headboard combination may incorporate other functions such as electrical connections and solar arrays.
3. The System can assure cost-effective supplementary wind power for commercial users such as fishing trawlers or "Club Med-type" passenger vessels by fully exploiting available vertical sail space.
4. Similarly, the System's optimization of shorter masts allows boat building economies in ballast and rigging wire. Conventional sails cannot approach such performance and economic benefits.
5. The sunshade-water catchment feature of system sails can be combined with solar panels or solar cells to provide alternate energy capabilities, which have both economic and ecological ramifications.
6. In summary, the System enables maximum sail power and efficiency for any sailing vessel despite the confines of conventional sailboat rig geometry.

Request for Constructive Assistance

If, for any reason, this Application is not now believed to be in full condition for allowance, Applicant respectfully request the constructive assistance and suggestions of the Examiner pursuant to M.P.E.P. Sec. 2173.02 and Sec. 707.070), first, as to place all or part of the Application in allowable form without further proceedings.

Sequence Listing

Not Applicable

I claim:

1. A sail system comprising a vessel, a mast, a sheet, a sail having a luff edge, a foot edge, a leech edge, a head, a tack, a clew, and means for attaching the head, tack and clew of said sail to a vessel, said sail comprising:

A. a maximum foot length no greater than 100% "j";

B. a plurality of sail hanks;

C. a diagonal batten oriented at an angle of approximately ninety degrees to the luff of said sail, said batten having a first end contained by a first batten receptacle having forestay connect ability and being attached at or near the luff of said sail and a second end contained by a second batten receptacle attached to said sail at or near the clew of said sail, each such batten receptacle being attached to said sail in the axis of said diagonal batten;

D. a batten pocket attached to said sail in the axis of said diagonal batten;

E. an approximately elliptical positive leech curve descending from the head of said sail through successive leech limit points to the clew of said sail, each such leech limit point deriving as follows:

i. said sail's head-to-clew diagonal being a line from the head to the clew of said sail;

ii. said sail's vertical extremities construction line being a vertical line disposed at or forward of said sail's tack and running upwards from the level of said sail's clew to the level of its head;

iii. said vertical extremities construction line comprising segments of equal height delimited by horizontal construction lines;

iv. each such horizontal construction line running horizontally aft from said vertical extremities construction line to the companion mast of said sail;

v. said sail's leech measurement intersections lying at respective intersections between each of said sail's horizontal construction lines and its head-to-clew diagonal;

vi. said sail's respective forward girth segments each being equal to the horizontal distance from successive leech measurement intersections to the luff of said sail;

vii. from uppermost to lowermost, each of said sail's aft girth segments being approximately equal in length to the following percentage of the length of respective corresponding forward girth segments: 80%, 30%; 20%, 6%, and 2%, said percentages corresponding to a preferred six-segment vertical construction line;

viii. each of said sail's leech limit points lying along a corresponding horizontal construction line at a distance aft of the luff of said sail equal to the combined length of corresponding forward and aft girth segments of said sail;

F. said sail's leech perimeter beginning at its head and descending sequentially through successive leech limit points to terminate at said sail's clew;

whereby a low cost, hoisted, non-overlapping, self-tacking, self-boomed headsail employs predetermined leech parameters to reconcile optimum performance and optimum convenience.

2. The sail system of claim 1, with the following distinguishing or additional features:

a headboard-end plate combination constructed of rigid or semi-rigid metallic or composite material having either a conventional or light and radar reflective surface, such material comprising companion port and starboard headboard plates each having one or more pairs of integral or mechanically attached end plates, each such end plate being disposed at an angle of approximately ninety-degrees relative to its companion headboard plate, the upper extremity of each such port or starboard headboard plate being attached to a corresponding side of said sail at a point approximately level with the upper extremity of said sail;

whereby a new, unexpected combination produces a synergism that enhances non-overlapping headsail performance and safety while optimizing inter-sail interface.

3. The sail System of claim 1 with the following distinguishing or additional properties:

A. The sail's foot being approximately horizontal and being connected to an external spar;

whereby System benefits extend to non-overlapping self-tacking jibs attached to external jib spars.

4. The sail system of claim 1 with the following distinguishing or additional properties:

A. one or a plurality of external batten reduction combinations, each such external batten reduction combination comprising a high-density batten sleeve and a companion semi-rigid batten;

B. each such high-density batten sleeve comprising a combination of diagonal or vertical fibers and horizontal fibers, such fibers having a reference density ratio of approximately two diagonal or vertical fibers to one horizontal fiber;

C. each such high-density batten sleeve having one or more variable density zones proximate to rig contact and sail folding points in which zones diagonal or vertical fiber density is reduced by fifteen-percent and horizontal fiber density is reduced by thirty-percent;

D. each such semi-rigid batten having one or more variable density batten zone proximate to corresponding rig contact points in which zones batten rigidity is reduced by fifteen-percent;

E. each such external batten reduction combination having a collective rigidity level approximately equal to that of the collective rigidity level of the respective batten and batten pocket it replaces;

whereby lighter external batten reduction configurations enable foldable self-boomed, self-tacking non-overlapping hoisted headsails that reconcile optimum performance and convenience.

5. The sail system of claim 1 with the following distinguishing or additional properties:

A. one or a plurality of integral batten substitute zones, each such integral batten substitute zone being disposed in the axis of a replaced batten, and having a width approximately equal to a replaced batten pocket; each such integral batten substitute zone comprising a combination of diagonal or vertical fibers and horizontal fibers mechanically or chemically integrated with the body of the sail in the axis of a replaced batten and batten pocket;

B. said fibers having a reference density ratio of approximately two diagonal or vertical fibers to one horizontal fiber;

C. each such integral batten substitute having one or more variable density zones proximate to rig contact points and sail folding points in which zones diagonal or vertical fiber density is reduced by fifteen-percent and horizontal fiber density is reduced by thirty-percent;

D. each such integral batten substitute having a collective rigidity level approximately equal to that of the batten and batten pocket it replaces;

whereby a new use of fiber-orienting-sail-making-technology unexpectedly yields batten-free self-tacking, self-boomed, non-overlapping semi-elliptical hoisted headsails with self-supported positive roach.

6. The sail system of claim 1, with the following distinguishing or additional properties:

A. two or more diagonal battens;

B. a topping lift;

C. a downhaul;

D. a single-line reefing system comprising cordage, pulleys and fairleads;

E. a deployment control configuration such as a Dutchman or Lazy Jack configuration;

whereby a new combination produces a non-overlapping, self-tacking, self-boomed hoisted headsail unexpectedly combining maximum-area-semi-elliptical shape with comprehensive cockpit sail control.

7. A sail system comprising a vessel, a mast, a sheet, a sail having a luff edge, a foot edge, a leech edge, a head, a tack, a clew, and means for attaching the head, tack and clew of said sail to a vessel, such sail comprising:

A. a maximum foot length no greater than 100% "j";

B. a plurality of sail hanks;

C. a diagonal batten oriented at an angle of approximately ninety degrees to the luff of said sail, said batten having a first end contained by a first batten receptacle having forestay connect ability and being attached at or near the luff of said sail and a second end contained by a second batten receptacle attached to said sail at or near the clew of said sail, each such batten receptacle being attached to said sail in the axis of said diagonal batten;

D. a batten pocket attached to said sail in the axis of said diagonal batten, and;

E. an approximately elliptical positive leech curve descending from said sail's head through successive leech limit points to the clew of said sail, each such leech limit point deriving as follows:

i. said sail's initial Maxjib rig contact point being a lowermost point of contact between the leech of said sail and a most proximate companion rig element;

ii. said sail's overlapping Maxjib rig contact diagonal being a line descending diagonally from said sail's head to its initial Maxjib contact point;

iii. said sail's vertical extremities construction line being a vertical line disposed at or forward of the sail's tack and running upwards from the level of said sail's initial Maxjib rig contact point to the head of said sail;

iv. said vertical construction line comprising segments of equal height delimited by horizontal construction lines;

v. each such horizontal construction line running horizontally aft from said vertical extremities construction line through the companion mast of said sail;

vi. said sail's leech measurement intersections lying at respective intersections between each of said sail's horizontal construction lines and its overlapping Maxjib rig contact diagonal;

vii. said sail's respective forward girth segments each being equal to the horizontal distance from successive leech measurement intersections to the luff of said sail;

viii. from uppermost to lowermost, the length of each of said sail's aft girth segments being approximately equal to the following percentage of the length of corresponding forward girth segments: 90%, b. 72%; c. 43%, d. 24%, e. 6% said percentages corresponding to a preferred six-segment vertical construction line;

ix. each of said sail's leech limit points lying along a horizontal construction line at a distance aft of the sail's luff equal to the combined length of corresponding forward and aft girth segments of said sail;

F. said sail's leech perimeter beginning at said sail's head and descending sequentially through successive leech limit points to terminate at the clew of said sail;

whereby a low cost, hoisted, overlapping self-tacking headsail combines semi-elliptical shape and integral booming and vanging to assure optimum performance and convenience in all conditions.

8. The sail system of claim 7, with the following distinguishing or additional features:

a headboard-end plate combination constructed of rigid or semi-rigid metallic or composite material having either a conventional or light and radar reflective surface, such material comprising companion port and starboard headboard plates each having one or more pairs of integral or mechanically attached end plates, each such end plate being disposed at an angle of approximately ninety-degrees relative to its companion headboard plate, the upper extremity of each such port or starboard headboard plate being attached to a corresponding side of said sail at a point approximately level with the upper extremity of said sail;

whereby a new, unexpected combination produces a synergism that enhances overlapping headsail performance and safety while optimizing inter-sail interface.

9. The sail system of claim 7 with the following distinguishing or additional properties:

A. one or a plurality of external batten reduction combinations, each such external batten reduction combination comprising a high-density batten sleeve and a companion semi-rigid batten;

B. each such high-density batten sleeve being constructed of sail cloth composed of diagonal or vertical fibers and horizontal fibers, such fibers having a reference density ratio of approximately two vertical or diagonal fibers to one horizontal fiber;

C. each such high-density batten sleeve having one or more variable density zones proximate to rig contact and sail folding points in which zones vertical or diagonal fiber density is reduced by fifteen-percent, and horizontal fiber density is reduced by thirty-percent;

D. each such semi-rigid batten having one or more variable density batten zones proximate to rig contact points in which zones batten rigidity is reduced by fifteen-percent;

E. each such external batten reduction combination having a collective rigidity level approximately equal to that of the collective rigidity level of the respective batten and batten pocket it replaces;

whereby new external batten reduction configurations unexpectedly enable lighter overlapping, self-tacking, self-boomed hoisted headsails that optimize tacking and jibing.

10. The sail system of claim 7 with the following distinguishing or additional properties:

A. one or a plurality of integral batten substitute zones, each such integral batten substitute zone being disposed in the axis of a replaced batten and having width approximately equal to a replaced batten pocket; each such integral batten substitute zone comprising a combination of diagonal or vertical fibers and horizontal fibers mechanically or chemically integrated with the body of the sail in the axis of a replaced batten and batten pocket;

B. said combination of fibers having a density ratio of approximately two diagonal or vertical fibers to one horizontal fiber;

C. each such integral batten substitute having one or more variable density zones proximate to rig contact points and sail folding points in which zones diagonal or vertical fiber density is reduced by fifteen-percent, and horizontal fiber density is reduced by thirty-percent;

D. each such integral batten substitute having a collective rigidity level approximately equal to that of the batten and batten pocket it replaces;

whereby a new use of existing fiber-orienting sail making technology yields batten-free, self-supporting overlapping, semi-elliptical hoisted headsails optimized for tacking and jibing.

11. The sail system of claim 7 with the following distinguishing or additional features:

A. two or more diagonal battens;

B. a topping lift;

C. a downhaul;

D. a single-line reefing system comprising cordage, pulleys and fairleads;

E. a deployment control configuration such as a Dutchman or Lazy Jack configuration;

whereby a new use of sail making materials unexpectedly results in an overlapping, self-tacking, self-boomed hoisted headsail combining maximum-area-semi-elliptical shape with comprehensive cockpit sail control.

12. A sail system comprising a vessel, mast, a sheet, a sail having a luff edge, a foot edge, a leech edge, a head, a tack, a clew, and means for attaching the head, tack and clew of said sail to a vessel, each such sail comprising:

A. a diagonal foot having a first end intersecting the luff of said sail at an angle of approximately eighty-five degrees and a second end intersecting the leech of said sail at an angle of approximately ninety degrees, the clew point of said sail being forward of a vessel's permanent backstay;

B. a diagonally-oriented semi-rigid batten approximately equal in length to the foot of said sail attached to said sail in the axis of said foot; said diagonal batten having a first end contained by a first batten receptacle having mast connect ability and being attached to said sail at or near the luff of said sail and a second end contained by a second batten receptacle attached to said sail at or near the clew of said sail, each such batten receptacle being attached to said sail in the axis of said diagonal batten;

C. a diagonal batten pocket attached to said sail in the axis of said diagonal batten;

D. a horizontal semi-rigid batten running from a point at or near the clew of said sail to the luff of said sail; said horizontal batten having a first end contained by a first batten receptacle having mast connect ability and being attached to said sail at or near the luff of said sail, and a second end contained by a second batten receptacle attached to said sail at or near the clew of said sail, each such batten receptacle being attached to said sail in the axis of said horizontal batten;

E. a horizontal batten pocket attached to said sail in the axis of said horizontal batten;

F. an approximately elliptical leech curve descending from said sail's head through successive leech limit points to its clew, each such leech limit point deriving as follows:

i. said sail's initial Maxmain rig contact point being a lowermost point of contact between the leech of said sail and a most proximate companion rig element;

ii. said sail's backstay contact diagonal being a descending diagonal line from the head of said sail to its initial Maxmain rig contact point;

iii. said sail's vertical extremities construction line being a vertical line disposed at or forward of the tack of said sail and running upwards from the level of initial Maxmain contact point to the level of the head of said sail;

iv. said vertical extremities construction line comprising segments of equal height delimited by horizontal construction lines;

v. each such horizontal construction line running horizontally aft from said vertical extremities construction line and terminating at a point approximately ten centimeters aft of the clew of said sail;

vi. said sail's respective leech measurement intersections lying successively at the intersection between each of said sail's horizontal construction lines and said sail's backstay contact diagonal;

vii. said sail's respective forward girth segments each being equal to the horizontal distance from successive leech measurement intersections to the luff of said sail;

viii. from uppermost to lowermost, the length of each of said sail's aft girth segments being approximately equal to the following percentage of the length of corresponding forward girth segments: 90%, b. 72%; c. 43%, d. 24%, e. 6% said percentages corresponding to a preferred six-segment vertical construction line;

ix. each of said sail's leech limit points lying along a corresponding horizontal construction line at a distance aft of said sail's luff equal to the combined length of the corresponding forward and aft girth segments of said sail;

G. said sail's leech perimeter beginning at its head and descending sequentially through successive leech limit points to terminate at the clew of said sail;

whereby a self-boomed, hoisted, semi-elliptical, mainsail eliminates external spars while assuring greater safety, convenience, and performance than boomed or furling mainsail configurations.

13. The sail system of claim 12, with the following distinguishing or additional features:

a headboard-end plate combination constructed of rigid or semi-rigid metallic or composite material having either a conventional or light and radar reflective surface, such material comprising companion port and starboard headboard plates each having one or more pairs of integral or mechanically attached end plates, each such end plate being disposed at an angle of approximately ninety-degrees relative to its companion headboard plate, the upper extremity of each such port or starboard headboard plate being attached to a corresponding side of said sail at a point approximately level with the upper extremity of said sail;

whereby a new, unexpected mainsail produces a synergism that enhances mainsail performance and safety while optimizing inter-sail interface.

14. The sail System of claim 12 with the following distinguishing or additional properties:

A. the sail's foot being approximately horizontal and being connected to an external spar;

whereby System benefits extend to boomed mainsails.

15. The sail system of claim 12 with the following distinguishing or additional properties:

A. one or a plurality of external batten reduction combinations, each such external batten reduction combination comprising a high-density batten sleeve and a companion semi-rigid batten;

B. each such high-density batten sleeve comprising a combination of diagonal or vertical fibers and horizontal fibers, such fibers having a reference density ratio of approximately two diagonal or vertical fibers to one horizontal fiber;

C. each such high-density batten sleeve having one or more variable density zones proximate to rig contact and sail folding points in which zones diagonal or vertical fiber density is reduced by fifteen-percent and horizontal fiber density is reduced by thirty-percent;

D. each such semi-rigid batten having one or more variable density batten zones proximate to rig contact points in which zones batten rigidity is reduced by fifteen-percent;

E. each such external batten reduction combination having a collective rigidity level approximately equal to that of the collective rigidity level of the respective batten and batten pocket it replaces;

whereby a new use of known batten and sail cloth materials unexpectedly results in lighter, less voluminous batten-free, overlapping semi-elliptical hoisted mainsails with self-supported positive roach.

16. The sail system of claim 12 with the follow distinguishing or additional properties:

A. one or a plurality of integral batten substitute zones, each such integral batten substitute zone being disposed in the axis of a replaced batten and having width approximately equal to a replaced batten pocket; each such integral batten substitute zone comprising a combination of diagonal or vertical fibers and horizontal fibers mechanically or chemically integrated with the body of the sail in the axis of a replaced batten and batten pocket;

B. said combination of fibers having a reference density ratio of approximately two diagonal or vertical fibers to one horizontal fiber;

C. each such integral batten substitute having one or more variable density zones proximate to rig contact points and sail folding points in which zones vertical or diagonal fiber density is reduced by fifteen-percent; and horizontal fiber density is reduced by thirty-percent;

D. each such batten substitute having a collective rigidity level approximately equal to that of the batten and batten pocket elements it replaces;

whereby a new use of fiber-orientating-sail-making-technology unexpectedly yields batten-free, overlapping semi-elliptical hoisted mainsails with self-supported positive roach.

17. The sail system of claim 12, with the following distinguishing or additional properties:

A. two or more horizontal battens;

B. a topping lift;

C. a downhaul;

D. a single-line reefing system comprising cordage, pulleys and fairleads;

E. a deployment control configuration such as a Dutchman or Lazy Jack configuration;

whereby new uses of sail making materials and new designs unexpectedly yield an overlapping, self-boomed, hoisted mainsail having maximum-area-semi-elliptical shape and comprehensive cockpit sail control.

18. The sail system of claim 12 with the follow distinguishing or additional properties:

A. the sail's foot being approximately horizontal and being connected to an external spar;

B. one or a plurality of external batten reduction combinations, each such external batten reduction combination comprising a high-density batten sleeve and a companion semi-rigid batten; each such high-density batten sleeve comprising a combination of diagonal or vertical fibers and horizontal fibers, such fibers having a reference density ratio of approximately two diagonal or vertical fibers to one horizontal fiber;

C. each such high-density batten sleeve having one or more variable density zones proximate to rig contact and sail folding points in which zones diagonal or vertical fiber density is reduced by fifteen-percent and horizontal fiber density is reduced by thirty-percent;

D. each such semi-rigid batten having one or more variable density batten zones proximate to rig contact points in which zones batten rigidity is reduced by fifteen-percent;

E. each such external batten reduction combination having a collective rigidity level approximately equal to that of the collective rigidity level of the respective batten and batten pocket it replaces;

whereby a new use of batten and sail cloth materials unexpectedly results in lighter, less voluminous mainsails for use with conventional or furling booms.

19. The sail system of claim 12 with the follow distinguishing or additional properties:

A. the sail's foot being approximately horizontal and being connected to an external spar;

B. one or a plurality of integral batten substitute zones, each such integral batten substitute zone being disposed in the axis of a replaced batten and having width approximately equal to a replaced batten pocket; each such integral batten substitute zone comprising a combination of diagonal or vertical fibers and horizontal fibers mechanically or chemically integrated with the body of the sail in the axis of a replaced batten and batten pocket;

C. said combination of fibers having a reference density ratio of approximately two diagonal or vertical fibers to one horizontal fiber;

D. Each such integral batten substitute having one or more variable density zones proximate to rig contact points and sail folding points in which zones vertical or diagonal fiber density is reduced by fifteen-percent; and horizontal fiber density is reduced by thirty-percent;

E. each such batten substitute having a collective rigidity level approximately equal to that of the batten and batten pocket elements it replaces;

whereby a new use of fiber-orienting technology unexpectedly results in lighter, less voluminous, batten-free optimized mainsails for boats having conventional or furling booms.

20. The sail system of claim 12 with the following distinguishing or additional properties:

A. A releasable tack;

B. A strop with a rapid fixation connected to said tack;

C. A through-sail grommet or faucet capable of water passage;

D. solar cells or panels attached to or integrated into the tissue of said sail;

whereby a self-boomed mainsail provides solar energy, water catchment and sunshade properties.

* * * * *